US006463225B1

(12) United States Patent
Abe et al.

(10) Patent No.: US 6,463,225 B1
(45) Date of Patent: Oct. 8, 2002

(54) DEVELOPING APPARATUS, PROCESS CARTRIDGE, FEEDING MEMBER AND AN ELASTIC SHEET

(75) Inventors: Daisuke Abe, Shizuoka-ken; Hideki Matsumoto, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/659,712

(22) Filed: Sep. 11, 2000

(30) Foreign Application Priority Data

Sep. 9, 1999 (JP) ..... 11-256417
Sep. 9, 1999 (JP) ..... 11-256419

(51) Int. Cl.[7] ..... G03G 15/08; G03G 15/10
(52) U.S. Cl. ..... 399/27; 399/61; 399/254
(58) Field of Search ..... 399/27, 30, 61, 399/62, 98, 99, 254, 256

(56) References Cited

U.S. PATENT DOCUMENTS 4,963,929 A * 10/1990 Ueda et al. ..... 399/62
4,987,452 A * 1/1991 Nakagawa et al. ..... 399/254
5,045,886 A * 9/1991 Weitzel et al. ..... 399/256
5,508,795 A * 4/1996 Kikuchi ..... 399/27
5,587,770 A * 12/1996 Jo et al.
5,612,770 A * 3/1997 Bandai et al. ..... 399/254
5,933,678 A * 8/1999 Park ..... 399/27

FOREIGN PATENT DOCUMENTS

JP 5-100571 4/1993

* cited by examiner

*Primary Examiner*—Sandra Brase
(74) *Attorney, Agent, or Firm*—Fitzpatrick, Cella, Harper & Scinto

(57) ABSTRACT

A developing device for developing an electrostatic latent image formed on an electrophotographic photosensitive member, includes a developing member for developing an electrostatic latent image formed on the photosensitive member with a developer, a detecting member for detecting the amount of developer, a stirring member for stirring the developer by rotation thereof, and a rubbing member for rubbing a surface of the detecting member. The rubbing member is a member separate from the stirring member and is rotatable integrally with the stirring member.

30 Claims, 34 Drawing Sheets

DEVELOPING APPARATUS, PROCESS CARTRIDGE, FEEDING MEMBER AND AN ELASTIC SHEET

FIELD OF THE INVENTION AND RELATED ART

The present invention relates to an image developing apparatus usable with an electrophotographic image forming apparatus, a process cartridge detachably mountable to a main assembly of the image forming apparatus, a feeding member and an elastic sheet.

An electrophotographic image forming apparatus includes an electrophotographic copying machine, an electrophotographic printer (for example, an LED printer, a laser beam printer, and the like), an electrophotographic facsimile apparatus, an electrophotographic word processor, and the like.

A process cartridge is a cartridge which integrally comprises a charging means, a developing meaning or a cleaning means, and an electrophotographic photosensitive member, and is removably installable in the main assembly of an electrophotographic image forming apparatus; and a cartridge which integrally comprises at least a developing means, and an electrophotographic photosensitive member, and is removable installable in the main assembly of an image forming apparatus.

An image forming apparatus which employed an electrophotographic image formation process employed a process cartridge system, according to which an electrophotographic photosensitive member, and one or a plurality of processing means, which works on the electrophotographic photosensitive member, are integrally assembled in the form of a cartridge removably installable in the main assembly of an image forming apparatus. Also according to this process cartridge system, the maintenance for an image forming apparatus can be performed by a user him/her self; the user does not need to rely on a service person for the maintenance. Therefore, the employment of a process-cartridge system drastically improved the operational efficiency of an image forming apparatus As a result, the process cartridge system has been widely used in the field of the image forming apparatus.

In the case of an image forming apparatus such as the above described electrophotographic image forming apparatus which employs a process cartridge system, a user him/herself must exchange a cartridge Therefore, the image forming apparatus is provided with a means for informing the user of developer depletion, for example, a developer amount detecting apparatus.

In order to detect the amount of remaining developer, it is known that a pair of electrodes in the form of a rod are placed in the developer container of a developing means, and the amount of the developer in the developer container was determined by detecting the changes which occurred to the electrostatic capacity between the two electrodes.

Japanese Laid-Open Patent Application No. 100571/1993 discloses a developer amount detecting apparatus, which employs a developer amount detecting member comprising two electrodes placed in the same plane in parallel to each other, one being in the shape of a "U", and the other being in the shape of a "I" so that they can be coupled on the same plane. This developer amount detecting member is located at the bottom portion of the developer container. This development amount detecting apparatus detects the amount of remaining developer by detecting the fluctuation in the electrostatic capacity between the parallel electrodes placed in the same plane.

SUMMARY OF THE INVENTION

It is a principal object of the present invention to provide a developing device, a process cartridge, a feeding member, and an elastic sheet usable with the developing device and the process cartridge, wherein a remaining amount of a developer can be detected substantially in real time.

It is another object of the present invention to provide a developing device, a process cartridge, a feeding member, and an elastic sheet usable with the developing device and the process cartridge, wherein performance of a mechanism for detecting a remaining amount of the developer can be maintained.

It is a further object of the present invention to provide a developing device, a process cartridge, a feeding member, and an elastic sheet usable with the developing device and the process cartridge, wherein accuracy os detection of a remaining amount of the developer can be improved.

It is a further object of the present invention to provide a developing device, a process cartridge, a feeding member, and an elastic sheet usable with the developing device and the process cartridge, wherein the developer deposited to detecting means for detection of a remaining amount of the developer can be removed.

According to an aspect of the present invention, there is provided a developing device for developing an electrostatic latent image formed on an electrophotographic photosensitive member, comprising, a developing member for developing an electrostatic latent image formed on the photosensitive member with a developer; a detecting member for detecting the amount of the developer; a stirring member for stirring the developer by rotation thereof; and a rubbing member for rubbing a surface of the detecting member, wherein the rubbing member is a member separate from the stirring member and is rotatable integrally with the stirring member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Embodiment 1

Hereinafter, an image developing apparatus, a process cartridge, an electrophotographic image forming apparatus, a scraping or wiping member or a rubbing member and an elastic sheet, which are in accordance with the present invention, will be described in more detail with reference to the appended drawings.

Referring to the accompanying drawings, a description will be provided as to a process cartridge and an electrophotographic image forming apparatus according to embodiments of the present invention.

Figure 1:
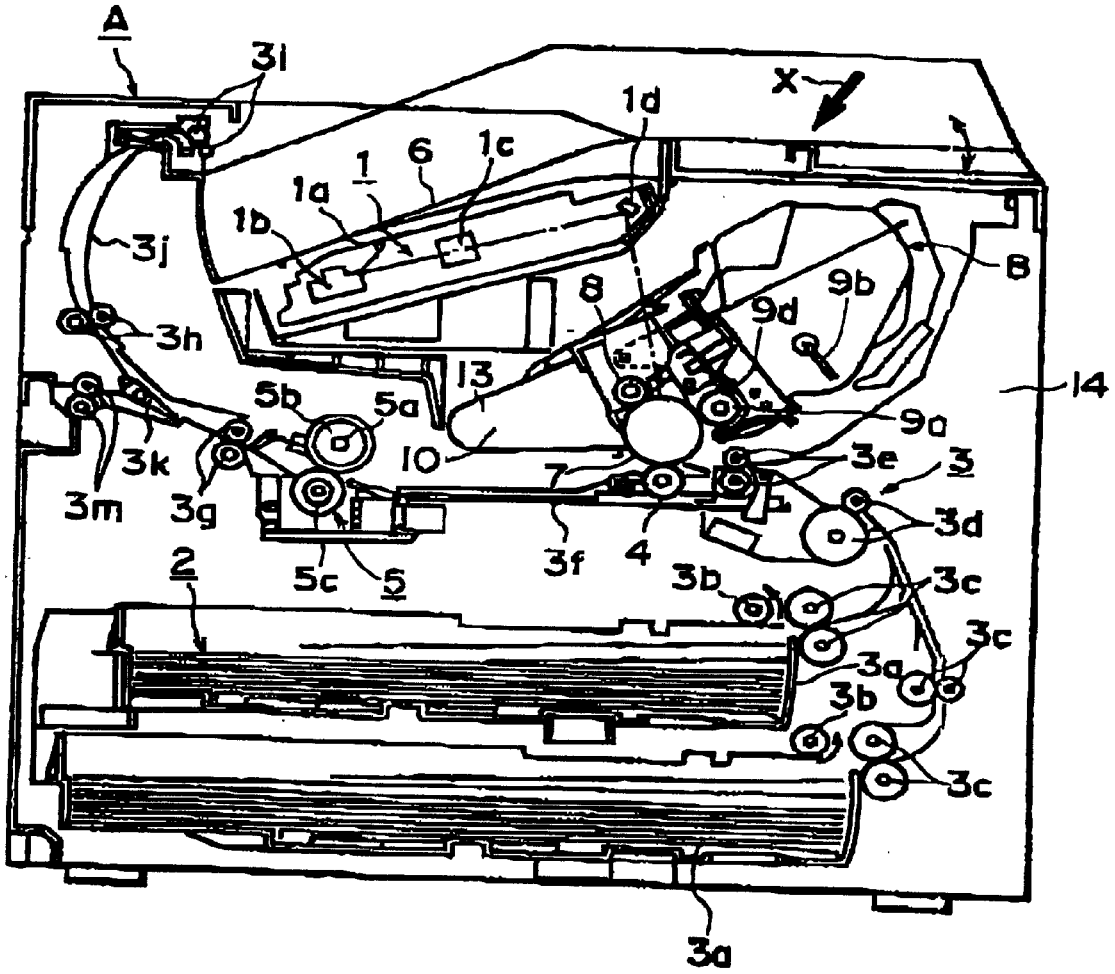
FIG. 1 is a schematic view of an example of and electrophotographic image forming apparatus in accordance with the present invention, and depicts the general structure thereof.
Figure 2:
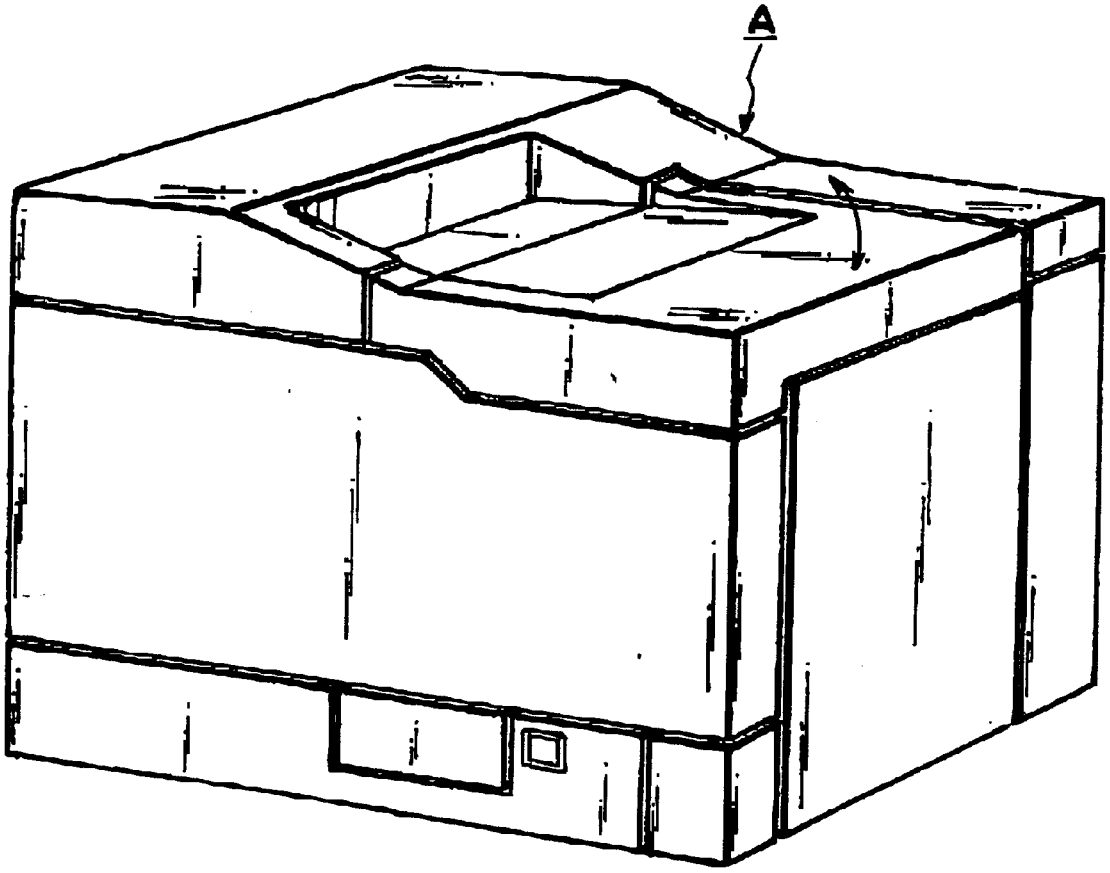
FIG. 2 is an external perspective view of the electrophotographic image forming apparatus in accordance with the present invention.
Figure 3:
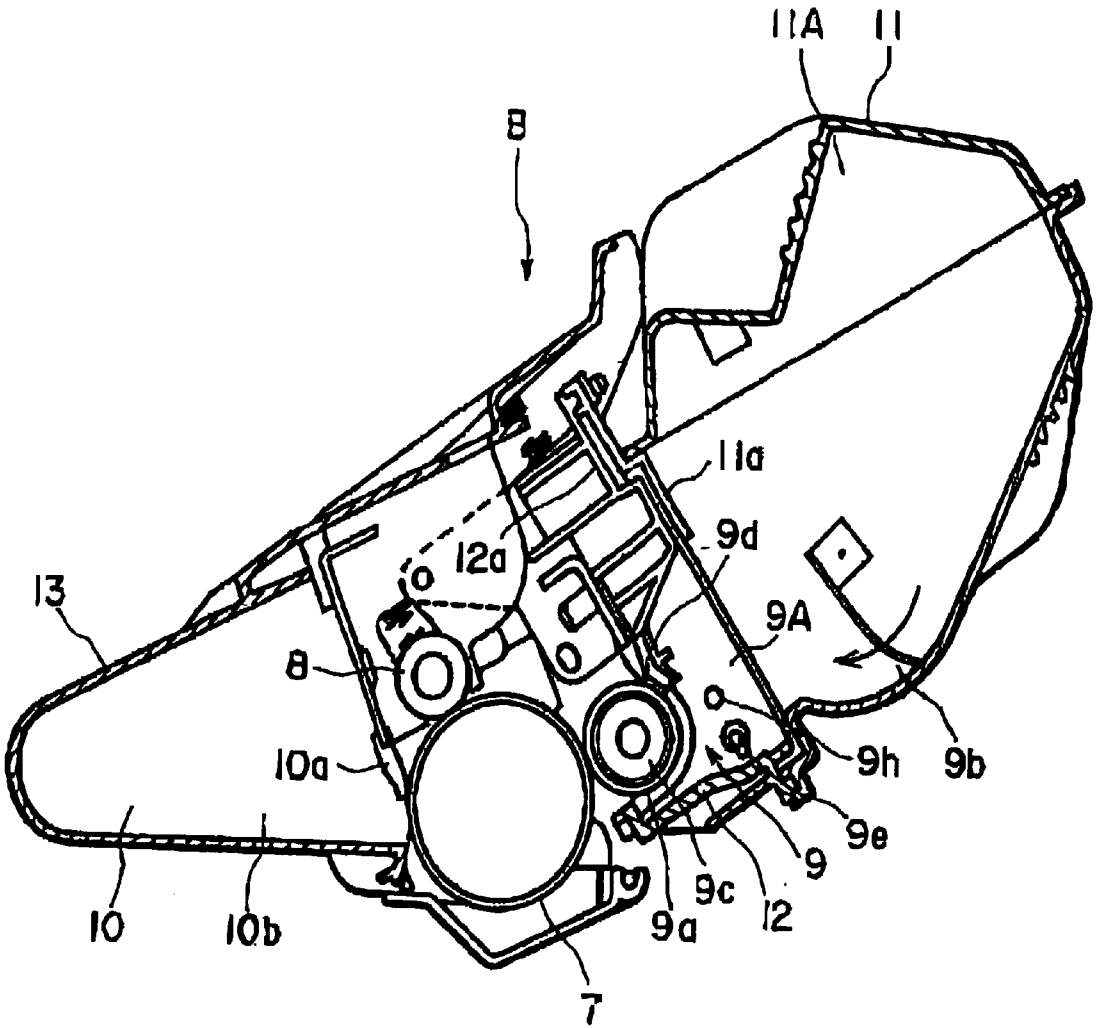
FIG. 3 is a vertical cross sectional view of a process cartridge in accordance with the present invention.

Referring to FIGS. 1–3, a description will be provided as to an electrophotographic image forming apparatus to which a process cartridge is a detachably mountable, according to one embodiment of the present invention. In this embodiment, the electrophotographic image forming apparatus is in the form of a laser beam printer A of an electrophotographic type in which images are formed on a recording material such as recording paper, an OHP sheet or textile through an electrophotographic image forming process.

The laser beam printer A comprises an electrophotographic photosensitive member, that is, a photosensitive drum 7. The photosensitive drum 7 is electrically charged by a charging roller 8 (charging means), and is exposed to a laser beam modulated in accordance with image information coming from optical means 1 including a laser diode 1*a,* a polygonal mirror 1*b,* a lens 1*c* and a reflection mirror 1*d,* so that a latent image is formed on the photosensitive drum in accordance with image information. The latent image is developed by developing means 9 into a visualized image, that is, toner image.

The developing means 9 includes a developer chamber 9A provided with a developing roller 9*a* (developer carrying member), wherein the developer in developer container 11A (developer accommodating portion) disposed adjacent to the developer chamber 9A is fed out to a developing roller 9*a* in the developer chamber 9A by rotation of a developer feeding member 9*b.* The developer chamber 9A is provided with a developer stirring member 9*e* adjacent to the developing roller 9*a* to circulate the developer in the developer chamber. The developing roller 9*a* contains therein a fixed magnet 9*c* so that developer is fed by rotation of the developing roller 9*a,* and the developer is electrically charged by triboelectric charge by the friction with a developing blade 9*d,* and is formed into a developer layer having a predetermined thickness, which layer is supplied to a developing zone of the photosensitive drum 7. The developer supplied to the developing zone is transferred onto the latent image on the photosensitive drum 7 so that toner image is formed. The developing roller 9*a* is electrically connected with a developing bias circuit, which is normally supplied with a developing bias voltage in the form of an AC voltage biased with a DC voltage.

On the other hand, a recording material 2 in a sheet feeding cassette 3*a* is fed out and supplied to an image transfer position by a pick-up roller 3*b,* a pair of feeding rollers 3*c,* 3*d,* and a pair of registration rollers, in timed relation with the formation of the toner image. In the transfer position, there is provided a transfer roller 4 (transferring means), which functions to transfer the toner image onto the recording material 2 from the photosensitive drum 7 by being supplied with a voltage.

The recording material 2 now having the toner image transferred thereonto is fed to fixing means 5 along a feeding guide 3*f.* The fixing means 5 includes a driving roller 5*c* and a fixing roller 5*b* containing therein a heater 5*a* to apply pressure and heat to the recording material 2 passing therethrough to fix the toner image on the recording material 2.

The recording material is then fed by pairs of discharging rollers 3*g,* 3*h,* 3*i* and is discharged to a discharging tray 6 along a reverse path 3*j.* The discharging tray 6 is provided on a top side of the main assembly 14 of the apparatus, that is, a laser beam printer A. A deflectable flapper 3K is usable to discharge the recording material 2 by a pair of discharging rollers without using the reversing passage 3*j.* In this embodiment, the discharging roller, 3*g,* 3*h,* 3*i,* the pair of feeding rollers 3*c,* 3*d,* the pair of registration rollers, the feeding guide 3*f,* the pair of discharging rollers and the pair of discharging rollers 3*m,* constitute sheet feeding means.

The photosensitive drum 7 after the transfer roller 4 transfers the toner image onto the recording material 2, is cleaned by cleaning means 10 so that developer remaining on the photosensitive drum 7 is removed so as to be prepared for the next image-forming-process operation. The cleaning means 10 scrapes the remaining developer off the photosensitive drum 7 by an elastic cleaning blade provided to contact to the photosensitive drum 7, and collect it in a residual developer container 10*b.*

In this embodiment, a process cartridge B includes a developing unit comprising a developer frame 11 including the developer container developer 11A accommodating the developer and the developer feeding member 9*b,* and a developing device frame 12 supporting the developing means 9 such as the developing roller 9*a* and the developing blade 9*d,* and the process cartridge B further includes a cleaning frame 13 supporting the photosensitive drum 7, the cleaning means 10 such as the cleaning blade 10*a* and the charging roller 8.

Figure 4:
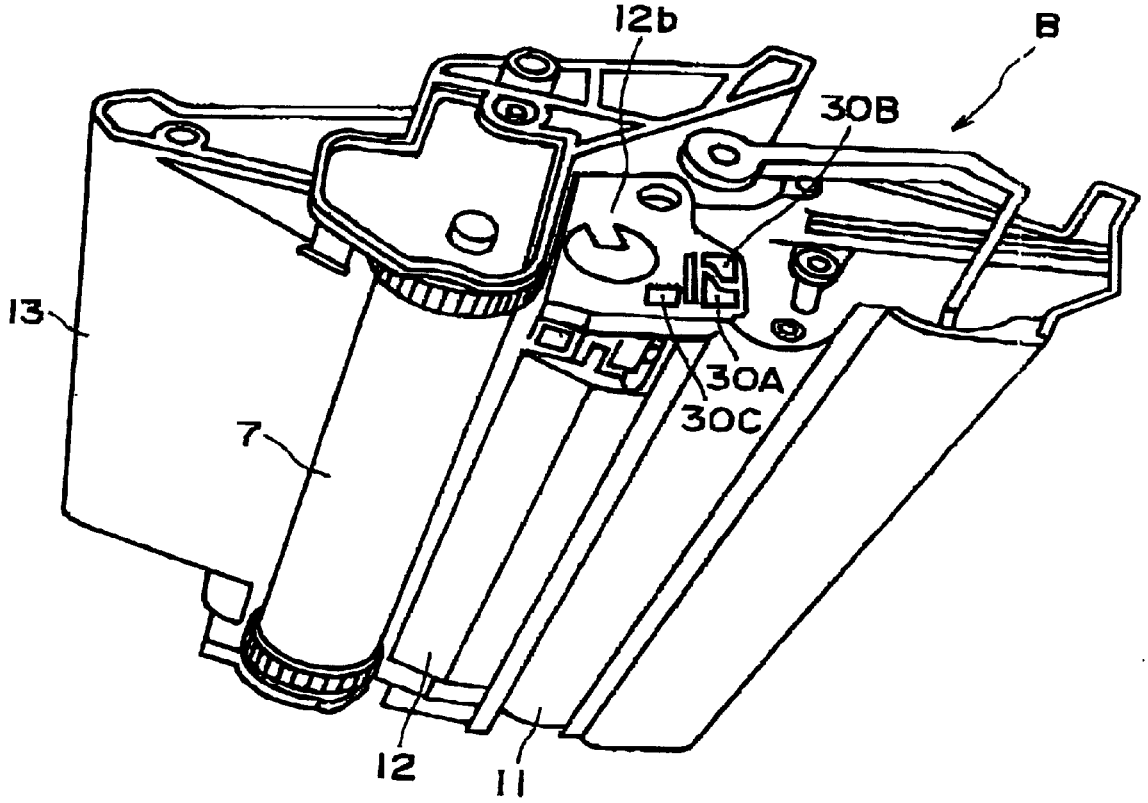
FIG. 4 is an external perspective view of the process cartridge in accordance with the present invention as seen from the bottom side.
Figure 5:
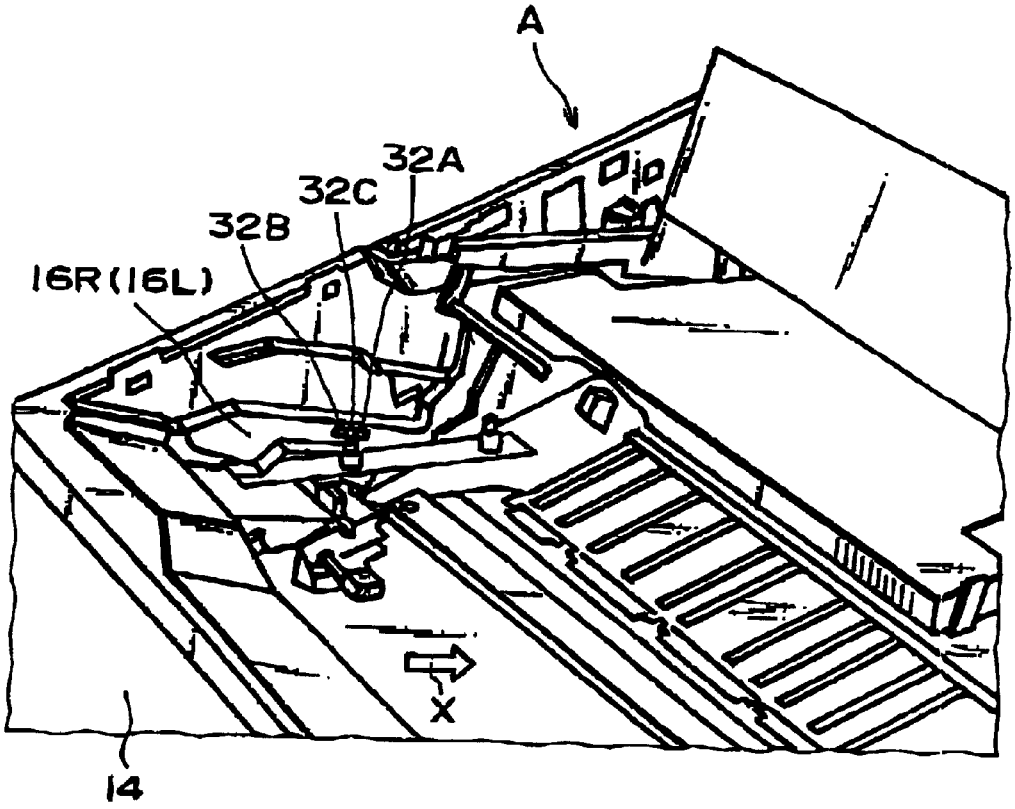
FIG. 5 is an external perspective view of the cartridge installation chamber in the main assembly of the process cartridge in accordance with the present invention.

The process cartridge B is detachably mounted to cartridge mounting means of the main assembly 14 of the image forming apparatus by the user. In this embodiment, the cartridge mounting means comprises guide means 13R (13L) on the outer surface of the process cartridge B and guide portions 16R (16L) of the main assembly 14 of the apparatus for guiding the guide means 13R (13L), as shown in FIGS. 4 and 5.

According to the embodiment of the present invention, the process cartridge B is provided with a developer amount detecting device for detecting in substantially real-time the remaining amount of the developer when the developer in the developer container 11A is consumed.

Figure 6:
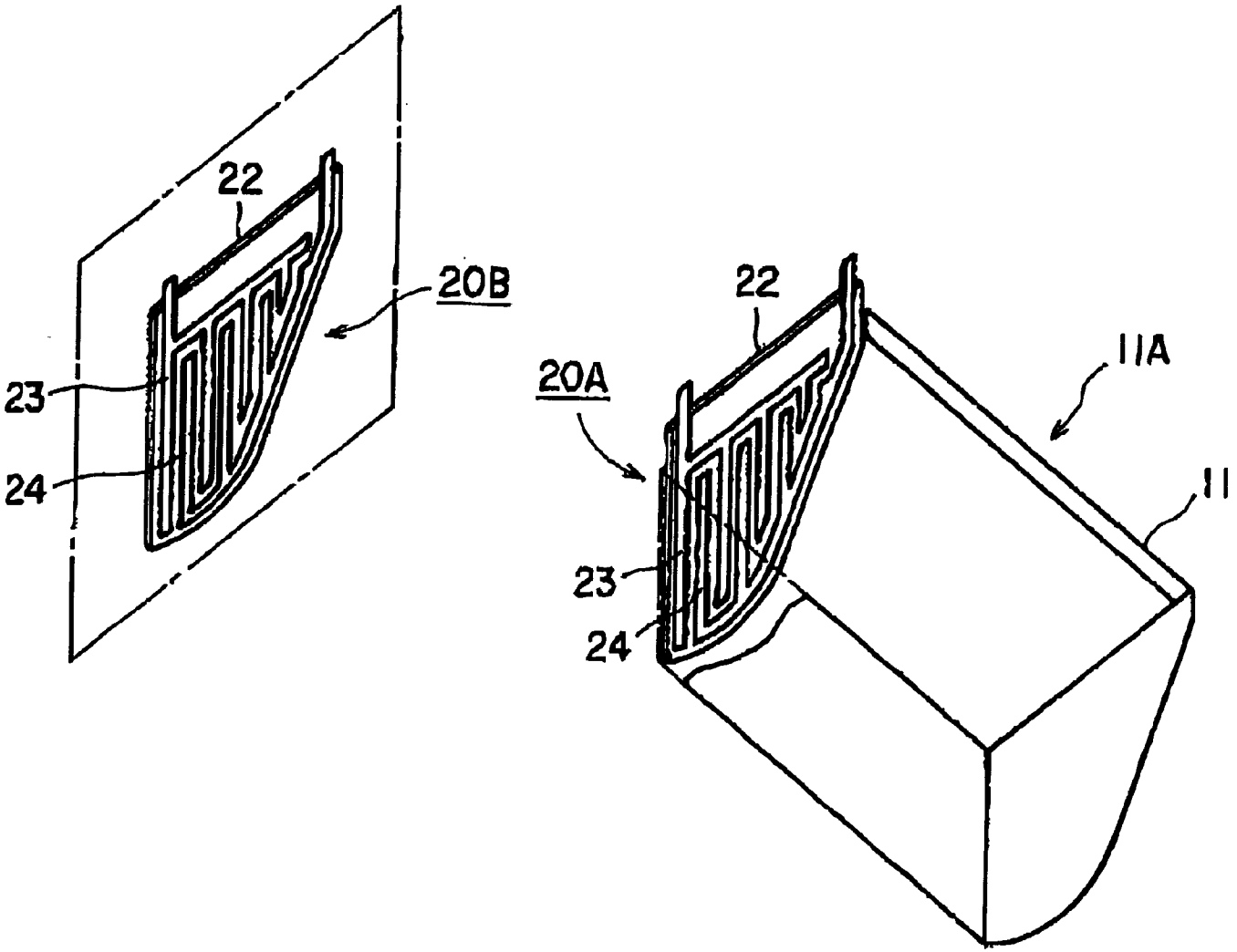
FIG. 6 is a perspective view of a developer container, illustrating a developer amount detecting device according to an embodiment of the present invention.

As shown in FIG. 6, the developer amount detecting device comprises a measuring electrode member 20A for detecting the amount of the developer, and a reference electrode member 20B for generating a reference signal on the basis of detection of the ambient temperature and humidity.

Figure 13:
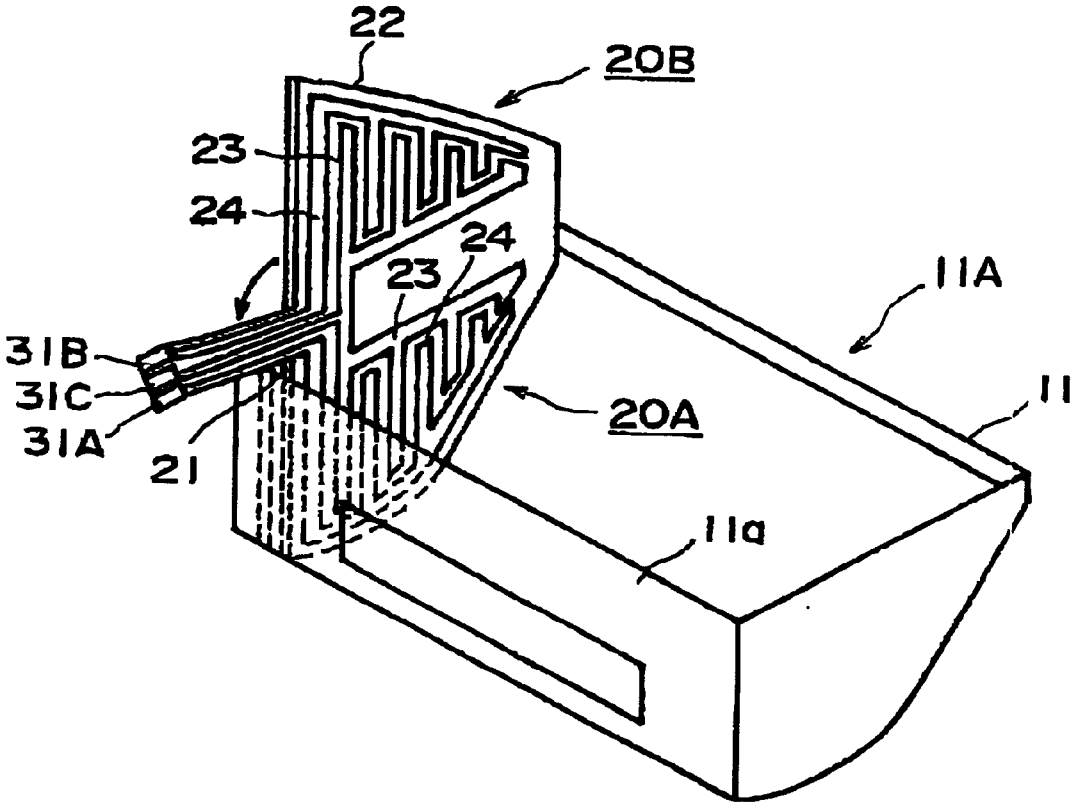
FIG. 13 is a perspective view of a developer container having a developer amount detecting device according to an embodiment of the present invention.
Figure 14:
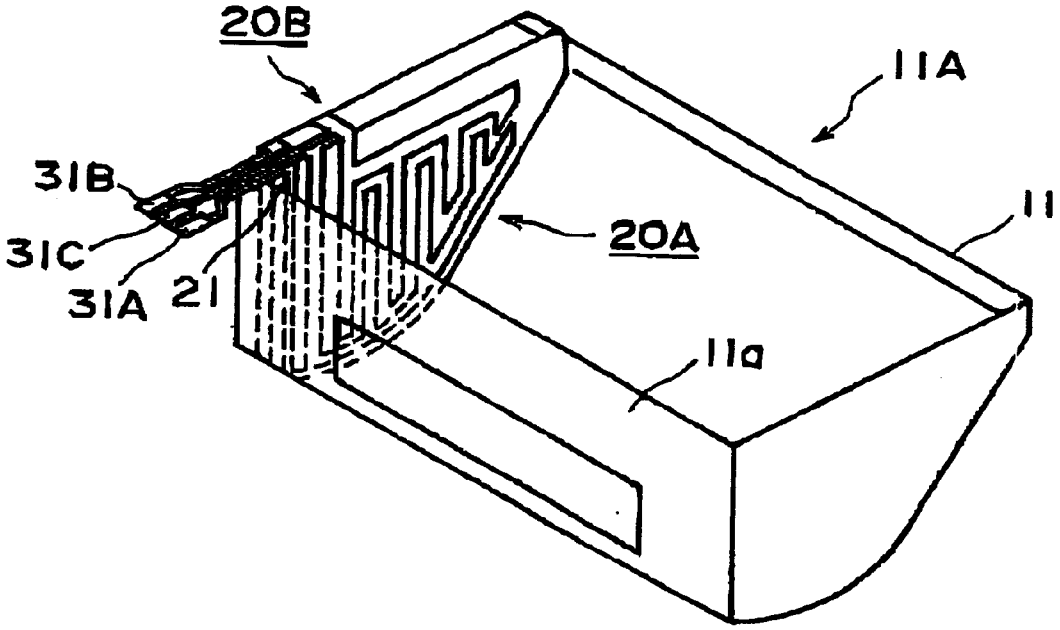
FIG. 14 is similar to FIG. 13, and is a perspective view of a developer container illustrating a developer container having a reference electrode member therein.

The measuring electrode member 20A is provided on an inside surface of the developer container 11A of the developing means 9 as shown in FIG. 6, or on such a portion in the developer container 11A that it contacts the developer and that the contact area thereof with the developer changes with a reduction of the developer, such as a bottom portion. As shown in FIGS. 13 and 14, the reference electrode member 20B may be disposed at such a position in the developer container as is the same side as the measuring electrode member 20A and is separated by a partition wall 21 so as not to be in contact with the developer.

Figure 7:
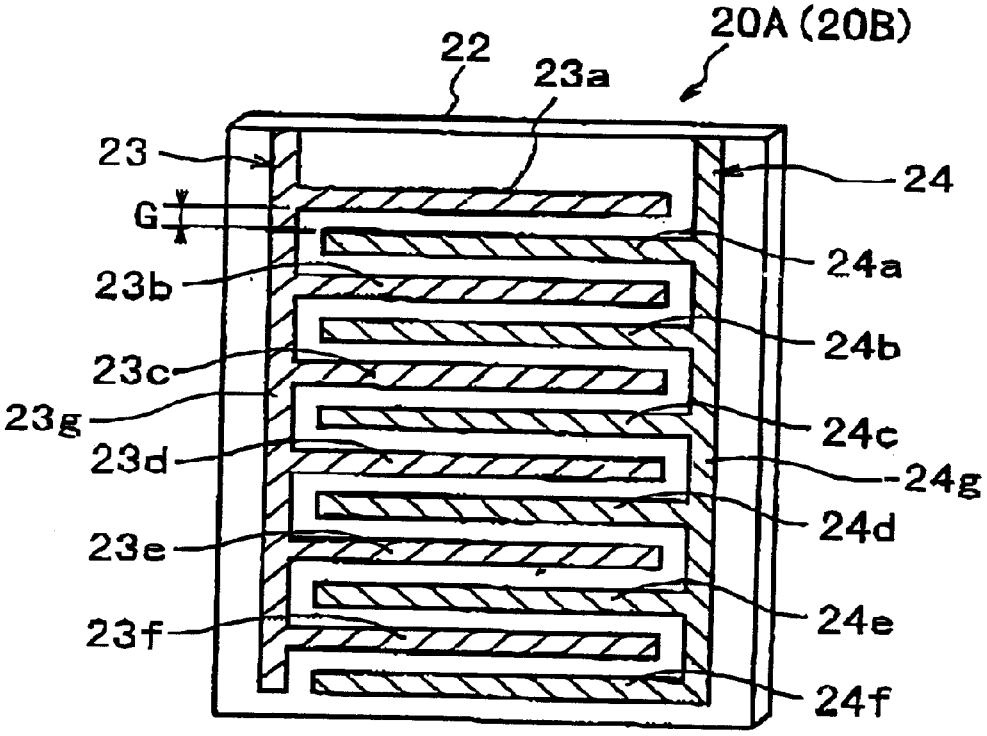
FIG. 7 shows front views of a measurement electrode and a reference electrode according to an embodiment of the present invention.

As shown in FIG. 7, the measuring electrode member 20A comprises a pair of electroconductive portions (input side electrode 23 and an output: side electrode 24) which are extended in parallel with each other with a predetermined gap on the substrate 22. In this embodiment, the electrodes 23, 24 have at least one pair of electrode portions 23*a*–23*f,*

Figure 8:
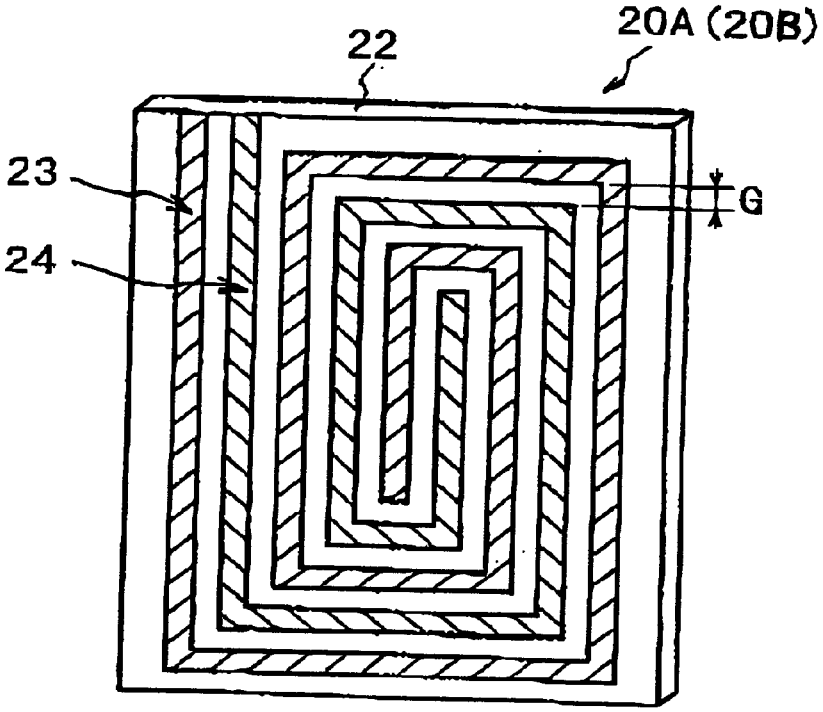
FIG. 8 shows front views of a measurement electrode and a reference electrode according to another embodiment of the present invention.

24*a*–24*f* juxtaposed in parallel with a predetermined gap G, and the electrode portion 23*a*–23*f*, 24*a*–24*f* are connected to the connecting electrode portions 23*g*, 24*g*, respectively. Thus, the two electrodes 23 and 24 have a comb-like configuration with the branch portions interlaced with each other. However, the electrode pattern of the measuring electrode member 20 is not limited to those examples, and for example, as shown in FIG. 8, the electrodes 23, 24 may be extended in the volute pattern with a constant gap.

The measuring electrode member 20A detects the remaining amount of the developer (the developer remainder) in the developer container 11A by detecting the electrostatic capacity between the parallel electrodes 23, 24. Since the developer has a dielectric constant which is larger than that of the air, and therefore, the contact of the developer on the surface of the measuring electrode member 20A increases the electrostatic capacity between the electrodes 23, 24.

Therefore, according to this embodiment, the measuring electrode member 20A can detect the developer in the developer container 11A on the basis of the area of the developer contacted to the surface of the measuring electrode member 20A, using a predetermined calibration curve, irrespective of the cross-sectional configuration of the developer container 11A or the configuration of the measuring electrode member 20A.

The electrode patterns 23, 24 of the measuring electrode member 20A can be provided by, for example, forming electroconductive metal patterns 23, 24 of copper or the like through etching or printing on a hard print board 22 such as paper phenol, glass epoxy resin or the like having a thickness of 0.4–1.6 mm or on a flexible printed board 22 of polyester, polyimide or the like resin material having a thickness of 0.1 mm. That is, they can be manufactured through the same manufacturing method as with ordinary printed boards and wiring patterns. Therefore, the complicated electrode pattern as shown in FIGS. 7 and 8 can easily manufactured at the same cost as with simple patterns.

When a complicated pattern shown in FIG. 7 or 8 is used, the length along which the electrodes 23, 24 are opposed to each other can be increased, and in addition, by using a pattern forming method such as etching, the gap between the electrodes 23, 24 can be reduced to several tens $\mu$m approximately, so that a large electrostatic capacity can be provided. The detection can be enhanced by increasing the amount of change of the electrostatic capacity More particularly, the electrodes 23, 24 have a width of 0.1–0.5 mm, and a thickness of 17.5–70 $\mu$m with the gap G therebetween of 0.1–0.5 mm. The surface on which the metal pattern is formed can be laminated with a thin resin film having a thickness of 12.5–125 $\mu$m for example.

As described in the foregoing, according to the detecting device for the amount of the developer according to the present invention, the measuring electrode member 20A is disposed on the inner surface of the developer container 11A or on such an inner bottom surface that the contact area with the developer reduces with consumption of the developer, and the total amount of the developer in the developer container can be detected by the change of the electrostatic capacity of the measuring electrode member 20A, which change is indicative of the change of the contact area with the developer.

Since the dielectric constant of the developer is larger than that of the air, the electrostatic capacity is larger at the portion where the developer is contacted to the measuring electrode member 20A (where the developer exists) than at the portion where no developer is contacted thereto (where the developer does not exist). Therefore, the amount of the developer in the developer container 11A can be detected by detecting the change of the electrostatic capacity.

According to the present invention, the developer remainder detecting device, as shown in FIG. 6, further comprises the reference electrode member 20B having a similar structure as the measuring electrode member 20A.

The reference electrode member 20B has the same structure as the measurement electrode member 20A. More particularly, as shown in FIG. 7, it comprises a pair of electrodes (input side electrodes 23 (23*a*–23*f*) and output side electrodes 24 (24*a*–24*f*)) formed parallel with a gap G on the substrate 22, and the two electrodes 23, 24 may be interlaced, or it may be in the form of a volute, as shown in FIG. 8. The reference electrode member 20B can be manufactured through the same manufacturing process as that used to manufacture the printed boards and the wiring patterns According to this embodiment, the electrostatic capacity of the reference electrode member 20B changes in accordance with the ambient condition such as the temperature and the humidity as described hereinbefore, so that it functions as a calibration member (reference electrode or member) for the measuring electrode member 20A.

Thus, according to the detecting device for the amount of the developer of this embodiment, the output of the measuring electrode member 20A is compared with the output of the reference electrode member 20B which is influenced by the change of the ambient conditions. For example, the electrostatic capacity of the reference electrode member 20B in a predetermined state is set to be the same as the electrostatic capacity of the measuring electrode member 20A when no developer exists, and then, the difference of the outputs of the reference electrode member 20B and the measuring electrode member 20A is indicative of the change of the electrostatic capacity caused by the presence of the developer, so that the accuracy of the detection of the remaining amount of the developer can be enhanced.

A description will be provided in more detail as to the detection principle of the amount of the developer. The measuring electrode member 20A detects the electrostatic capacity of the contact portion of the surface of the pattern to estimate the amount of the developer in the developer container 11A, and therefore, the output is influenced by the change of the ambiance humidity, ambient temperature or the like.

For example, when the humidity is high, which means that moisture content in the air is high, with the result that dielectric constant of the atmospheric air contacting the detecting member 20A is high. Therefore, even when the amount of the developer is the same, the output of the measuring electrode member 20A changes if the ambient condition changes. Additionally, if the material of the substrate 22 constituting the pattern absorbs moisture, the dielectric constant changes with the result, in effect, of the ambient conditions change.

By the use of the reference electrode member 20B, as the calibration element, which exhibits the same change as the measuring electrode member 20A in accordance with the ambient condition change, that is by the use of the reference electrode member 20B having the same structure as the measuring electrode member 20A but not contacted to the developer, the reference electrode member 20D being placed under the same condition as the measuring electrode member 20A, the developer remainder can be detected without the influence of the ambient condition variation when the difference of the outputs of the measuring electrode member 20A and the reference electrode member 20B is used for the detection.

Figure 9:
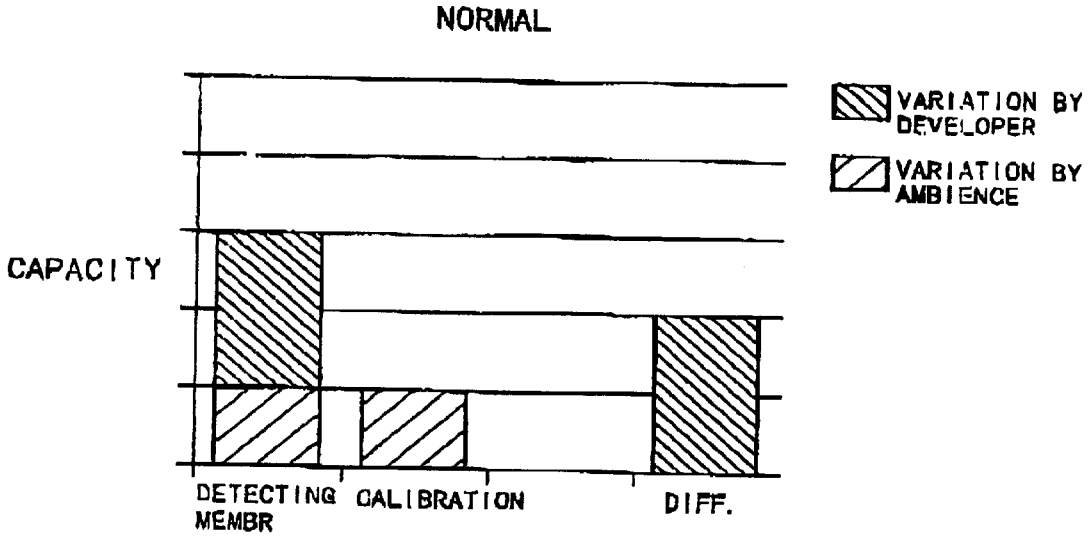
FIG. 9 is a graph illustrating a principle of detection of the amount of the developer according to the present invention.

As shown in the bar graph of FIG. 9, at the leftmost part, the electrostatic capacity determined by the measuring electrode member 20A for detecting the amount of the developer, is indicative of the variation of the developer contacting the surface of the detecting member plus the variation of the ambient condition. If the same is placed under the high temperature and high humidity ambience, the electrostatic capacity increases despite the fact that amount of the developer is the same, since the electrostatic capacity increases corresponding to the ambient condition change, as indicated at the leftmost part in FIG. 16.

Figure 10:
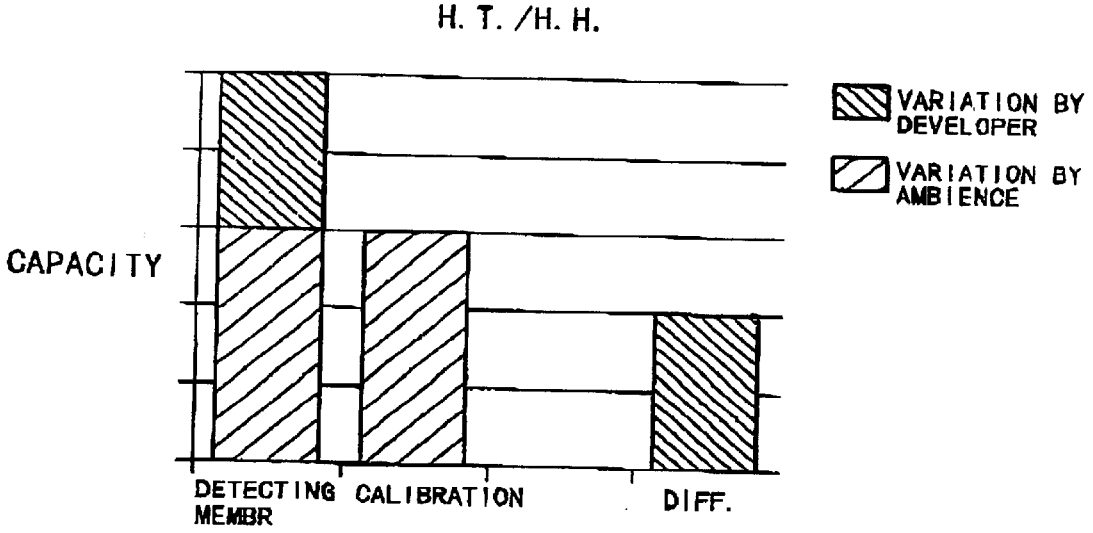
FIG. 10 is a graph illustrating a principle of detection of the amount of the developer according to the present invention.

As shown in the middle parts of FIGS. 9 and 10, the reference electrode member (calibration electrode) 20B exhibiting the same response to the ambient condition variation as the measuring electrode member (detecting member) 20A, is used, and the difference therebetween (right side of the graph) is determined, by which the electrostatic capacity indicative of the amount of the developer only, can be provided.

Figure 11:
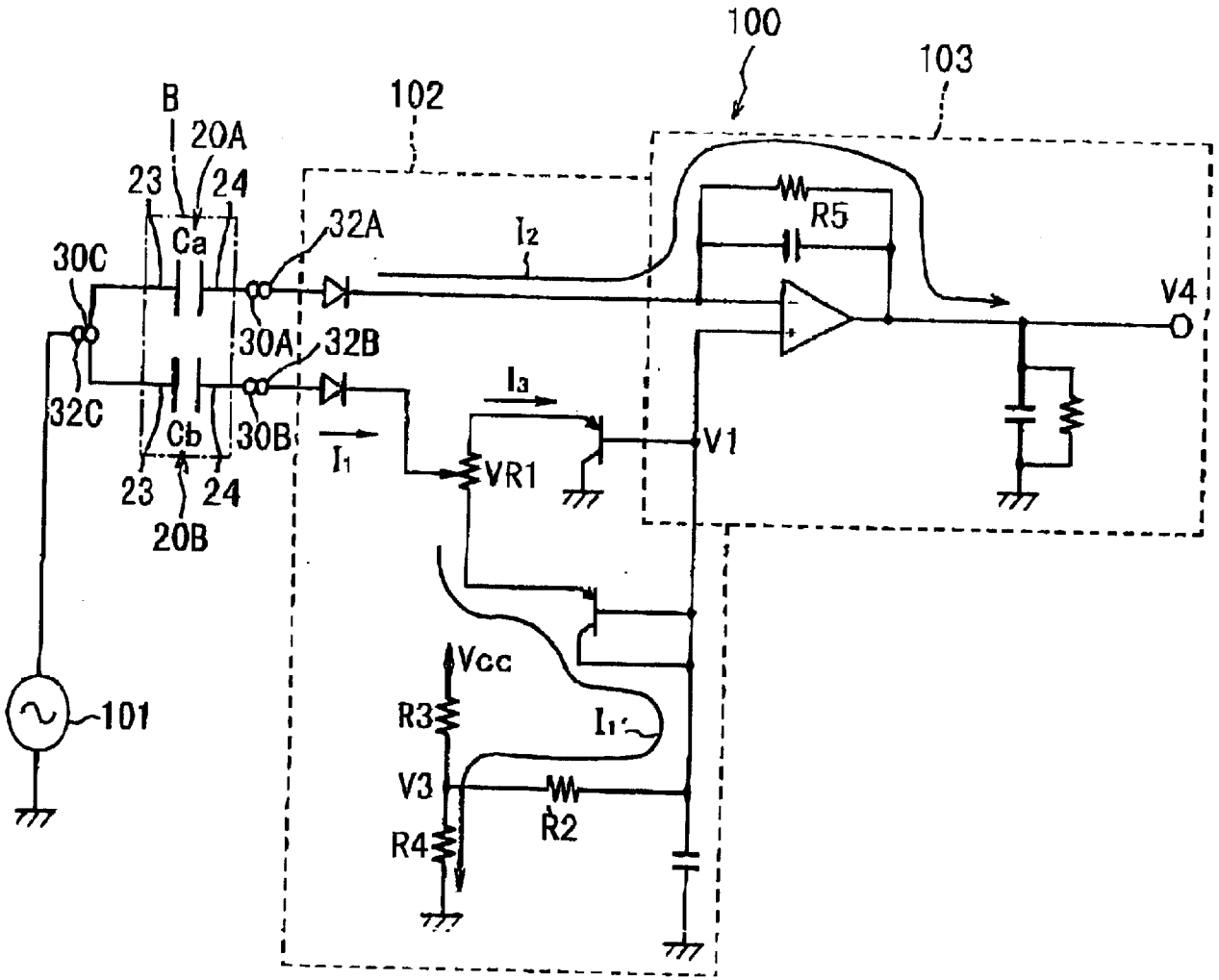
FIG. 11 is a graph illustrating a detection circuit of the amount of the developer according to the present invention.

Referring to FIG. 11, the detecting device for the amount of the developer embodying the above described principle will be described. FIG. 11 shows an example of a circuit for developer detection, more particularly, the connection between the measuring electrode member 20A and the reference electrode member 20B in the image forming apparatus.

The measuring electrode member 20A, as the detecting member having an electrostatic capacity Ca that changes in accordance with the amount of the developer, and the reference electrode member 20B, as a calibration the electrode having the electrostatic capacity Cb that changes in accordance with the ambient condition, are connected as indicated; more particularly, the input side electrodes 23 is connected to the developing bias circuit 101 (developing bias applying means) by way of a contact 30C (main assembly side contact 32C), and the output side electrode 24 is connected to the control circuit 102 of developer amount detecting circuit 100 by ways of contacts 30A (a main assembly side contact 32A) and 30B (main assembly side contact 32B). The reference electrode member 20B uses an AC (alternating) current I1 supplied through a developing bias circuit 101, and a reference voltage V1 for detecting the developer remainder is set.

The control circuit 102, as shown in FIG. 11, adds, to the voltage V3 set by the resistances R3, R4, the voltage drop V2 determined by the resistance R2 and the AC current I1' which is the current branched by a volume VR1 from the AC current I1 supplied to the reference electrode member 20B, that is, an impedance element.

The AC (alternating) current I2 applied to the measuring electrode member 20A is inputted to the amplifier, and is outputted as the detected value V4 (V1−I2×R5) indicative of the developer remainder. The voltage output is the detected value indicative of the developer remainder.

As described in the foregoing, according to the developer amount detecting device of this embodiment, the use is made with the reference electrode member 20B (calibration element) exhibiting the same capacity change in accordance with the ambient condition change as the measuring electrode member 20A, so that detection error due to the variation of the ambient condition can be cancelled or compensated for so that high accuracy of the detection for the developer remainder can be accomplished.

Figure 12:
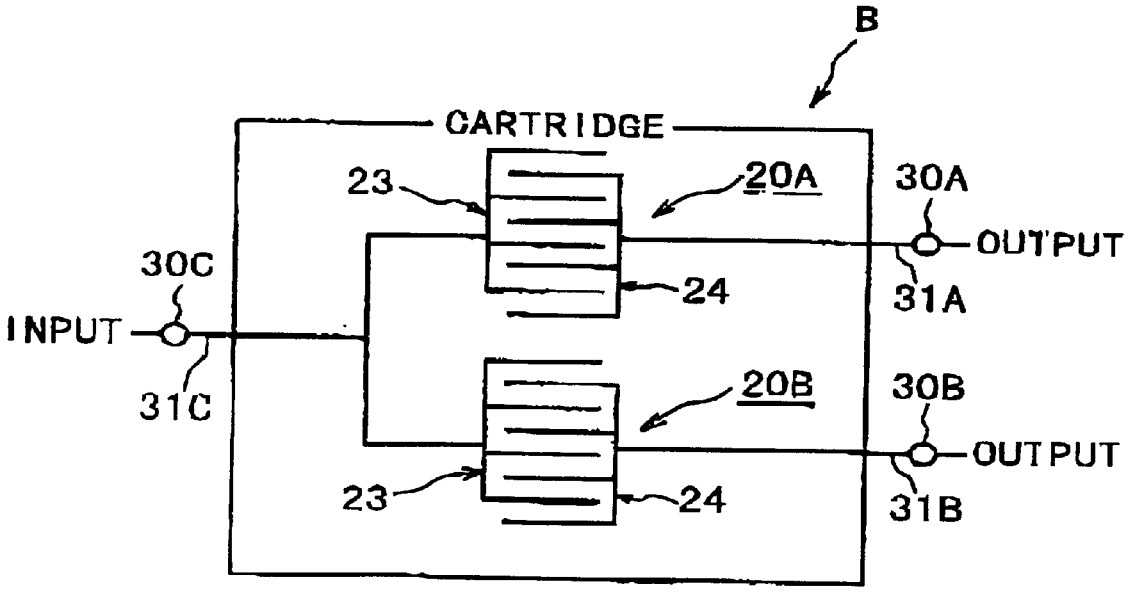
FIG. 12 is an illustration of the arrangement of a measuring electrode member and a reference electrode member.

According to this embodiment, the reference electrode member 20B as the calibration member and are the measuring electrode member 20A have the same structure and are disposed in the developer container 11A, as shown in FIGS. 12–14. With this structure, the developer container is provided both with the measuring electrode member 20A and the reference electrode member 20B, so that the variation due to the ambient condition can be removed or canceled, and since the measuring electrode member 20A and the reference electrode member can be placed under the substantially same ambient conditions, the detection accuracy can be enhanced.

Furthermore, according to this embodiment as shown in FIGS. 11 and 12, the process cartridge B is provided with three contacts, namely, an input side contact 30C, which is common for the detection and the comparison, output contacts 30A and 30B. With such a structure, the number of contacts can be reduced. Additionally, by using common contacts for the input, the input pulse can be made identical, so that accuracy is enhanced.

According to this embodiment, as will be understood from FIGS. 13 and 14, the electrodes 23, 24 of the measuring electrode member 20A and the reference electrode member 20B are formed on one side of one bendable substrate 22 such as a flexible printed board, and is folded when it is mounted to the developer container. In this embodiment, the measuring electrode member 20A and the reference electrode member 20B have the same electrode pattern, Therefore, the patterns of the electrodes 23, 24 of the measuring electrode member 20A and the reference electrode member 20B provide substantially the same electrostatic capacities, end the width, the length, the clearance and the opposing areas are substantially the same. The reference electrode member 20B thus manufactured is forded back substantially at the canter of the substrate, and it is disposed at such a position in the developer container 11A containing the measuring electrode member that it is partitioned by a partition wall 21 and it is not contacted to the developer.

The measuring electrode member 20A and the reference electrode member 20B are manufactured in a similar manner as the normal manufacturing step of the printed boards, and therefore, there are variations in the electrostatic capacities of the substrates due to the variations in the width, the height of the electrode pattern, resulting from the variation of the moisture absorbed rate and/or the dielectric constant of the equipment or material, and/or the etching conditions. According to this embodiment, the measuring electrode member 20A and the reference electrode member 20B are formed on the same side of the substrate, so that a single substrate is both for the detecting member and the calibration member, and therefore, the cost can be saved. Additionally, the electrode pattern is formed on the same material, the variations attributable to the differences of the natures of the base material can be minimized. Moreover, since the patterns are formed on the same side of the base material, the variations during the pattern formation, such as during the etching, can be suppressed. Furthermore, with such a structure, the detection pattern can be provided toward the top of the developer container, so that detection of the developer is possible even if the developer container is full to the top. According to this embodiment, as shown in FIG. 13, from the substrate 22 on which the measuring electrode member 20A and the reference electrode member 20B are formed, there are projected the output contact 31A for the measuring electrode connected electrically with the output side electrode 24 of the measuring electrode member 20A, the output contact 31B for the reference electrode connected electrically with the output side electrode 24 of the reference electrode member 20B, and the common input contact 31C connected with the input side electrodes 23 of the measuring electrode member 20A and the reference electrode member 20B.

Figure 15:
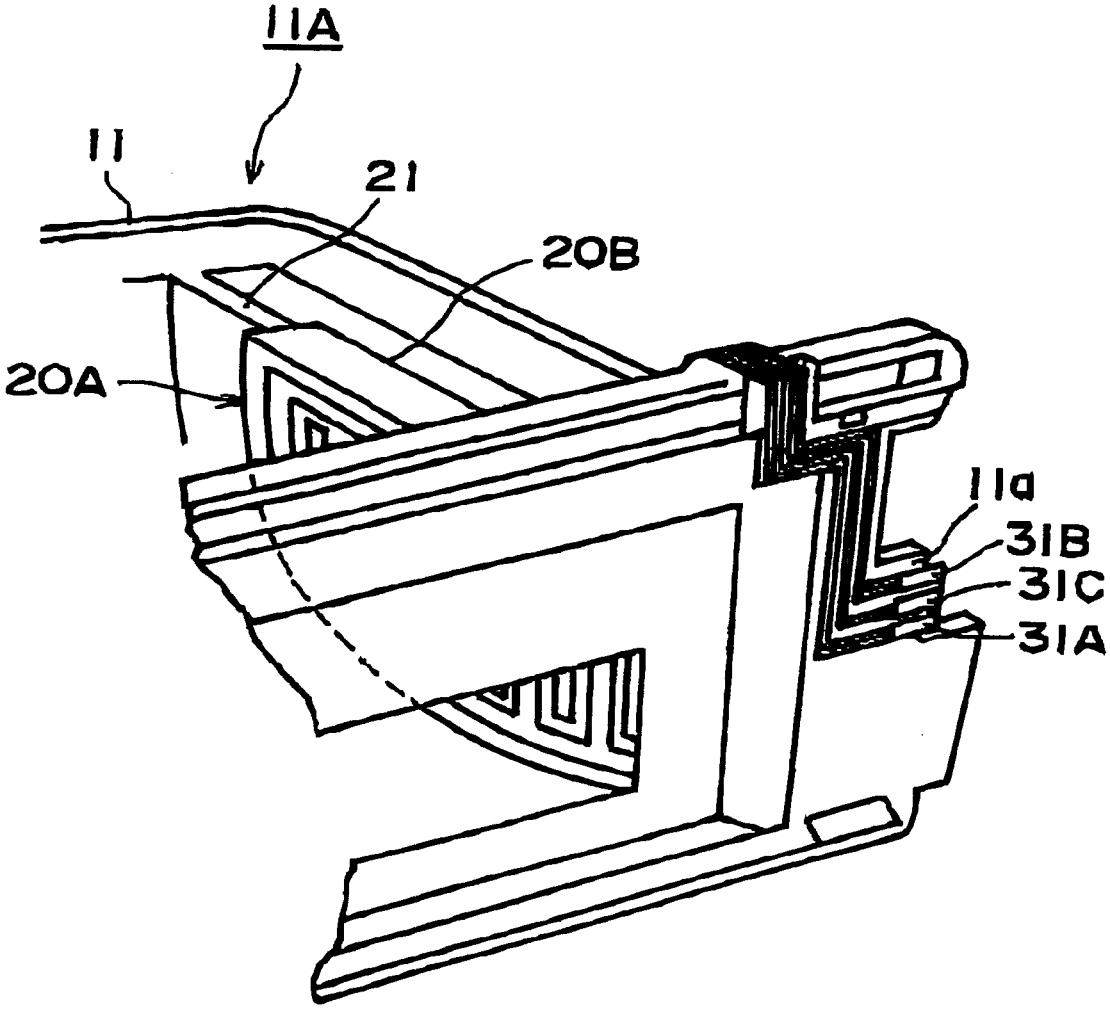
FIG. 15 is an illustration of connection of contacts of a measuring electrode member and a reference electrode member.
Figure 16:
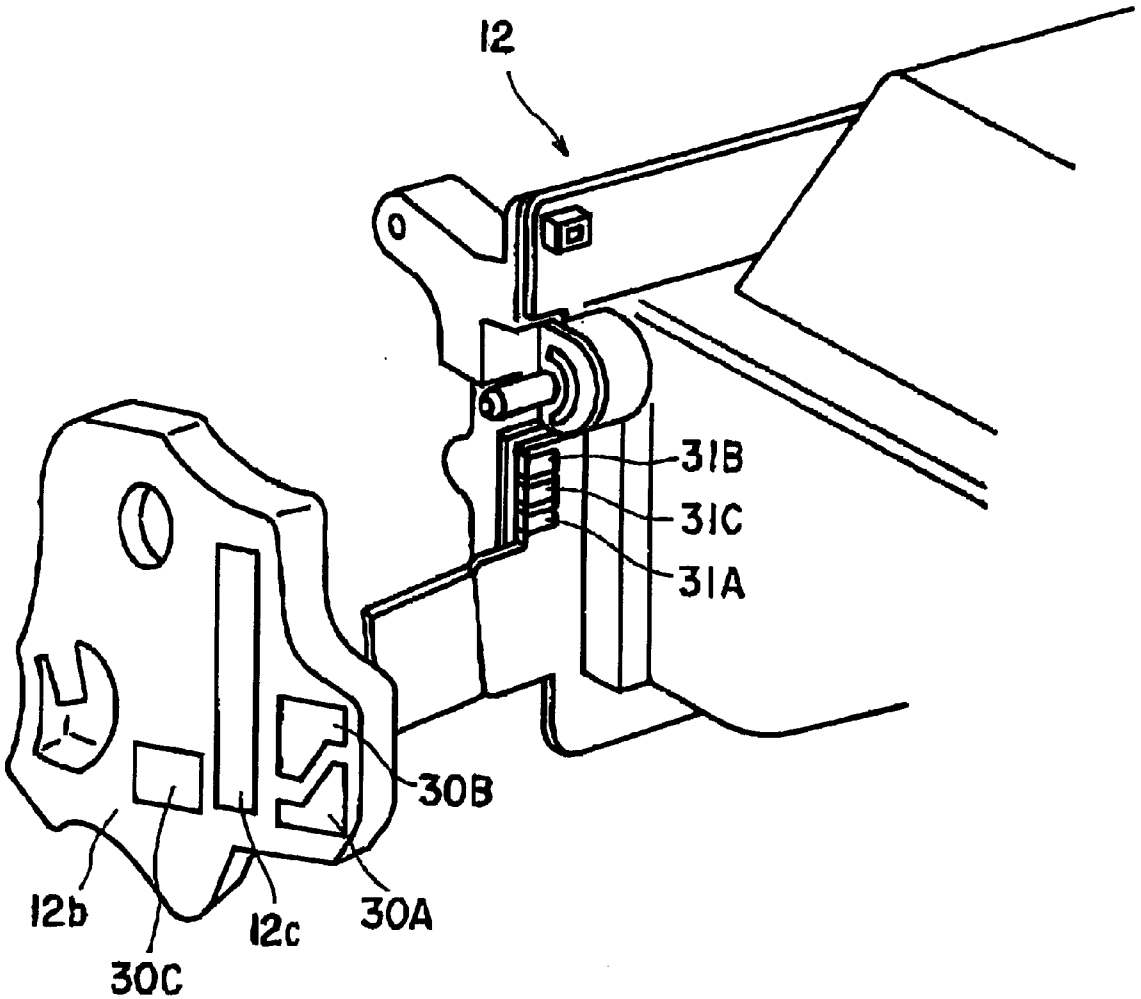
FIG. 16 is an illustration of 3 contacts provided in a process cartridge.

These three contacts 31A, 31B, 31C, ace fixed to a front wall portion 11*a* of the developer frame 11 bridging the weld portion relative to the developing device frame 12 shown in FIG. 16 of the developer container 11A as shown in FIG. 15; and the three contacts 31A, 31B, 31C are exposed outwardly from the contact port 12*c* formed in the side member 12*b* fixed to the side of the developing device frame 12, as shown in FIGS. 16 and 4 and are connected electrically to the output contact 30A of the measuring electrode and to the output contact 30B of the common input contact 30C mounted to the side member 12*b*. As shown in FIG. 5, the contacts 30A, 30B, 30C of the process cartridge are electrically connected to the contacts 32A, 32B, 32C in the main assembly 14 of the apparatus when the process cartridge B is mounted to the main assembly 14 of the apparatus, and therefore, the measuring electrode member 20A and the reference electrode member 20B provided in the process cartridge B are connected to the developer amount measuring circuit 100 shown in FIG. 11.

In the foregoing description of the embodiment, the patterns of the electrodes 23, 24 of the reference electrode member 20B and the measuring electrode member 20A have substantially the same electrostatic capacities, pattern widths, lengths, clearances and opposing areas. However, the areas of the electrode patterns 23, 24 of the reference electrode member 20B for calibration may be different from that of the electrode patterns 23, 24 of the measuring electrode member 20A. In this case, the output of the reference electrode member 20B is multiplied by a predetermined coefficient, and the multiplied output is compared with the output of the measuring electrode member 20A. Using such a structure, the size of the reference electrode member 20B can be reduced so that the space occupied by the detecting member can be reduced. The members 20A and 20B may be placed on the same wall of the developer container 11A at the same side, and the reference electrode member 20B is prohibited from contacting the developer, and in this case, it is possible to increase the percentage of the pattern area of the detecting member 20A in the limited the area, therefore, the amount of the change of the electrostatic capacity and the detection accuracy can be enhanced.

In the foregoing, the same configurations or same dimensions do not mean exactly identical configuration or dimensions, and do not exclude those having a difference due to manufacturing errors or the like as long as the detection can be made with practical accuracy.

As described in the foregoing, according to this embodiment, the developer container 11A is provided with the measuring electrode member 20A and the reference electrode member 20B for substantially real-time detection of the developer remainder, further preferably the developer chamber 9A of the developing means 9 is provided with an antenna rod, that is, an electrode rod 9*h* FIG. 3 is extended by a predetermined length in the longitudinal direction of the developing roller 9*a* with a predetermined, clearance from the developing roller 9*a*. With this structure, the emptiness of the developer in the developer container can be detected by detecting the change of the electrostatic capacity between the developing roller 9*a* and the electrode rod 9*h*.

According to the image forming apparatus of this embodiment, the amount of the developer in the developer container 11A can be detected substantially in real-time, and on the basis of the detection, the consumption amount of the developer may be displayed so as to promote the user to prepare the replenishing cartridge and further to supply the developer upon the display of the emptiness.

Figure 17:
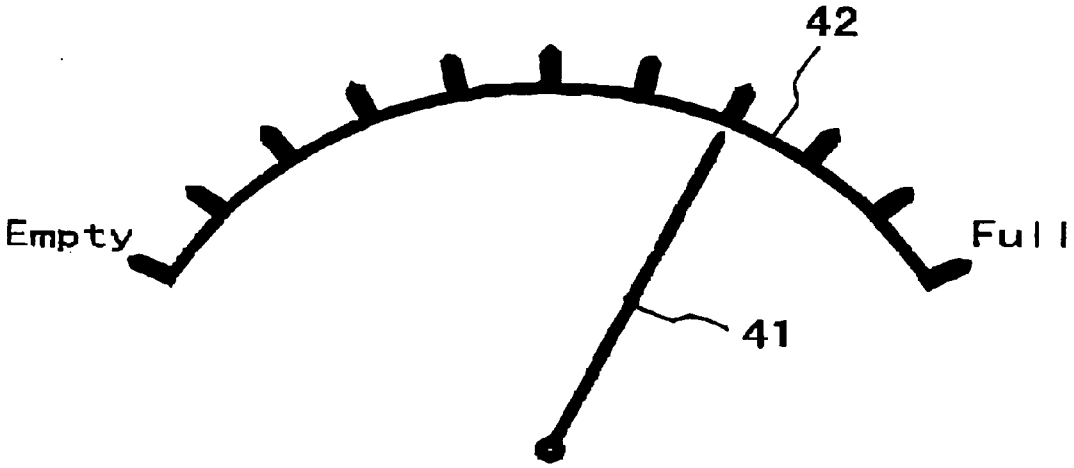
FIG. 17 is an illustration of the display of an amount of the developer according to an embodiment of the present dimension.
Figure 18:
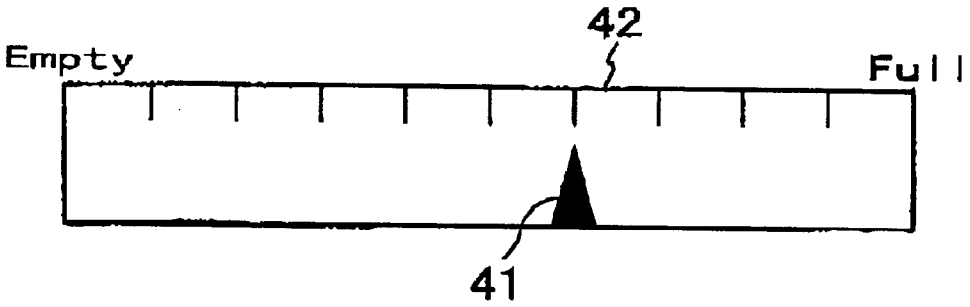
FIG. 18 shows a further example of the display of an amount of the developer according to an embodiment of the present invention.

A description will be provided as to the manner of display of the amount of the developer. The detected information provided by the developer amount detecting device is displayed on the screen of the terminal equipment such as a personal computer of the user in the manner, shown in FIGS. 17 and 18. In FIGS. 17 and 18, an indicator 41 moves in accordance with the amount of the developer so that the user is aware of the amount of the developer.

Figure 19:
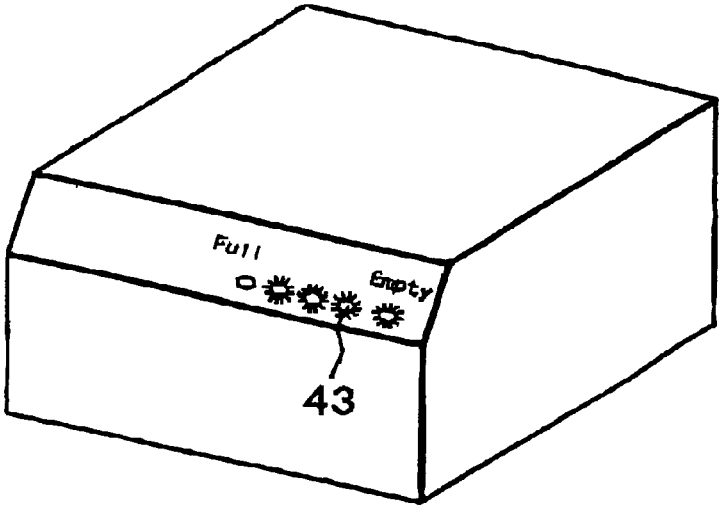
FIG. 19 shows a further example of the display of an amount of the developer according to an embodiment of the present invention.

FIG. 19 shows an alternative, wherein the main assembly of the electrophotographic image forming apparatus is provided with a display portion of, an LED (43) or the like, which is lit on or off, in accordance with the amount of the developer.

In the preceding embodiments, the amount of the remaining developer can be continuously detected while the amount of the remaining developer is in a range from approximately 100% down to 0%, provided that the entire amount of the developer contained in the developer container before a process cartridge is put to use for the first time is 100%. However, the application of the present invention does not need to be limited to the preceding embodiment. Far example, modifications way be made so that the amount of the remaining developer in the developer container can be continuously detected in a range from 50% down to 0%, for example. It should be noted here that 0% does not means a state of a process cartridge in which the developer has been completely depleted; it also includes another state of a process cartridge in which the amount of the developer in the process cartridge has decreased to a point close enough to disable the image forming apparatus to form images with a predetermined level of quality (development quality).

A description will be provided as to the structure effective to improve the detection accuracy of the remaining amount of the developer.

Hereinafter, a structure for improving the developer amount detection accuracy of a developer amount detecting apparatus in this embodiment will be described.

Figure 20:
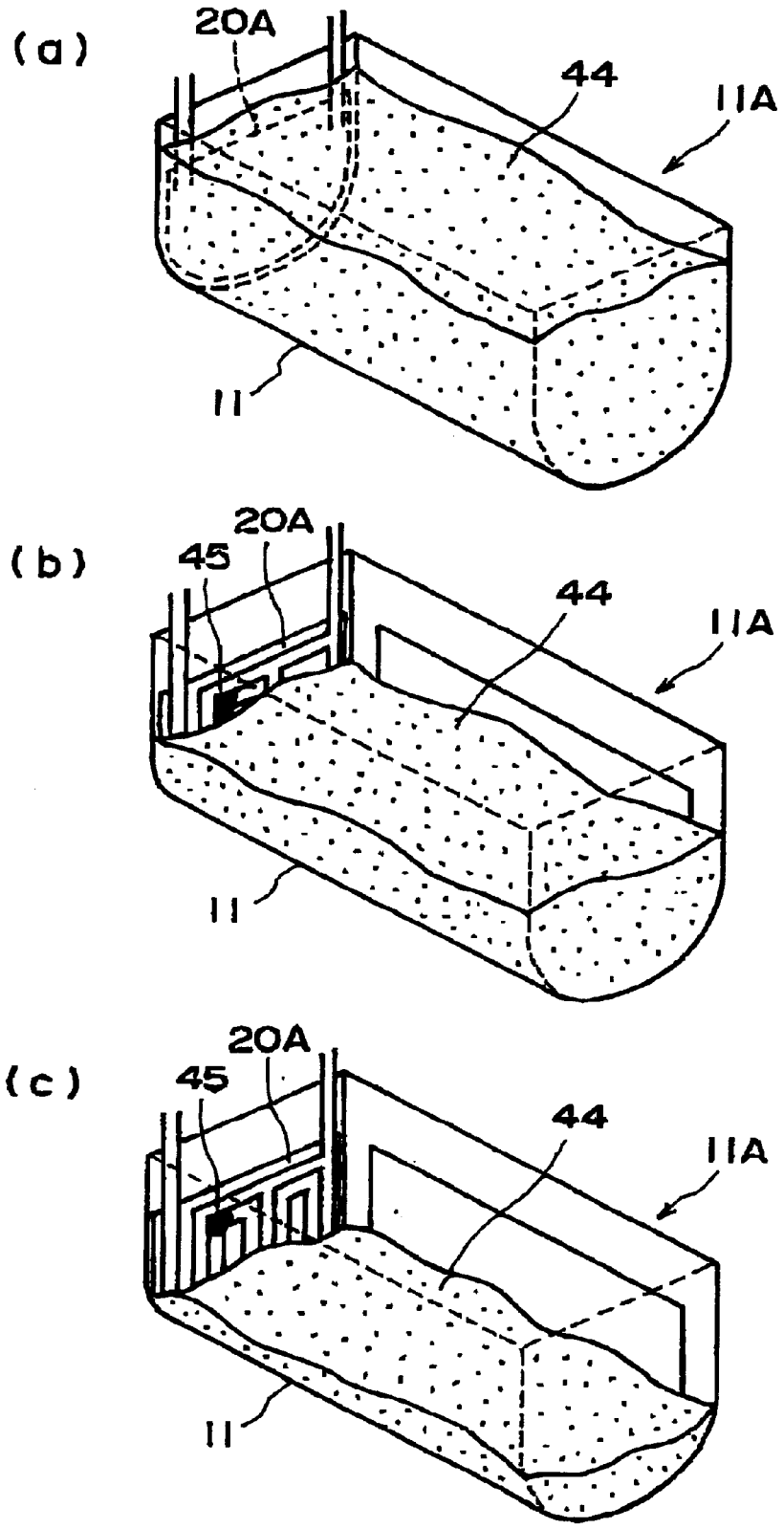
FIG. 20 is a perspective view illustrating consumption of a developer in a developer container.

FIGS. 20(*a*)–(*c*), show the state of developer consumption in the developer container 11A on the internal surface of which a measurement electrode 20A is located.

The state illustrated in FIG. 20 (*a*) is immediately after the developer container 11A is completely filled with developer, that is, when the amount of developer is large. As developer is continuously consumed from this state, the state of the developer container ilk changes to the state illustrated in FIG. 20(*b*), and then to the state illustrated in FIG. 20(*c*), the level of the top surface 44 of the developer gradually descending. As a result, the size of the portion of the surface of the measurement electrode 20A which is not in contact with developer (surface correspondent to the space with no developer) gradually increases.

However, there is a possibility that a small amount of developer 45 will adhere to the surface of the measurement electrode 20A, and remains above the top surface 44 of the developer.

If this small amount of developer 45 adhering to the surface of the measurement electrode 20A remains there even though the developer within the developer container 11A is continuously consumed, it becomes the cause of the error in detection the developer amount. Therefore, in order to improve the accuracy in detecting the amount of the developer remaining in the developer container 11A, the small amount of the developer 45 remaining adhered to the measurement electrode 20A should be removed.

Thus, in this embodiment, a wiping member for wiping away developer from the surface of the measurement electrode 20A is provided so that the error in the measurement of the developer amount resulting from the developer adhesion can be controlled. Hereinafter, this will be described in detail.

Figure 21:
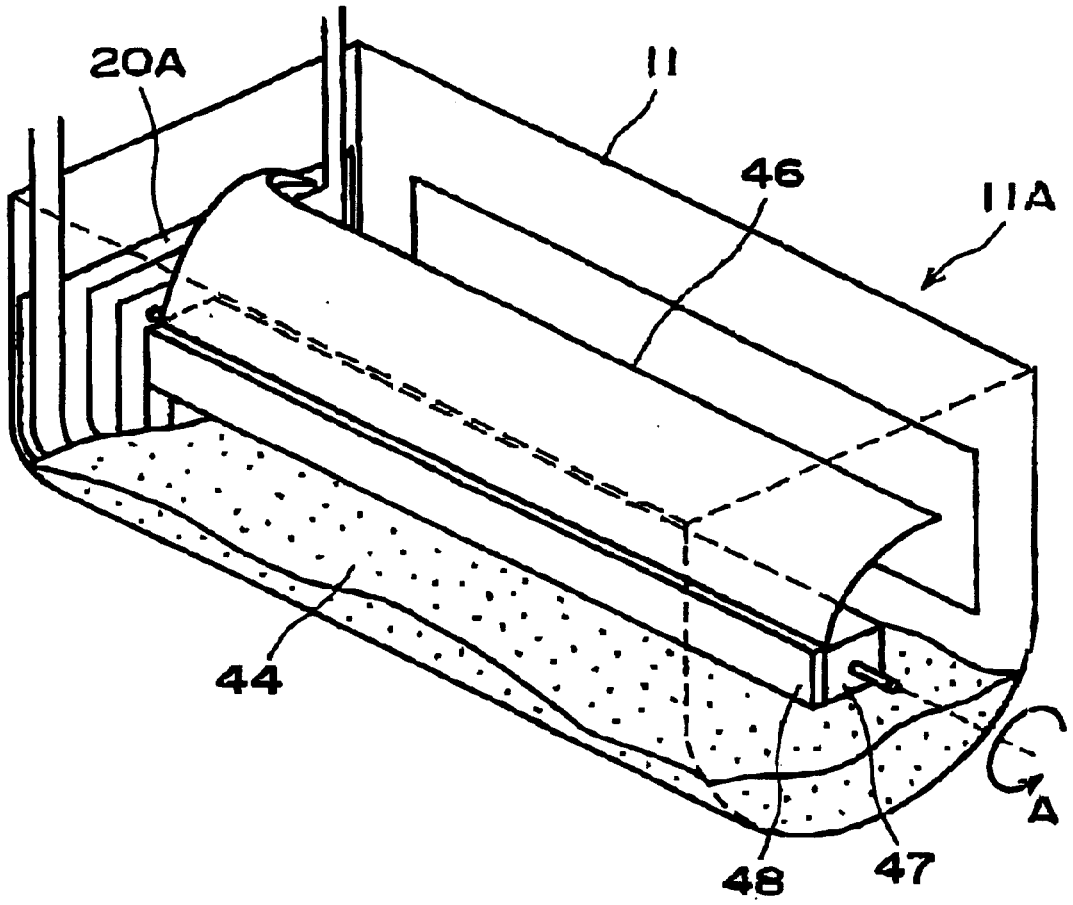
FIG. 21 is a perspective view illustrating a developer container having a wiping member for the measuring electrode according to an embodiment of the present invention.

FIG. 21 shows the interior of the developer container 11A provided with a wiping member.

The developer container 11A in this embodiment is provided with a wiping member, which comprises a rotatable member and a piece of a sheet. The longitudinal ends of the rotatable member are rotatably supported by the developer container shell 11, and the sheet is fixed to the rotatable member in such a manner that its longer edges become parallel to the longitudinal direction of the rotatable member. In other words, in this embodiment, the wiping member is a combination of the piece of sheet 46, and a rotational rod 47, or the rotatable member, which is the member to which the sheet 46 is fixed. It wipes the surface of the measurement electrode 20A with the sheet 46.

Further, not only does the sheet 46 in this embodiment wipe the measurement electrode 20A, but also it stirs the developer within the developer container 11A while wiping the measurement electrode 20A. In other words, in this embodiment, the sheet 46 for wiping the measurement electrode doubles as the aforementioned developer conveying member 9*b*.

As described above, in this embodiment, the sheet 46, and the rotatable rod 47, or a rotatable member are used for both stirring the developer and wiping the measurement electrode 20A, to simplify the apparatus. The present invention is not limited to this structural arrangement, as will be described later. For example, the sheet for wiping the measurement electrode, and the sheet for stirring developer, do not need to be the same sheet or parts of the same sheet.

To describe it more specifically, in this embodiment, the sheet 46 is extended in a direction parallel to its longitudinal edges, so that one of the other edges, that is, the shorter edges, of the sheet makes contact with the surface of the measurement electrode 20A on the internal surface of the developer container 11A. As for the material for the sheet 46, PET (polyethylene-terephthalate), PPS (polyphenylene sulfide), or the like is used.

The rotatable rod 47 as a rotatable member is formed of resin. It is rotatably supported by the developer container shell 11, at both of its longitudinal ends. The rotatable rod 47 is rotated in the direction of an arrow mark A as a driving force is transmitted thereto from the driving means (unillustrated) of the image forming apparatus main assembly 14 through the driving force transmitting means comprising gears, couplings (unillustrated), and the like.

In fixing the sheet 46 to the rotatable rod 47, the sheet 46 is sandwiched between the rotatable rod 47 and a pressing member 48 in the form of a piece of a plate, and is secured to the rotatable rod 47 with the use of small screws, bonding, thermal crimping, ultrasonic welding, or the like means. The method for fixing the sheet 46 is not limited to the above described methods.

Figure 22:
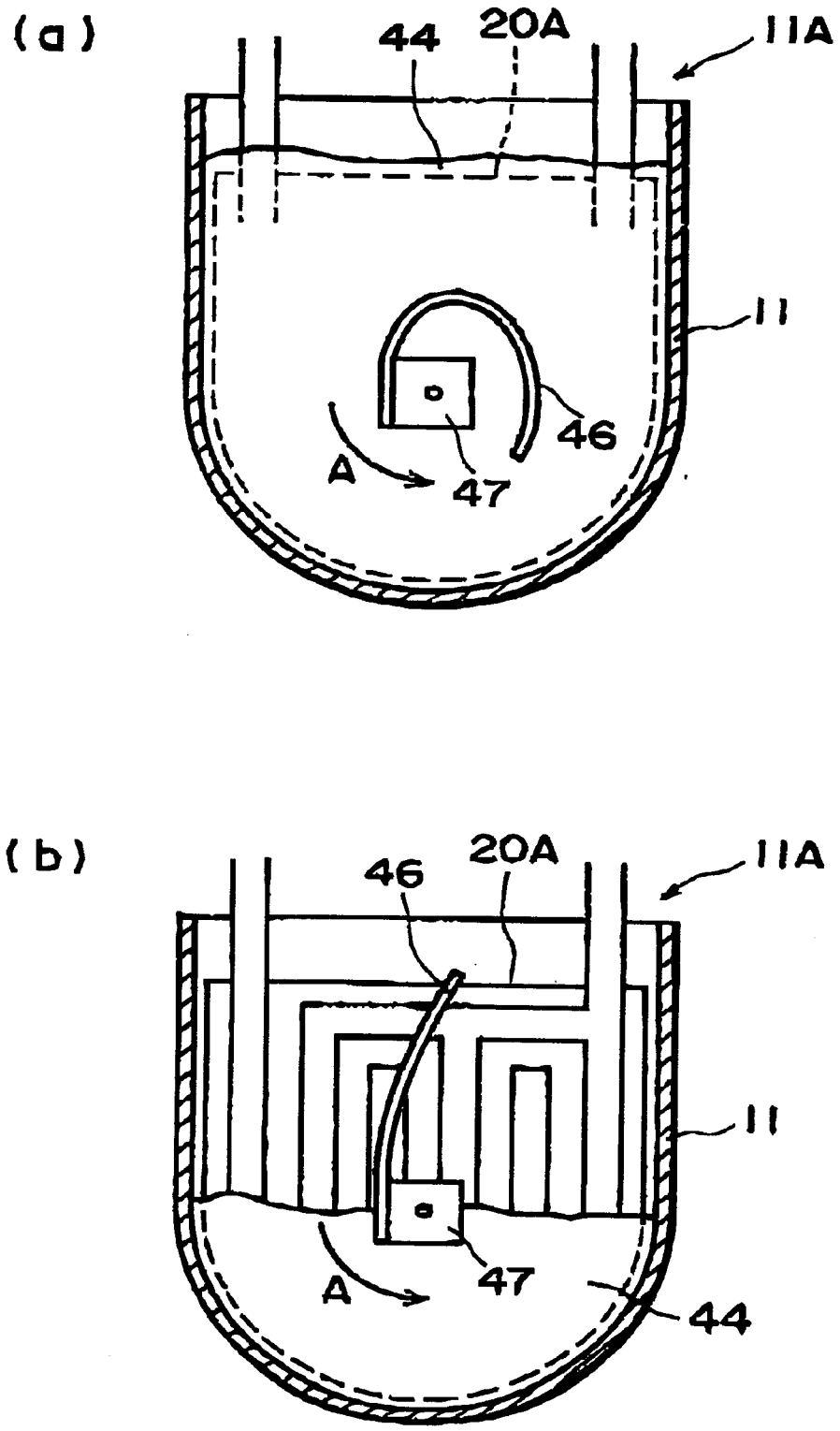
FIG. 22 is a sectional view of a developer container illustrating a sheet member which functions both for stirring a developer and for wiping the measuring electrode when the developer remainder amount is large (a), and when the amount is small.
Figure 23:
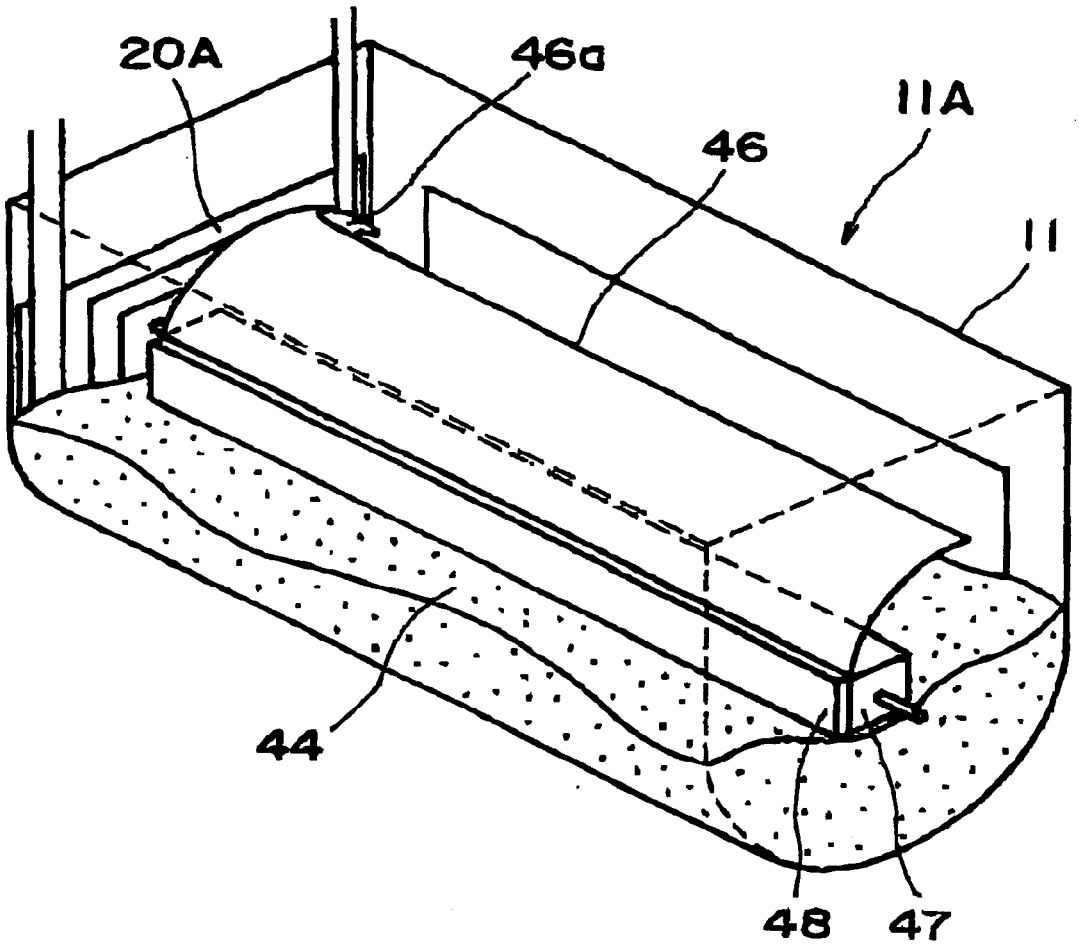
FIG. 23 is a perspective view of a developer container, wherein a sheet member, which functions both for stirring the developer and for wiping the measuring electrode, is away at a longitudinal end.

The wiping member structured as described will be described with regard to its movement in wiping away the developer 45 remaining on the measurement electrode 20A. First, referring to FIG. 22, when the amount of the developer in the developer container is large as illustrated in FIG. 22(*a*), the sheet 46 is bent in the direction opposite to the rotational direction of the rotatable rod 47, remaining hidden below the top surface 44 of the body of the developer. However, am the amount of the developer becomes smaller due to developer consumption as shown in FIG. 22(*b*), the resistance created upon the sheet 46 by the developer also becomes smaller, the sheet 46 to appear above the top surface 44 of the body of the developer.

Thus, after the level of the top surface 44, of the developer falls a certain distance, the portion of the surface of the measurement electrode 20A, which is exposed above the top surface 44 of the developer, can be wiped by the sheet 46. In other words, the elasticity of the sheet 46 pressing on the measurement electrode 20A can be used to cause the sheet 46 to rub against the surface of the measurement electrode 20A to wipe away the small amount of the developer 45 remaining on the surface of the measurement electrode 20A.

However, according to the studies conducted by the inventors of the present invention, if the sheet 46 is simply pressed upon the measurement electrode 20A, the tip portion 46*a* (corner portion) of the free edge of the sheet 46, that is, the portion of the sheet 46 which makes contact with the measurement electrode 20A, tends to float from the measurement electrode 20A due to the force of constraint of the sheet 46, or the force with which this sheet 46 presses upon the measurement electrode 20A, is reduced by the force of constraint of the sheet 46. This sometimes causes the wiping member to unsatisfactorily wipe the remnant developer 45.

Figure 24:
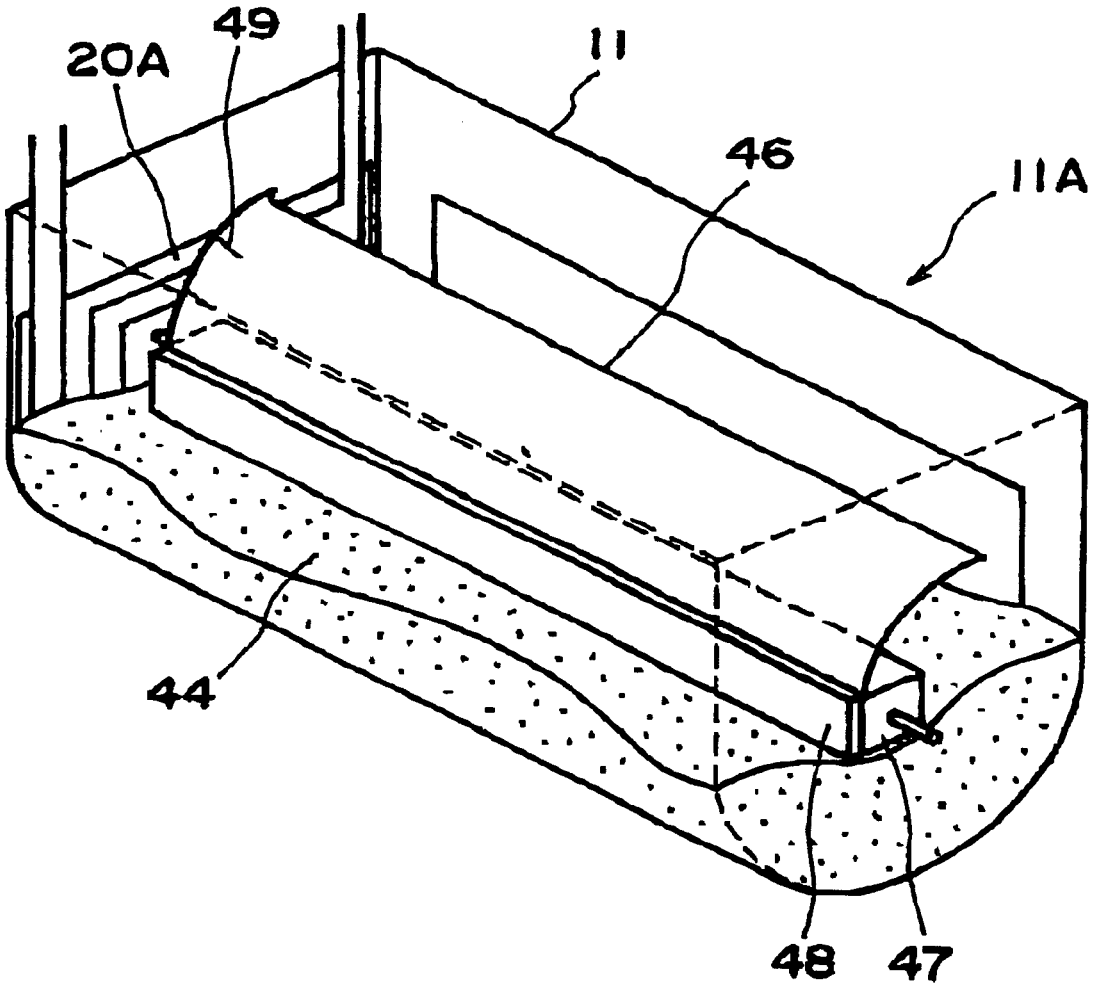
FIG. 24 is a perspective view of a developer container having a sheet member, which functions both to stir the developer and wipe the measuring electrode, the sheet member being provided with a cut at an end adjacent the measuring electrode according to an embodiment.

Thus, it is desirable that the edge of the sheet 46, which makes contact with the surface of the measurement electrode 20*k*, is provided with slits 49, as shown in FIG. 24. In this embodiment, the slits 49 are cut in the longitudinal direction of the sheet 46, that is, the direction parallel to the direction in which the sheet 46 is pressed upon the measurement electrode 20A.

With the provision of these slits 49, the floating of the tip portion 46*a* of the sheet 46, which is placed in contact with the measurement electrode 20A, is prevented. As a result, the force with which the longer edge portion of the sheet 46 is pressed upon the measurement electrode 20A is made nearly uniform in terms of the direction of the longer edge, making it possible for the surface of the measurement electrode 20A to be virtually evenly wiped across the entire rotational range of the sheet 46 in terms of the longitudinal direction of the sheet 46.

As described above, according to this embodiment, the amount of the developer within the developer container can be accurately and continuously detected following the developer consumption. In addition, the accuracy with which the remaining amount of the developer is detected can be improved with the use of a simple structure.

Embodiment 2

The process cartridge and electrophotographic image forming apparatus in this embodiment are basically the same as those in the first embodiment, and are different from those in the first embodiment only in the structure of the wiping member for wiping the developer remaining adhered to the measurement electrode 20A. Thus, the members with the same functions and structures are given the same reference codes as those in the first embodiment, and their detailed descriptions will be not be given here.

In this embodiment a sheet dedicated for wiping the measurement electrode is provided in addition to the sheet for stirring the developer in the developer container 11A, or the stirring portion or the developer conveying member 9*b* in the form of a stirring rod or a stirring plate, First, referring to FIG. 25, a structure in which a rotatable rod 47 similar to the one in the first embodiment is employed as a rotatable member will be described.

Figure 25:
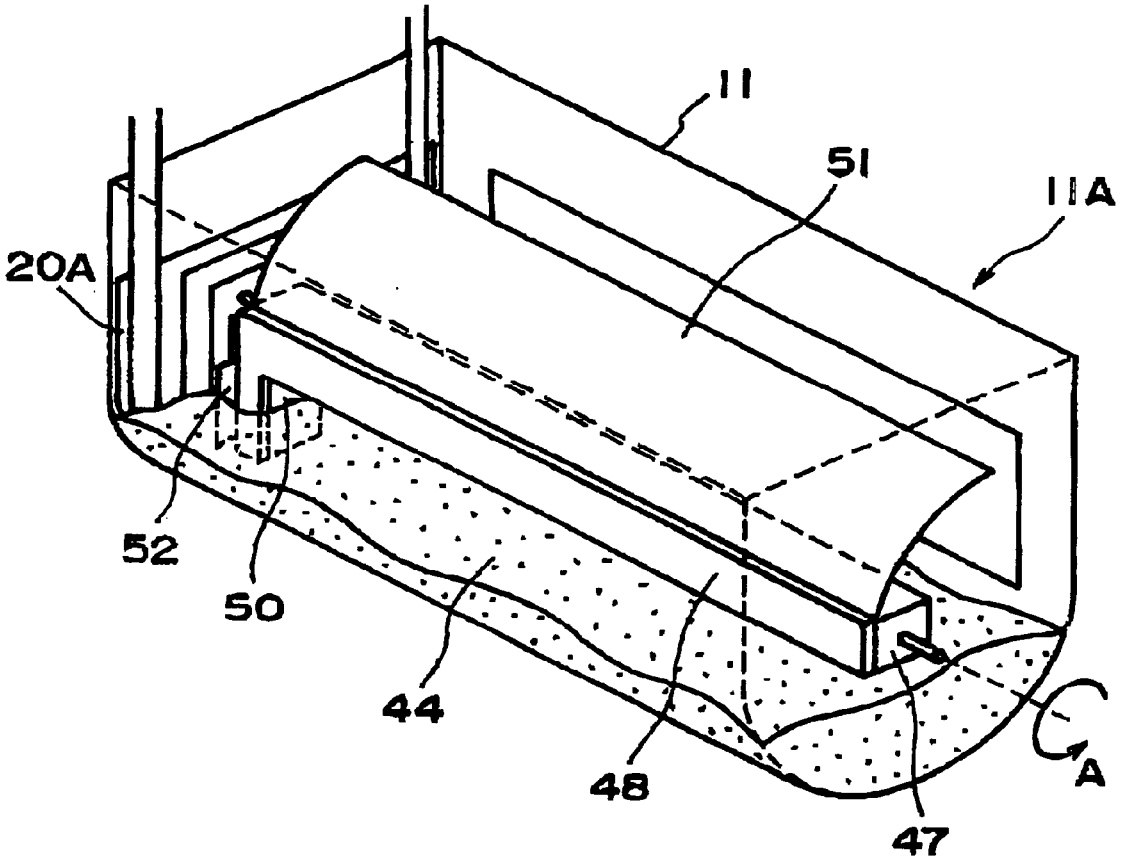
FIG. 25 is a perspective view of a developer container according to an embodiment of the present invention, wherein a sheet member for wiping the measuring electrode is mounted to a rib provided at a longitudinal end of the rotation rod member.

The wiping member shown in FIG. 25 comprises a rotatable rod 47 as a rotatable member, a nip 50, a piece of sheet 52 as a member for wiping a measurement electrode, and piece of sheet 51 for stirring developer. The rib 30 is provided on the rotatable rod 47, on the measurement electrode 20A side, and the sheet 52 is attached to the rib 50. The sheet 51 is fixed to the rotatable rod 47, and is extended in the longitudinal direction of the rod 47.

In other words, in the case of the structure illustrated in FIG. 25, the developer stirring sheet 51 and measurement electrode wiping sheet 52 are two independent pieces of sheet. The rotatable rod 47, rib 50 and measurement electrode wiping sheet 52 fixed to the rib 50 constitute the wiping member, whereas the rotatable rod 47 and developer stirring sheet 51 make up the developer conveying member 9*b*.

In this embodiment, the rib 50, on the longitudinal end of the rotatable rod 47 on the measurement electrode side, is structured so that it extends in the direction opposite to the free edge of the developer stirring sheet 51. Its length is such that it does not make contact with the bottom wall of the developer container 11A. However, the rib 50 may be structured so that it extends in the direction of the free edge of the sheet 51.

The electrode wiping sheet 52 fixed to the rib 50, and its free edge is in contact with the measurement electrode 20A as is the edge of the sheet 46 on the measurement electrode 20A aide in the first embodiment. Both the developer stirring sheet 51 and electrode wiping sheet 52 are sandwiched between the pressing member 48 in the form of a piece of plate and the rotatable rod 47, and are secured thereto with the use of small or fixed thereto by bonding, thermal crimping, ultrasonic welding, or the like means. In this embodiment, the pressing means 48 is L-shaped so that its shape matches the shape of combination of the rotatable rod 47 and the rib 50 extending from the longitudinal end of the rotatable rod 47, and so that both the developer stirring sheet 51 and measurement electrode wiping sheet 52 can be secured with a single pressing member, that is, the pressing member 4B in this embodiment. As for the material for the measurement electrode wiping sheet 52, PET (polyethylene-terephthalate), PPS (polyphenyl sulfide), or the like is used.

As driving force is transmitted from the driving means (unillustrated) provided in the image forming apparatus main assembly 14 through the driving force transmitting means (unillustrated), the rotatable rod 47 rotated in the direction of an arrow mark A, causing the developer stirring sheet 51 to convey the developer while stirring it, and the measurement electrode wiping sheet 52 to wipe the portion of the surface of the measurement electrode 20A above the top surface 44 of the developer, at the same time.

Next, referring to FIG. 26, structure in which a stirring plate is used as the developer conveying member 9*b* will be described.

Figure 26:
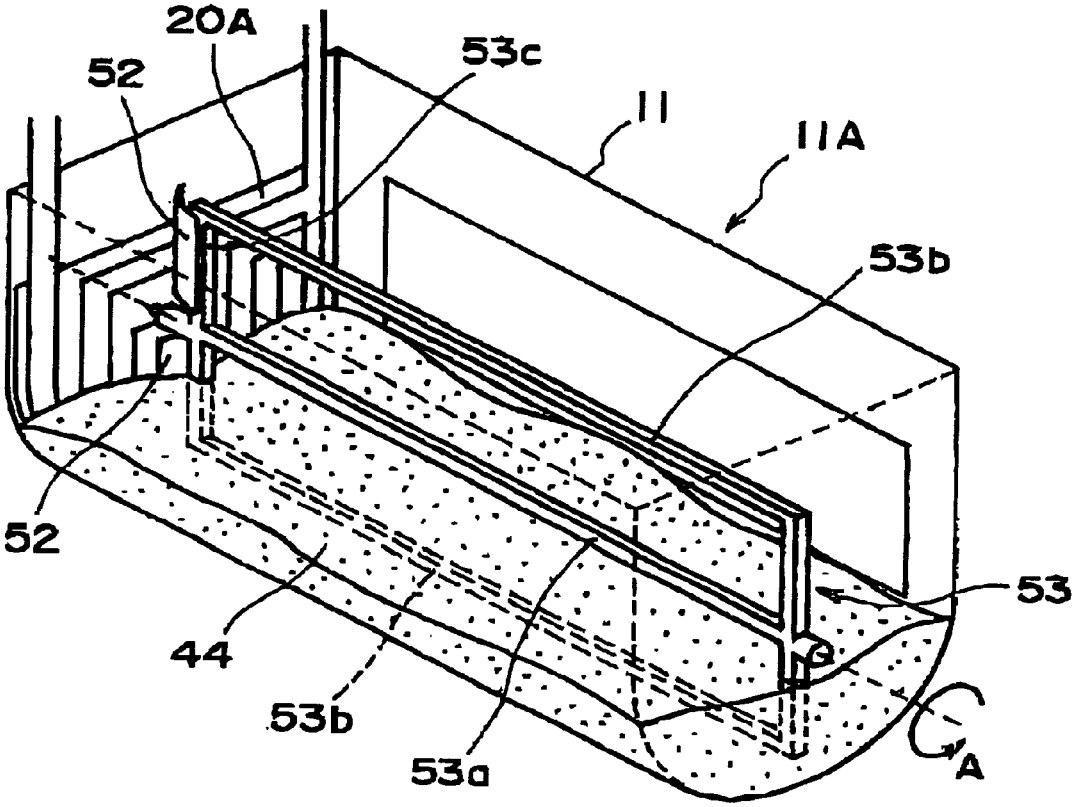
FIG. 26 is a perspective view of a developer container according to an embodiment of the present invention wherein a sheet member for wiping the measuring electrode is mounted to a stirring plate.

The stirring plate 53, a rotatable member, illustrated in FIG. 26 comprises a pair of axle portions, a rod portion 53*a*, a pair of rod portions 53*b*, and four connecting portions 53*c*. The rod portions 53*a* and 53*b* are parallelly positioned with respect to each other, with the pair of rod portions 53*a* opposing each other with respect to the rod portion 35*b*, and are connected to each other at both of their longitudinal ends adjacent to the side wall of the developer container 11A, with the connecting portion 53*a*, making up a single integral piece of a developer stirring portion in the form of a ladder. The axle portions are extended from the longitudinal ends of the rod portion 53*a*, one for one, and are supported by the developer container shell 11 so that the stirring plate 53 can be rotated in the direction of an arrow mark A. The axial line of the stirring plate 53 coincides with the axial line of the rod portion 35*a*.

Two pieces of measurement electrode wiping sheet 52 are secured to the connecting portions 35*c* one far one on the measurement electrode 20A side: the connecting portions 35*c* located on the longitudinal end of the stirring plate 53 on the measurement, electrode 20A aids serves as the mount for the measurement electrode wiping sheet 52. The free edge of each measurement electrode wiping sheet 52 is in contact with the measurement electrode 20A. In other words, in this embodiment, the measurement electrode wiping sheets 52 are symmetrically attached to the connecting portions 53*c* one for one with respect to the rotational axis of the stirring plate 53. With the provision of the above described structural arrangement, the measurement electrode 20A can be wiped by the rotation of the plate 53.

Next, referring to FIG. 27, a case in which a stirring rod 54 in the form of a crank shaft is used as the developer conveying member 9*b* will be described.

Figure 27:
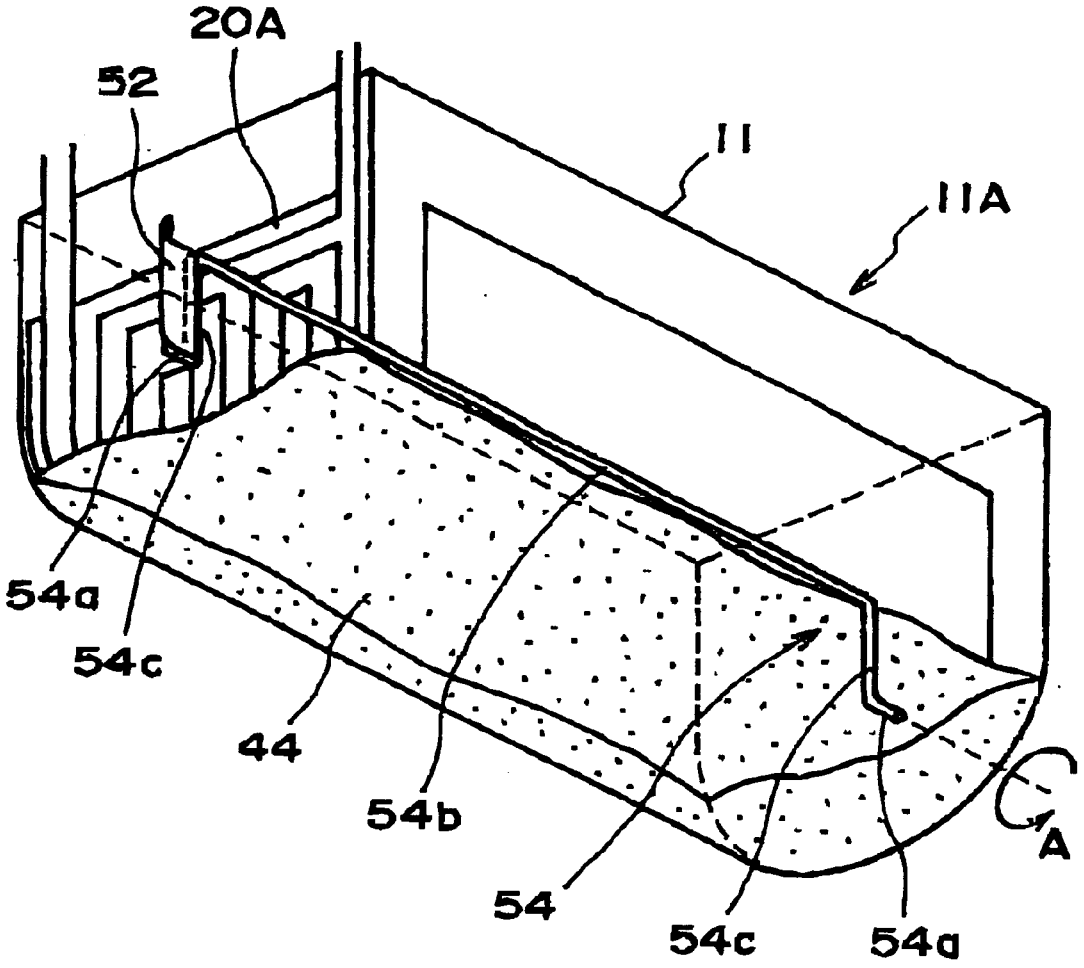
FIG. 27 is a perspective view of a developer container according to an embodiment of the present invention, wherein a sheet member for wiping the measuring electrode is mounted to a stirring rod in the form of a crank.

Referring to FIG. 27, the stirring rod 54, which is a rotatable member, is in the form of a crank shaft, and is supporting portions 54*a* and 54*a* constituting the shaft portion of the stirring red 54 are supported by the developer container shell 11, so that the stirring rod 54 can be rotated in the direction of an arrow mark A. The stirring portion 54*b* of the stirring rod 54, which is parallel to the shaft portions 54*a* and stirs the developer, is formed of a single piece of rod, along with the crank portions 54*c* and shaft portions 54*a*.

A piece of sheet 52 for wiping the measurement electrode is fixed to the crank portion 54*c* of the stirring rod 54 on the measurement electrode 20A side, and its free edge is in contact with the measurement electrode 20A. This type of structural arrangement also makes it possible for the measurement electrode 20A to be wiped by the rotation of the stirring rod 54.

As described above, according to this embodiment, it does not occur that the measurement electrode wiping sheet 52 bends in the direction to wrap itself around the rotatable rod 47 as does the measurement electrode wiping sheet 52 in the first embodiment. Therefore, the force for wiping away developer from the surface of the measurement electrode 20A is more evenly applied to the surface of the measurement electrode 20A.

As described above, according to the present invention, the amount of the developer remaining in a developer container can be continuously detected as the developer is consumed. In addition, the accuracy of an apparatus for detecting the amount of remaining developer can be improved with the employment of a simple structure.

Embodiment 3

The process cartridge and the electro-photographic image forming apparatus in this embodiment are basically the same as those in the, first embodiment, and are different from those in the first embodiment only in the structure of the wiping member for wiping the developer remaining adhered to the measurement electrode 20A. Thus, the members with the same functions and structures are given the same referential codes as those in the first embodiment, and their detailed descriptions will be not be given here.

Figure 28:
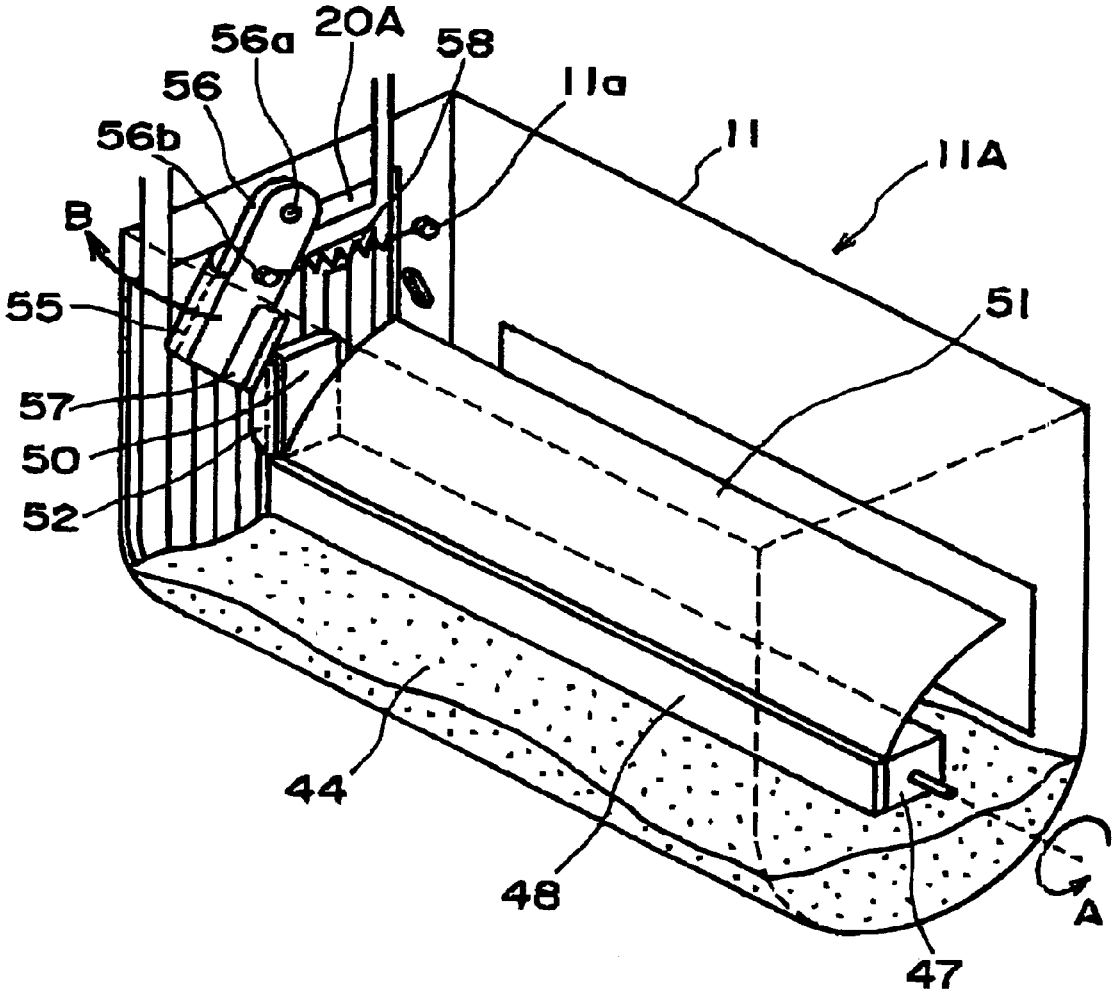
FIG. 28 is a perspective view of a developer container according to an embodiment of the present invention, wherein there are provided a sheet member for the measuring electrode and a second sheet member for assisting the measuring electrode wiping.

FIG. 28 shows the interior of the developer container 11A in this embodiment. Firstly, the structural arrangement in this embodiment is essentially the same as that in the second embodiment illustrated in FIG. 25. In other words, a piece of sheet 52 for wiping a measurement electrode is secured to a rib 50 as a sheet mount attached to the longitudinal end of the rotatable rod 47 as a rotatable member, forming a wiping member. A piece of sheet 51 for stirring developer is fixed to the rotatable rod 47 so that the longer edge of the sheet 51 becomes parallel to the longitudinal direction of the rotational rod 47. In operation, as the rotatable rod 47 is rotated, developer is stirred while the measurement electrode 20A is wiped. Secondly, with the use or the structural arrangement in this embodiment, a much wider area of the surface of the measurement electrode 20A can he wiped.

In other words, in this embodiment, in the developer container 11A the rotatable member 47 is rotatably supported by the developer container shell 11, at both of its longitudinal ends, and one of the longitudinal ends of the rotatable rod 47, that is, the longitudinal end on the measurement electrode side, is provided with the rib 50. The developer stirring sheet 51 is fixed to the rotatable rod 47, and the measurement electrode wiping sheet 52 is fixed to the rib 50. The rotatable rod 47 rotates by receiving the driving force from the driving means (unillustrated) provided in the image forming apparatus main assembly 14 through the driving force transmitting means, causing the developer stirring sheet 51 to convey developer while stirring it, and the measurement electrode wiping sheet 52 to wipe the surface of the measurement electrode 20A at the same time.

Further, in this embodiment, an supplementary means for wiping the measurement electrode is provided, which comprises a second sheet mount 56, a supplementary, or the second, piece of sheet 5*b* for wiping the measurement electrode, and an elastic member 58, as shown in FIG. 28.

To describe it more specifically, the measurement electrode wiping supplementary means in this embodiment is provided with a long and narrow sheet mount 56 as the second sheet mount. The sheet mount 56 comprises a driving force receiving portion 57 and a support portion 56*a*. The driving force receiving portion 57 is integral with one of the longitudinal ends of the sheet mount 56, and the supporting portion 56*a* is at the other longitudinal end. The sheet mount 56 is pivotably attached to the upper portion of the developer container shell 11, above the measurement electrode 20A, through the supporting portion 56*a*. Its sweeping range reaches into the sweeping range of the rib 50. The measurement electrode wiping supplementary means is also provided with the second piece, or supplementary piece, of sheet 55 for wiping the measurement electrode, which is fixed to the second sheet mount 56. Further, the measurement electrode wiping supplementary means comprises an elastic member 58, which is connected to the projection 56*b* of the second sheet mount 56 and the projection 11*a* provided on the internal surface of the developer container shell 11 so that it resists the pivotal movement of the second sheet mount 56. The second sheet mount 56 is provided with a projection 56*b*.

The measurement electrode wiping sheet 55 is fixed to the second sheet mount 56 by one of its edges, whereas another edge of the measurement electrode wiping supplementary sheet 55, or the free edge, is in contact with the surface of the measurement electrode 20A.

As the rotatable rod 47 is rotated by the driving force from the image forming apparatus main assembly 14, first, the rib 50 at one or the longitudinal ends of the rotatable rod 47 is moved to the position at which it comes into contact with the driving force receiving portion 57 of the sheet mount 56 kept on the projection 11*a* side of the developer container shell by the force of the elastic member 58.

As the rotatable rod 47 is further rotated in the direction of an arrow mark A the rib 50 makes contact with the driving force receiving portion 57. Then, as the rotatable rod 47 is further rotated in the direction of the arrow mark A, the sheet mount 56 28 moved in the direction of an arrow mark B about the supporting portion 56*a*, with the rib 50 and driving force receiving portion 57 remaining in contact with each other. As a result, the surface of the measurement electrode 20A is wiped by the measurement electrode wiping supplementary sheet 55.

As the rib 50 and driving force receiving portioned 57 are separated from each other by the further rotation of the rotatable rod 47, the sheet mount 56 is returned to the initial position, or the position on the projection 11*a* side of the development container shell 11, by the force of the elastic member 58.

As described above, as the rotatable rod 47 is rotated, not only is the surface of the measurement electrode 20A wiped by the measurement electrode wiping sheet 52, but also it is wiped by the measurement electrode wiping supplementary sheet 55 which made to swing back and force by the rotation of the rotatable rod 47.

Figure 29:
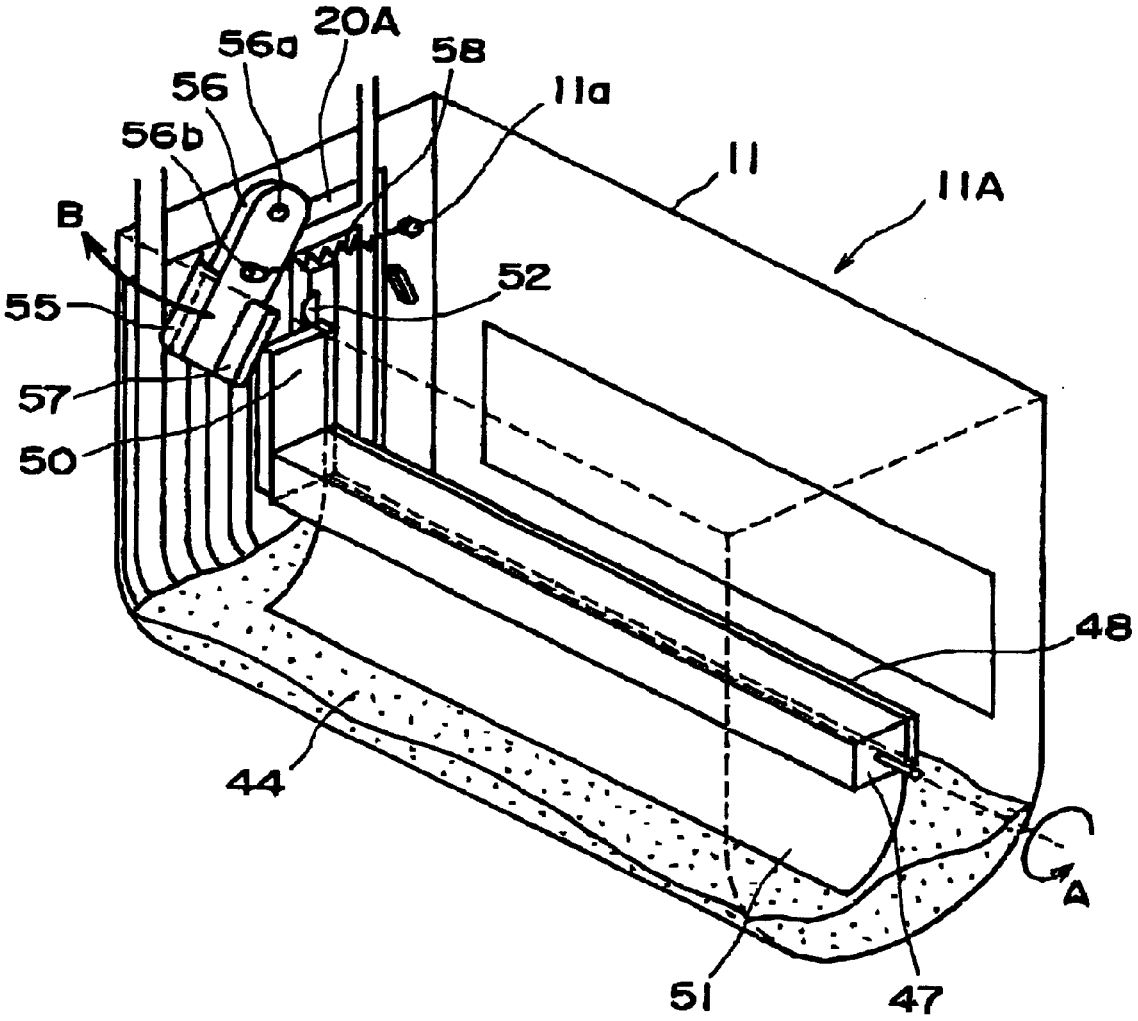
FIG. 29 is a perspective view of a developer container according to another embodiment of the present invention, wherein there are provided a sheet member for wiping the measuring electrode and a second sheet member for assisting measuring electrode wiping.

Incidentally, the rib 50 may be structured so that it extends from one of the longitudinal ends of the rotatable rod 47 in the direction apposite to the free edge of the developer stirring sheet 51 as in the second embodiment. Further, the measurement electrode wiping supplementary means may be driven by this rib 50 as shown in FIG. 29.

As described above, in this embodiment, it is made possible for the portion of the surface of the measurement electrode outside the sweeping range of the principle wiping sheet to be wiped by the measurement electrode wiping supplementary sheet. More specifically, the measurement electrode wiping supplementary sheet 55 is positioned above the sweeping range of the measurement electrode wiping sheet 52 so that a much wider area in terms of the vertical direction of the developer container 11A can be swept, allowing the measuring electrode 20A to be extended much higher. Thus, even when a tall developer container, in which the position of the top surface of the developer therein could be much higher than in an average developer container, is employed, the amount of the remaining developer can be accurately detected, continuously from the state when the top surface 44 of the developer is relatively high, that is, the state when the amount of the remaining developer is relatively large.

As described above, in this embodiment, the amount of the developer remaining in the developer container can be continuously detected. In addition, the accuracy of the apparatus for detecting the amount of the remaining developer can be improved with the employment or a simple structural arrangement.

Figure 47:
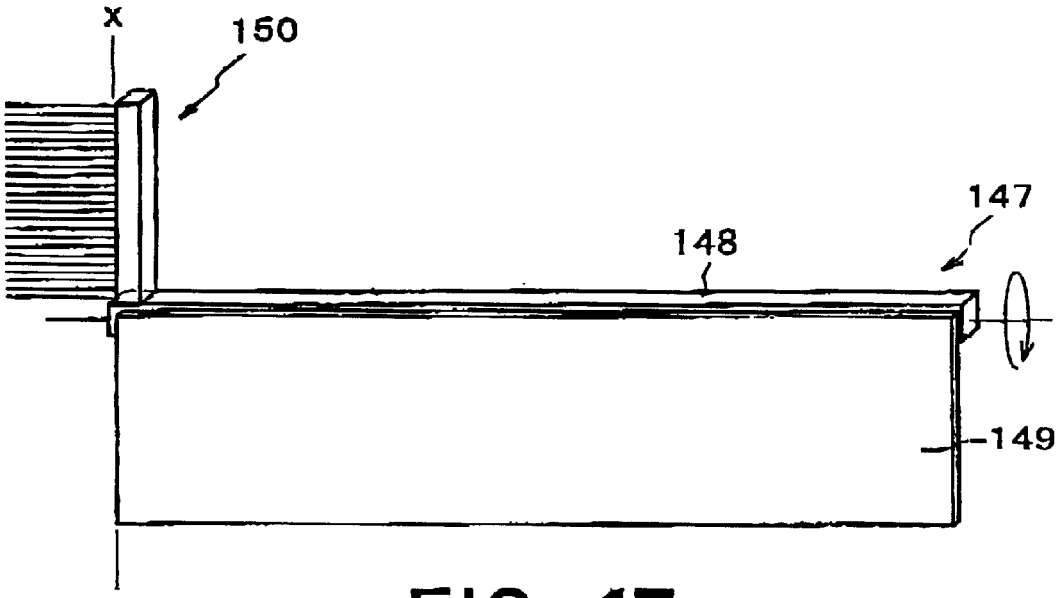
FIG. 47 is a schematic illustration of a developer feeding member provided with a wiping member for a developer amount detecting member.

FIG. 47 shows examples of a developing means and developer container. The developing means has a developer bearer 142 which bears developer and conveys it to an image bearing member, and is in the form of a sleeve, for example. The electrostatic latent image on an image bearing member is developed with the developer borne on the developer bearer 142. The developing means 140 is connected to a developer container 141, that is, a developer storage.

The developer container 141 contains a developer conveying member 147 far conveying developer to the developer bearer 142, and stirring the developer within the developer container 141. The developer conveying member 147 also doubles as a developer stirring member. It comprises a rotatable rod 148 as a rotatable member, and a piece of elastic sheet 149. The rotatable rod 148 rotatably supported approximately in parallel to the longitudinal direction of the developer bearer 142, for example. The elastic sheet 149 is formed of resin. Instead of the above described developer conveying member 147, a single piece of rod in the form of a crank shaft comprising a pair of supporting portions, which serves as axles, and a developer stirring portion, or a single piece of plate, may be employed.

Figure 44:
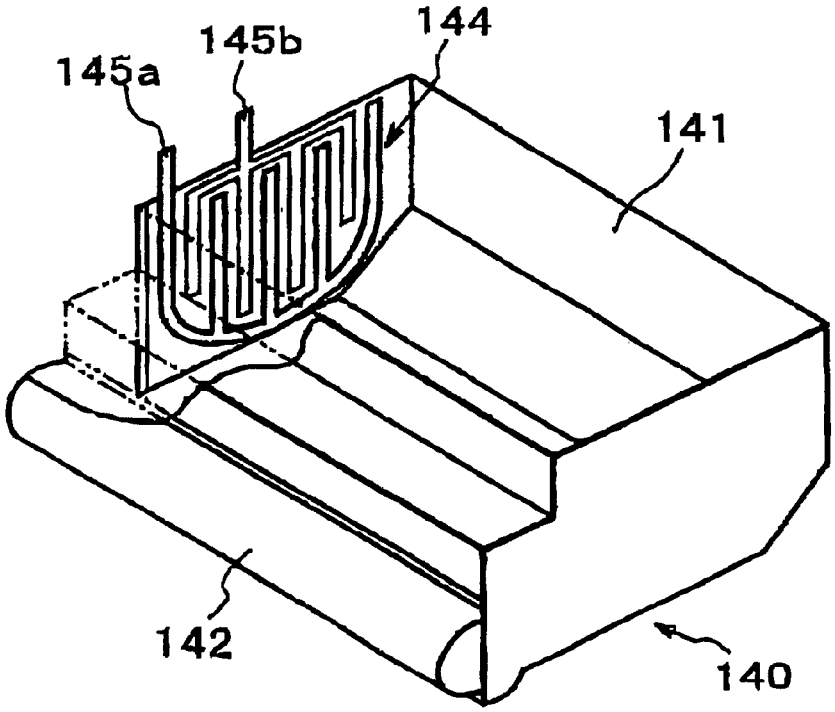
FIG. 44 is an illustration of an inner side of a developer container to which the present invention is applicable.

Although the following idea was not publicly known when the present invention was submitted for a patent, it was considered to place a member for continuously detecting the developer amount in a developer container so that the amount of the developer remaining in the developer container could be continuously detected by a developer amount detecting apparatus. FIG. 44 shows an example of a developer container 141 equipped with a developer amount detecting member 144.

As illustrated in FIG. 44, the developer amount detecting member 144 is placed at a location where it makes contact with developer, and where the size of the contact area between the developer amount detecting member 144 and the developer decreases as the developer within the developer container 13 reduces. The developer amount detecting member 144 has en electrode pattern 145 which comprises a set of at least two sub-patterns in the form of a fork, one of which includes an electrode 145*a* on the input side, and the other of which includes an electrode 145*b* on the output side. Roughly speaking, these sub-patterns are placed so that the tine portions of one sub-pattern fit one for one in the intervals of the tine portions of the other, with a uniform gap among them. The developer amount detecting apparatus applies voltage between the electrodes 145*a* and 145*b*, through the electrode 145*a* on the input side with the use of a voltage applying means (unillustrated), and the electrostatic capacity of the developer amount detection member 144, which varies in response to the presence or absence of the developer on the surface of the developer amount detecting member 144, is detected by the control section (unillustrated) provided, for example, in the image forming apparatus main assembly, through the electrode 145*b* on the output side, to continuously determine the amount of the developer. This method makes it possible to accurately and continuously detect the developer amount, rendering this method superior in development amount detection.

In the embodiment described below, the developer amount detecting member 144 for continuously detecting the amount of remaining developer is placed in the developer container 141, and the surface of the developer amount detection member 144 is wiped to prevent developer from remaining adhered thereon, or to wipe away the developer remaining thereon.

Figure 45:
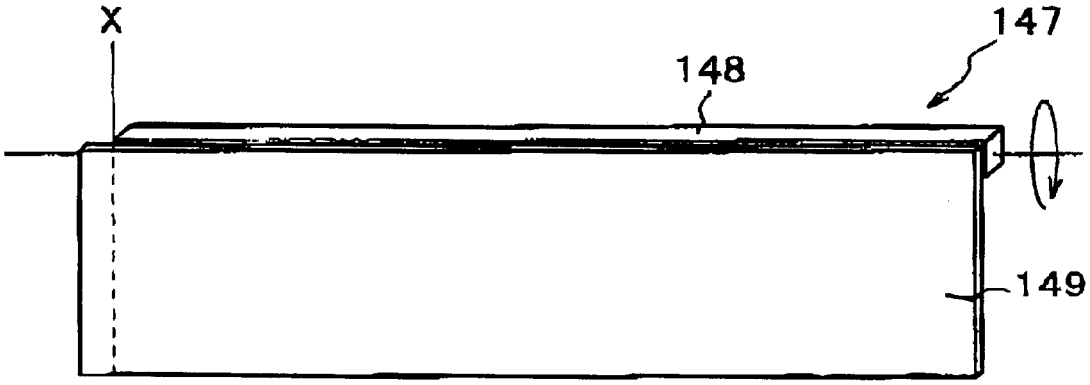
FIG. 45 is a schematic perspective view of a developer feeding member.
Figure 46:
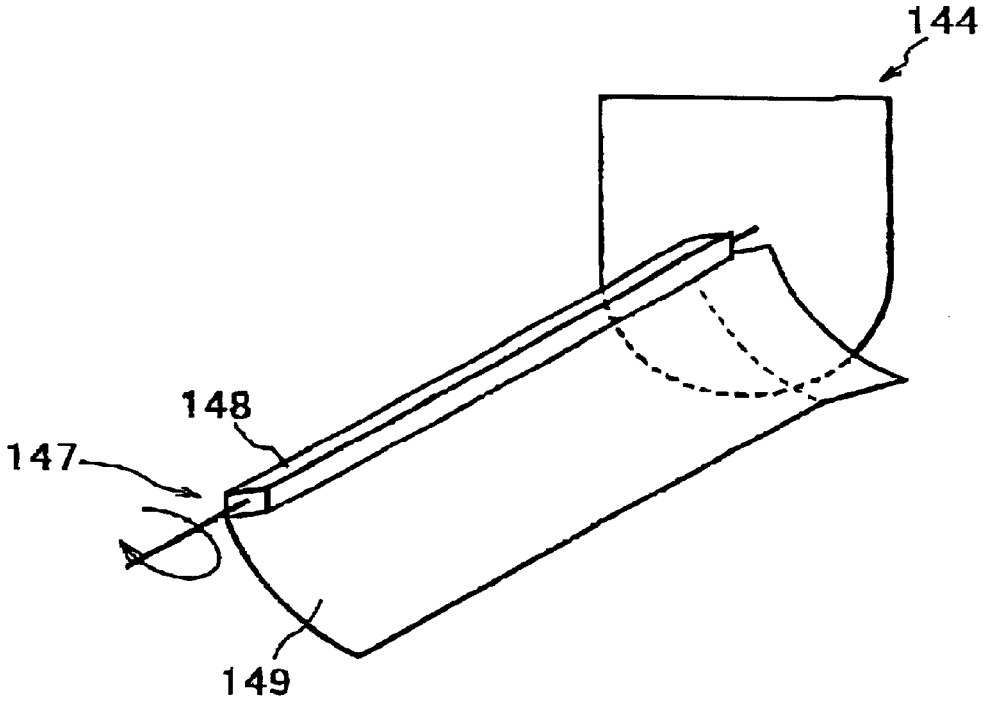
FIG. 46 is a schematic illustration of a developer feeding member which functions also to wipe the developer off the developer amount detecting member.

As for the structure for wiping the surface of the developer amount detecting member 144, the following idea may be considered: it is possible to make the developer conveying member 147, which conveys developer while stirring it, double as a member for wiping the surface of the developer amount detecting member 144. FIG. 45 shows such a developer conveying member 147. FIG. 46 shows the state of the developer conveying member 147 illustrated in FIG. 45, in which the developer conveying member 147 is wiping the surface of the developer amount detecting member on the lateral surface of the developer container 141, while conveying and stirring the developer.

More specifically, as shown in FIG. 45, the developer conveying member 147 comprises a rotatable rod 148 as a rotatable member, about the central axis of which the developer conveying member 147 rotates, and a piece of elastic sheet 149, which is approximately 30–200 $\mu$m thick and is pasted on the rotatable rod 148. As shown in FIG. 46, the dimension of the elastic sheet 149 in terms of the longitudinal direction of the developer container 141 is rendered greater than the dimension of the internal space of the developer container 141 in the same direction, so that a part of the edge portion of the elastic sheet 149 at the longitudinal end of the elastic sheet 149 is elastically deformed to be placed in contact with the developer amount detecting member 144. In other words, the developer conveying member 147 is structured so that the portion of elastic sheet 149 on the left side of the broken line X in FIG. 45, the position of which coincides with the position of the internal surface of the lateral wall of the developer container 141, theoretically enters the developer amount detecting member 144; the edge portion of the elastic sheet 149 would encroach into the space currently occupied by the developer amount detection member 144 if the developer amount detecting member 144 were not present.

With the provision of the above described structural arrangement in which the elastic sheet 149 makes theoretical entry into the developer amount detecting member 144, not only is the developer conveying member 147 given the function of conveying the developer within the developer container 141 while stirring it, but also the function of wiping away the developer remaining on the surface of the developer amount detecting member 144, while conveying the developer.

There is another structural arrangement which deserves consideration. According to this arrangement, a developer wiping member independent from the developer conveying member 147 is provided to wipe away the developer on the surface of the developer amount detecting member 144. More specifically, referring to FIG. 47, a developer wiping member 150 is in the form of a brush, which is connected to the rotatable rod 148 of the developer conveying member 147, for example. As the developer conveying member 147 rotates, the developer wiping member 150 in the form of a brush rotates about the rotational axis of the developer conveying member 147 while wiping the surface of the developer amount detecting member 144.

There are more structural arrangements which deserve consideration, in addition to the arrangement illustrated in FIG. 47. For example, it is possible to provide a wiping member which wipes away developer while rotating at the same time as the developer conveying member 147, a wiping member which wipes the developer amount detection member 144 while being moved in one direction by borrowing the force generated by the rotation of the developer conveying member 147 and also while being returned in the opposite direction by the force generated by a spring or the like, or a wiping member which is driven by a driving force completely independent from the force which drives the developer conveying member 147, to wipe the developer amount detecting member 144.

In order to wipe the developer amount detecting member 144 with the use of a simple structure, it is desired that the developer conveying member 147 is structured as illustrated in FIGS. 45 and 46, so that not only does it convey developer while stirring it, but also it wipes away developer from the surface of the developer amount detecting member 144 while conveying developer.

In recent years, it has been desired that developer is not wasted even if a process cartridge is not taken out of an apparatus and shaken, that is, virtually the entirety of the developer in a developer container can be consumed without inconveniencing a user (hereinafter, this type of structure is called a "no-shake structure", and giving a developer container the "no-shake structure" is called "no-shake-structuring").

Figure 48:
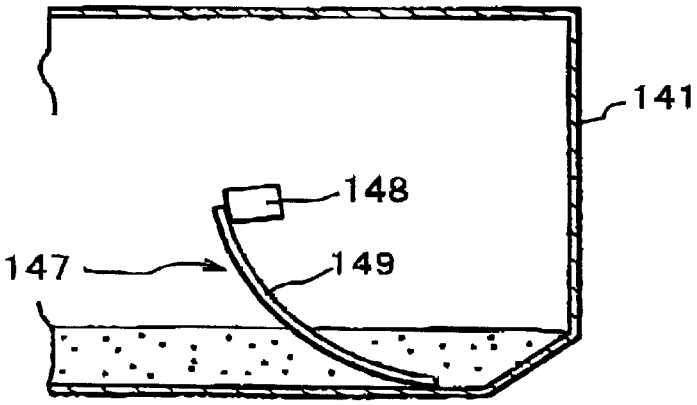
FIG. 48 is an illustration of a developer feeding member for accomplishing a non-shaking structure.
Figure 49:
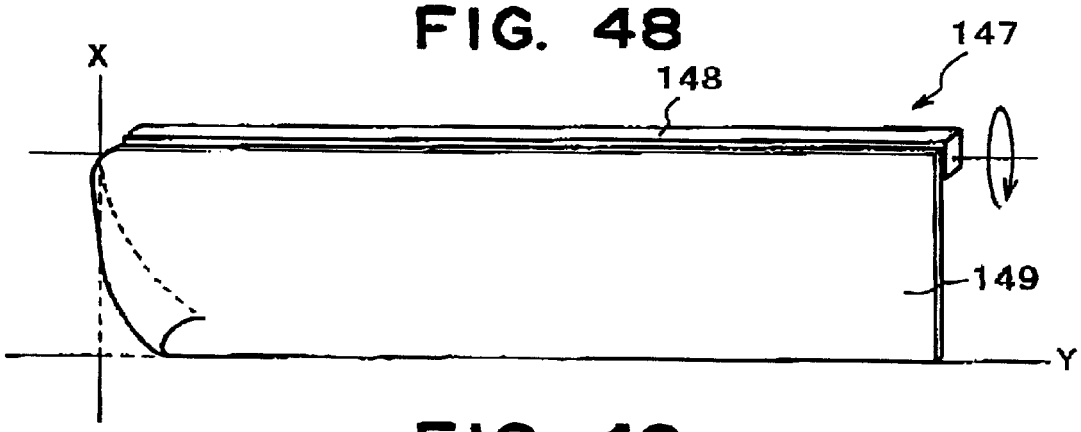
FIG. 49 is an illustration wherein a part of the developer feeding member is away from a bottom surface of the developer container.

FIG. 48 shows an example of a no-shake-structured developer container 141, which has been taken into consideration. Referring to FIG. 49, a piece of elastic sheet 149 is pasted to a rotatable rod 148 as a rotatable member to form a developer conveying member 147. The dimension of the elastic sheet 149 in the direction perpendicular to the axial direction of the rotatable rod 148 is rendered long enough for the elastic sheet 149 to be elastically bent by making contact with the internal surface of the bottom wall of the developer container 141. With this structural arrangement, as the rotatable rod 148 is rotated, the elastic sheet 149 can convey virtually the entire amount of the developer within the developer container 141, remaining in contact with the bottom wall of the developer container 141 while elastically bending.

If a developer amount detecting member 144 is on the internal surface of the side wall of the developer container 141, it is feasible to extend the elastic sheet 149 of the developer conveying member 147 in the axial direction of the rotatable rod 148 in such a manner that the elastic sheet 149 theoretically enters the surface of the developer amount detecting member 144 on the side wall of the developer container 141 and wipes the developer remaining on the surface of the developer amount detecting member 144, end it is also feasible to extend the elastic sheet 149 in such a manner that it theoretically enters the bottom surface of the developer container 141, in order to no-shake-structure the developer container 141. In the case of this type of arrangement, a large amount of force is applied to the elastic sheet 149 in the direction parallel to the side wall of the developer container 141. The tests conducted by the inventors of the present invention revealed that the elastic sheet 141 partially floats from the bottom surface of the developer container 141, as shown in FIG. 49, due to this force which applies to the elastic sheet 149, failing to remain fully in contact with the bottom surface of the developer container 141. In FIG. 49, a broken line X represents the surface of the side wall of the developer container 141, and a broken line Y represents the internal surface of the bottom wall of the developer container 141.

As a result, a certain amount of developer remains unused in the developer container 141.

In the preceding sections of this specification, the cleaning of the developer amount detecting member 144 and the no-shake-structuring of the developer container 141 were described with reference to an image forming apparatus of a process cartridge type. However, it became evident that if an attempt was made to rely on only the developer conveying member 147 to clean the developer amount detecting member 144 as well as to no-shake-structure the developer container 141, it was possible that phenomena similar to the above described problem would also occur in an image forming apparatus, in the main assembly of which a developing apparatus equipped with, for example, a developing means 140 and a developer container 141, is removably installable, and also an image forming apparatus, to the main assembly of which a developing apparatus replenishable with developer is fixed.

Thus, the object of the embodiments of the present invention which will be described next to provide, without a cost increase, an image forming apparatus, a process cartridge, and a developer conveying member, which are structured so that the surface of the developer amount detecting member is wiped, and the developer within the developer container is wastelessly consumed without inconveniencing a user.

Hereinafter, a process cartridge, an electrophotographic image forming apparatus, a developer conveying member, and a developer container, will be described in more detail with reference to the appended drawings.

Figure 30:
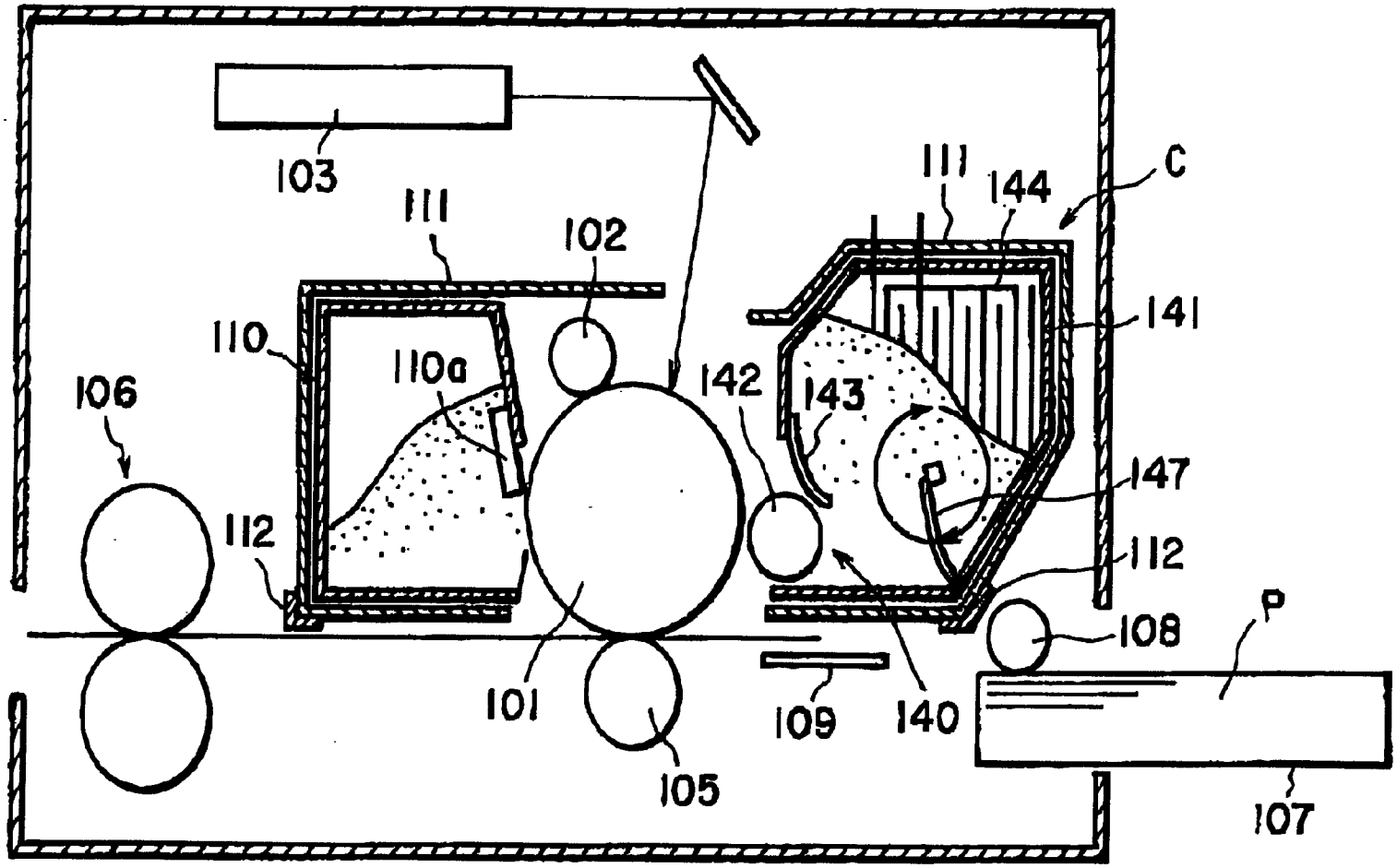
FIG. 30 is a schematic illustration of an electrophotographic image forming apparatus to which a process cartridge according to the present invention can be detachably mounted.

First, referring to FIG. 30, the electrophotographic image forming apparatus in this embodiment will be described. The electrophotographic image forming apparatus in this embodiment is an electrophotographic laser beam printer which employs a process cartridge system. It form images on recording media, for example, a recording sheet, an OHP sheet, and fabric, or the like, with the use of an electrophotographic image formation process.

The image forming apparatus in FIG. 30 has a cylindrical electrophotographic photosensitive member 101, that is, an electrophotographic photosensitive drum (hereinafter, simply called "photosensitive drum") as an image bearing member, which rotates about its rotational axis in the direction indicated by an arrow mark. After being uniformly charged by a charging means 102, the peripheral surface of the photosensitive drum 101 is exposed by a laser-based exposing system 103, which is an exposing means (latent image forming means), in accordance with image formation information. As a result, an electrostatic latent image is formed on the surface.

As the photosensitive drum 101 rotates, the electrostatic latent image on the photosensitive drum 101 reaches a development position at which the electrostatic latent image squarely faces a developing means 140, and the developing means 140 develops the electrostatic latent image into a visible image (toner image) by developing the image portion of the electrostatic latent image with developer.

The visible image (toner image) developed on the photosensitive drum 101 with the use of developer is transferred onto a piece of recording medium P by the function of a transferring means 105, at the position (transfer station) where the peripheral surfaces of the transferring means 15 and photosensitive drum 101 squarely face each other. The recording medium P is fed out of a recording media storing portion 107 by a recording medium feeding roller 108 and a conveying means 109, and is further conveyed to the transfer station, while the arrival of the leading edge of the recording medium P to the transfer station is synchronized with the arrival of the leading end of the toner image on the photosensitive drum 101 to the transfer station, by a registration roller (unillustrated).

After being transferred onto the recording medium P, the toner image is conveyed, while being borne on the recording medium P, to a fixing apparatus 106, in which it is fixed to the recording medium P by heat and pressure, to effect a permanent copy. Meanwhile, the developer which remained on the photosensitive drum 101 after the transfer is removed by a blade 110*a*, or a cleaning means, and is stored in a waste developer container 110. Then, the photosensitive drum 101 is recharged by the charging means 102 to be used for the following cycle of image formation.

Figure 31:
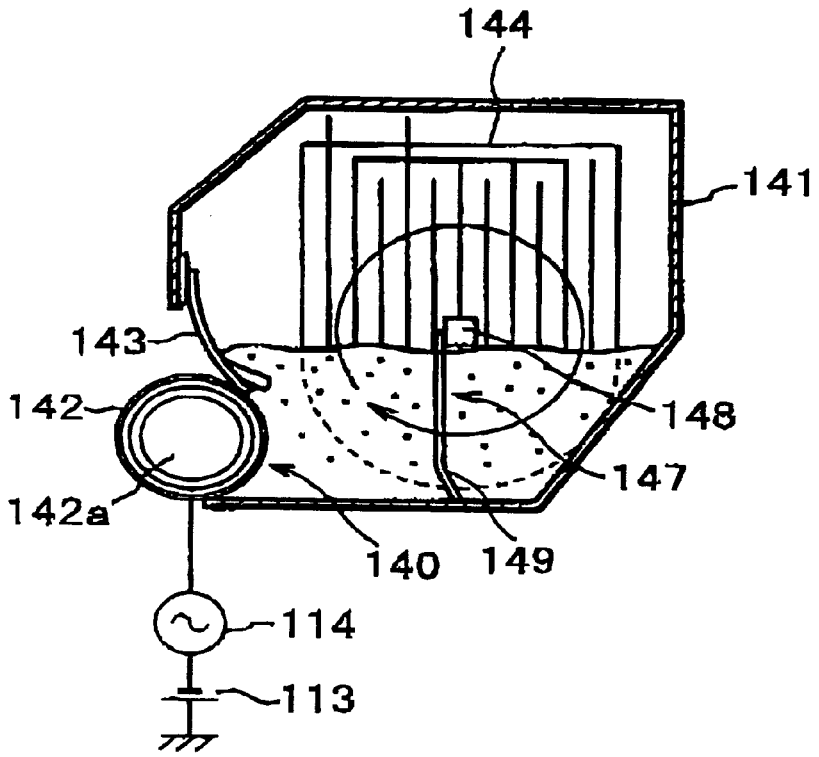
FIG. 31 is a schematic illustration of a developing device according to an embodiment of the present invention.

As will be understood by referring to FIG. 31, in this embodiment, the developer container 141 as a developer storage is connected to a developing means 140. The developing means 140 comprises the development sleeve 142, as a developer bearing member, and an elastic blade 143 as a developer regulating means for regulating the thickness of the developer borne on the development sleeve 142.

The development sleeve 142 comprises a nonmagnetic aluminum cylinder with a diameter of 16 mm, and a layer of resin coated on the peripheral surface of this aluminum cylinder. The resin contains electrically conductive particles. Within the internal space of the development sleeve 142, a magnet roll 142 with four magnetic poles is placed.

The elastic blade 143 as a developer regulating member is positioned so that it makes surface-to-surface contact with the development sleeve 142. The elastic blade 143 in this embodiment is formed of silicone rubber with a hardness of 40 degrees (JIS), and is kept pressed upon the peripheral surface of the development sleeve 142 so that the contact pressure between the two surfaces remains at approximately 30–40 gf/cm (in terms of the longitudinal direction of the development sleeve 142).

In this embodiment, negatively chargeable single component toner is employed as the developer. In manufacturing this developer, 100 parts in weight (wt. parts) of styrene-butyl acrylate copolymer as binder resin, 80 wt. parts of magnetic particle, two wt. parts of mono-azoic complex of iron as negative charge controller, and two wt. parts of polypropylene as wax, are melted and mixed with the use of a double axle extruder heated to 140° C. Then, after being cooled, the mixture is roughly pulverized by a hammer mill, and then microscopically pulverized by a jet mill. The microscopic particles are air classified to obtain microscopic particles with an weight average diameter of 5.0 $\mu$m. Then, the thus obtained classified particles of the mixture are mixed with 1.0 part in weight of microscopic particle of hydrophobic silica by a Henschel mixer, to obtain the final product or developer, the weight average of which is in a range of 3.5–7.0 $\mu$m (mostly 6 $\mu$m).

To the development sleeve 142, compound bias voltage comprising DC voltages and AC voltage is supplied from bias supply power sources 113 and 114 connected to the development sleeve 142, so that a proper amount of development bias is applied between the photosensitive drum 101 and development sleeve 142.

Regarding the development bias voltage applied to the development sleeve 142, when the gap between the photosensitive drum 101 and development sleeve 142 is approximately 300 $\mu$m, for example, a DC voltage of −500 V, and an AC voltage which is rectangular in waveform, 1600 V in peak-to-peak voltage, and 2200 in frequency, are applied. In this embodiment, the potential level Vd to which the photosensitive drum 101 is charged by the charging means 2 is set at a potential level of −600 V (Vd=−600 V), which corresponds to a dark area (dark area potential level). The potential level V1 of the exposed area, which corresponds to the light areas, is set at −150 V (V1=−150 V). In this embodiment, the areas with the light area potential level are developed (reversal development).

In this embodiment, the developer container 141 is provided with the developer conveying member 147, which is rotatably supported in the developer container 141 to stir and convey the developer within the developer container 141: the developer conveying member 146 doubles as a developer stirring member. The developer conveying member 147 is rotated in the direction indicated by an arrow mark. It has a rotatable rod 148, a rotatably member, which constitutes the rotational axle of the developer conveying member 147, and the axial line of which is parallel to the axial line of the development sleeve 142. The developer conveying member 147 is also provided with a piece of elastic sheet 149 formed of, for example, PET (polyethylene-terephthalate), which is fixed to the rotatable rod 148 by one of its long edges so that this edge becomes parallel to the longitudinal direction of the rotatable rod 148. The selection of the material for the elastic sheet 149 does not need to be limited to PET.

The developer conveying member 147 rotates as the driving force from the driving means (unillustrated) provided in the image forming apparatus main assembly is transmitted to the developer conveying member 147 through the driving force transmitting means (unillustrated) comprising the gears and the like provided in the process cartridge. As the developer conveying member 147 rotates, the elastic sheet 149 pasted to the rotatable rod 148 conveys the developer to the development sleeve 142 while stirring it. The developer conveying member 147 will be described later in detail.

After being conveyed to the developing means 140 by the developer conveying member 147, the developer is borne in a layer on the development sleeve 142 by the magnetic force of the magnetic roll 142*a*. Then, as the development sleeve 142 is rotated in the direction of an arrow mark, the thickness of the layer of developer on the development sleeve 142 is regulated to a predetermined thickness, while being triboelectrically charged, by the elastic blade 143. As the development sleeve 142 is further rotated in the direction of the arrow mark, the developer is supplied to the position (development station) where the peripheral surfaces of the development sleeve 142 and photosensitive drum 101 virtually make contact with each other. In the development station, the developer on the development sleeve 142 is transferred onto the electrostatic latent image on the photosensitive drum 101 by the aforementioned development bias, effecting a toner image.

In this embodiment, the electrophotographic photosensitive member 101 (photosensitive drum), the developing means 140, that is, a processing means, which has the development sleeve 142 and elastic blade 143, and acts on the photosensitive drum 101, the charging means 102, the cleaning blade 110*a*, that is, the cleaning means, the developer container 141 connected to the developing means 140, and the waste developer container 10 connected to the cleaning means, are integrally placed in a shell 111 to form a process cartridge C.

This process cartridge C is removably installable in the image forming apparatus main assembly equipped with an installing means 112, and forms images on the recording medium F conveyed by the conveying means 109 of the image forming apparatus, with the use of an electrophotographic image formation process.

Figure 32:
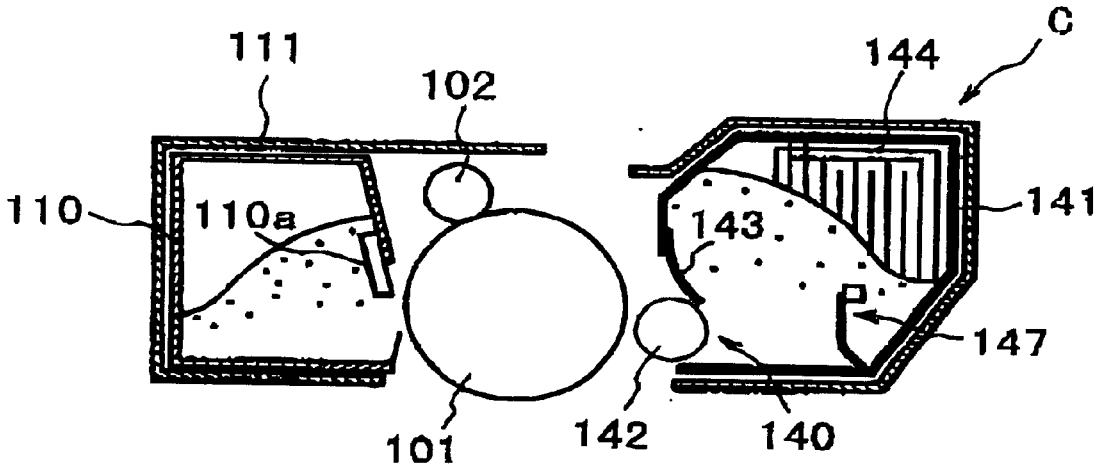
FIG. 32 is a schematic illustration of a process cartridge according to an embodiment of the present invention.

FIG. 32 shows the general structure of the process cartridge C in this embodiment. The design of the process cartridge C in this embodiment is such that the service lives of the processing means in the process cartridge C, that is, the photosensitive drum 101, charging means 104, and cleaning means 110*a*, expire approximately at the same time that the developer within the developer container 141 is completely depleted. Therefore, the process cartridge C in this embodiment enjoys the advantage that a user can expect. that as long as developer is within the process cartridge C, satisfactory images are always obtained, and that the above described processing means can be easily replaced because they are integrated in the form of a process cartridge.

The image forming apparatus in this embodiment has a developer amount detecting apparatus, which makes it possible to continuously detect the amount of the developer within the developer container 114 as the developer is consumed. Thus, the amount of the remaining developer is continuously detected based on the output of a developer amount detecting member 144 provided for continuously detecting the developer amount in the developer container 141.

In this embodiment, the developer amount detecting member 144 is of a so-called capacitance type, which changes in its capacitance in response to the change in the dielectric constant of the substance on the surface of this developer amount detecting member 144. More specifically, referring to FIG. 33(*a*), the developer amount detecting member 144 has an electrode pattern comprising a pair of electrodes, that is, an input electrode 145*a* and an output electrode 145*c,* which are in the form of a multi-tined fork, the tine portions of the input electrode 145*a* and the tine portions of the output electrodes 145*b* being alternately placed in parallel at predetermined intervals.

Figure 33:
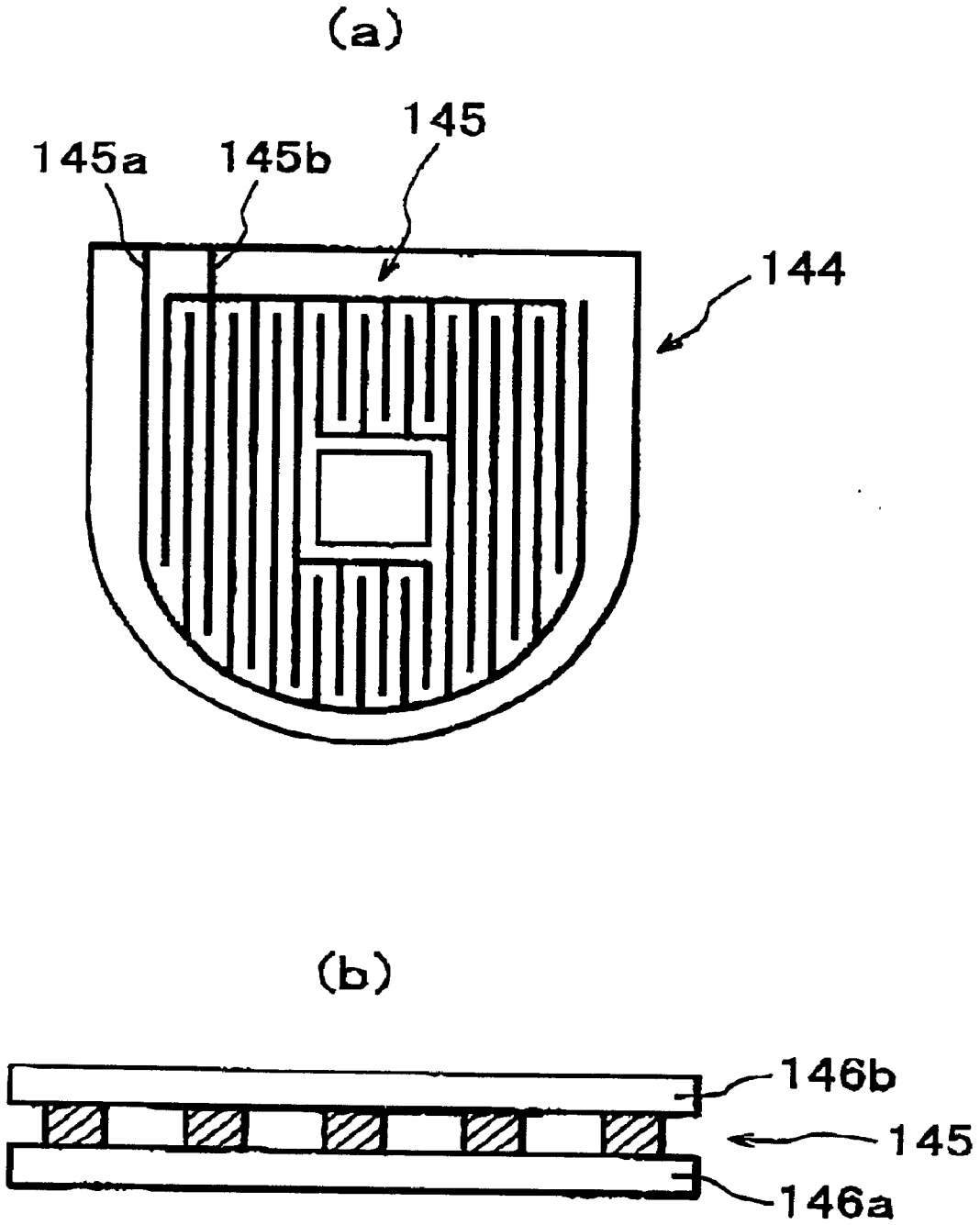
FIG. 33 is a (a) front view and a (b) sectional view of a detecting member for detecting an amount of a developer provided in a developer container.

Referring to FIG. 33(*b*), which is a cross-sectional view of the developer amount detecting member 144, the developer amount detecting member 144 is formed by accumulating a base film 146*a,* the electrode pattern 145, and a cover film 146*b,* in lasers. The base film 146*a* and cover film 146*b* are formed of PET (polyethylene terephthalate), and are both 25 μm thick. The electrode pattern 145 is formed by etching a copper plate using an ordinary method, and is 40 μm in thickness.

The developer amount detecting member 144 in this embodiment is a development amount detecting member 144, and is placed at a position at which the size of the contact area between the developer amount detecting member 144 and the developer within the developer container 141 is reduced as the developer amount decreases it is placed on the side wall of the developer container 141, that is, the wall of the developer container 141 perpendicular to the longitudinal direction of the development sleeve 142. In operation, voltage is applied between the electrodes 145*a* and 146*b* from a voltage applying means (unillustrated) on the image forming apparatus main assembly side, through the input electrode 145*a,* and the electrostatic capacity between the electrodes 145*a* and 145*b* is detected by the control portion (unillustrated) on the image forming apparatus main assembly side, through the output electrode 141*b,* to continuously detect the amount of the developer remaining in the developer container 141.

The developer amount detection member 144 is given an electrode pattern such as the electrode pattern 145 illustrated in FIG. 33(*a*), so that the length by which the tine portions of one electrode alternately opposite the tine portions of the other electrode is increased to improve the detection sensitivity of the developer amount detecting member 144, and also so that the entire surface of the developer amount detecting member 144 becomes approximately uniform in terms of detection sensitivity.

With the use of the above described developer amount detecting member 144, how much of the surface area of the developer amount detecting member 144 is covered with the developer can be detected as a capacitance value, since developer and air have different dielectric constants.

To describe the method for displaying the developer amount, the information detected by the aforementioned developer amount detecting apparatus is displayed on, for example, the screen of a terminal such as the personal computer of a user, as shown in FIGS. 17 and 18. In FIGS. 17 and 18, a user is informed of the amount of developer by the location on a gauge 42 pointed to by a hand 41 which moves in proportion to the developer amount. Instead, an indicator comprising LEDs or the like may be directly attached to the electrophotographic image forming apparatus main assembly, so that one of the LEDs corresponding to the current developer amount blinks.

According to this embodiment, the developer amount can be continuously detected. More specifically, assigning a ratio of 100% to the amount of the developer in a brand new developer container, the amount of the developer can be continuously detected across the entire range of 100% to 0%. However, the present invention is not limited by this embodiment. For example, the developer amount detecting means may be structured to detect a developer amount only when the developer amount is within a range of 50–0%. Incidentally, a ratio of 0% does not mean that the developer has been completely depleted: it includes a state in which a small amount of developer still remains in the developer container 141, and this amount is not large enough to maintain a predetermined level of image quality.

In the case of the developer container 141, in which the developer amount detecting member 144 is pasted on the interior surface of its side wall as in this embodiment, in essence, the height of the top surface of the developer remaining in the developer container 141 is measured based on the above described principle. Therefore, the manner in which the developer remains in the developer container 141, that is, the shape of the cross section of the body of the developer perpendicular to the longitudinal direction of the developer container 141 at the center portion of the developer container 141 in terms of the longitudinal direction, is desired to remain always the same as the manner in which the developer remains on the surface of the developer amount detecting member 144, that is, the shape of the contact area between the surface of the developer amount detecting member 144 and the body of the developer.

However, the developer tends to remain on the developer amount detecting member 144 due to the cohesive force of the developer, the electrostatic force, and the like.

Therefore, in this embodiment, the dimension of the elastic sheet 149 of the developer conveying means 147 in the developer container 141 in terms of its longitudinal direction is made greater than the dimension of the internal space of the developer container 141 in the same direction, so that the edge of the elastic sheet 149 is theoretically entered into the developer amount detecting member 144. In other words, the longitudinal end of the elastic sheet 140 is placed in contact with the developer amount detecting member 144 in such a manner that the elastic sheet 149 is elastically deformed by the surface of the developer amount detecting member 144. As a result, as the developer conveying member 147 is rotated, the elastic sheet 149 aggressively rubs the surface of the developer amount detecting member 144 to wipe away the developer from the surface of the developer amount detecting member 144.

In addition, in this embodiment, the dimension of the elastic sheet 149 in terms of the direction perpendicular to the axial line of the rotatable rod 148 is made greater than the distance between the axial line of the rotatable rod 148 and the internal surface of the bottom wall of the developer container 141, so that the elastic sheet 149 makes theoretical entry into the bottom wall of the developer container 141. In other words, the free end of the elastic sheet 149 is placed in contact with the bottom surface of the developer container 141 in such a manner that the elastic sheet 149 is elastically deformed by the bottom surface of the developer container 141. As a result, as the developer conveying member 147 is rotated, the elastic sheet 149 rubs the bottom surface of the developer container 141 to convey virtually the entire developer in the developer container 141. In other words, the developer container 141 is no-shake-structured.

Next, the developer conveying member 147 will be described in more detail.

Figure 34:
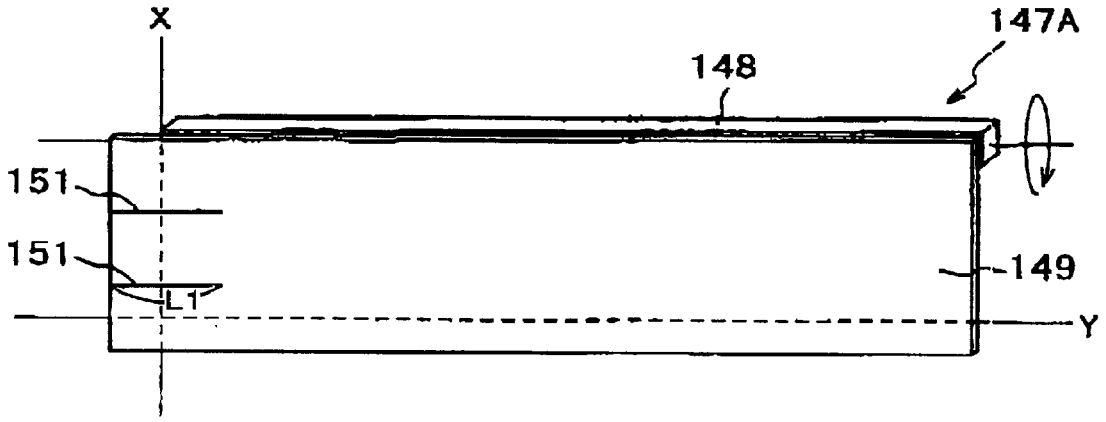
FIG. 34 is a schematic perspective view of a developer feeding member to which the present invention is applicable.

First, in this embodiment, in order to study the efficiency with which the developer on the surface of the developer amount detecting member 144 is, wiped away when only the developer conveying member 141 is employed, and also to study the feasibility of no-shake structuring a process cartridge with the use of only the developer conveying member 147, a developer conveying member 147A illustrated in FIG. 34 is prepared, and the design of the elastic sheet 149 is varied as will be described later, to study the performance difference among the various designs. In FIG. 34, a broken line X represents the position of the internal surface of the side wall of the developer container 141, and a broken line Y represents the internal surface of the bottom wall of the developer container 141. The portions of the elastic sheet 149 extending beyond these lines X and Y are portions which make theoretical entry into the side and bottom walls of the developer container 141, respectively. The developer conveying member 147 is rotated in the direction of an arrow mark.

As for the material for the elastic sheet 149 of the developer conveying member 147A, a piece of 50 $\mu$m thick PET is used. Since the developer amount detecting amount in this embodiment is placed on the internal surface of one of the side walls of the developer container 141, the dimension of the elastic state 149 is increased in the longitudinal direction of the developer conveying member 147A, so that the edge of the elastic sheet 149 on the developer amount detecting member 144 side makes theoretical entry into the developer amount detecting member 144.

Further, the edge portion of the elastic sheet 149 which makes theoretical entry into the developer amount detecting member 144 is provided with a plurality of slits 151 cut inward from the edge in the direction perpendicular to the surface of the developer amount detecting means 144, that is, in the direction in which the edge portion makes theoretical entry into the developer amount detecting member 144. The length L1 of the slit is not limited to a certain length, and in this embodiment, it is rendered greater than the amount of the theoretical entry of the elastic sheet 149 into the developer amount detecting member 144, that is, the length of the portion of the elastic sheet 149 from the edge of the elastic sheet 149 on the developer amount detecting member 144 side to the position of the internal surface of the side wall of the developer container 141 indicated by the broken line X in the drawing. These slits 151 are provided so that the distribution of the force applied by the elastic sheet 149 in terms of the direction parallel to the shorter edge of the elastic sheet 149 becomes uniform.

When tests were conducted in which developer was actually consumed by the developing apparatus 4 equipped with the developer conveying member 147A illustrated in FIG. 34, it was recognized that the developer conveying member 147A was satisfactory in terms of performance in wiping away the developer on the surface of the developer amount detecting member 144.

In the tests which will be described next, developer conveying members 147B–147H, which were recreated by variously modifying the structure of the elastic sheet 149 of the aforementioned developer conveying member 147A, and will be described later, were prepared. Then, the remnant amount of the developer on the bottom wall of the developer container 141, the performance in wiping away the developer from the developer amount detecting member 144, the performance in stirring the developer, and the performance in conveying the developer, were confirmed for each developer conveying member. following the procedure described below.

That is, the developer conveying members 147 differentiated in structure were placed in their own developer containers 141, and each developer container 141 was completely filled with developer. Then, the developer in each container was consumed to form images having a printing pattern with a printing ratio of 4%. During the printing operations, the conditions of the developer conveying members 147 during the developer consumption, the manner in which the developer remained on the bottom surface of the developer container 141 at the point in time when aberrant white spots began to appear, and the manner in which the developer remained on the surface of the developer amount detecting member 144, were confirmed.

The developer conveying member structure was variously modified while satisfying the following basic measurements.

Basic Measurement:

Rotational rod 148: 4 mm×4 mm square rod

Distance from axial line of rotational rod 148 to bottom surface of developer container 141: 21.5 mm Amount of theoretical entry into bottom wall of developer container 141: 2.0 mm (distance from axial line of rotational rod 148 to free end of elastic sheet 149: 23.5 mm)

Amount of theoretical entry into developer amount detecting member 144: 2.0 mm (only in direction of developer amount detecting member 144)

Rotational velocity: 5 sec/rotation

FIGS. 35–41 show the developer conveying member 147B–147H different in structure. The broken lines X and Y in the drawings show the positions of the internal surfaces of the side and bottom walls, respectively, of the developer container 141. Each developer conveying member rotated in the direction of the arrow mark in the corresponding drawing.

Figure 35:
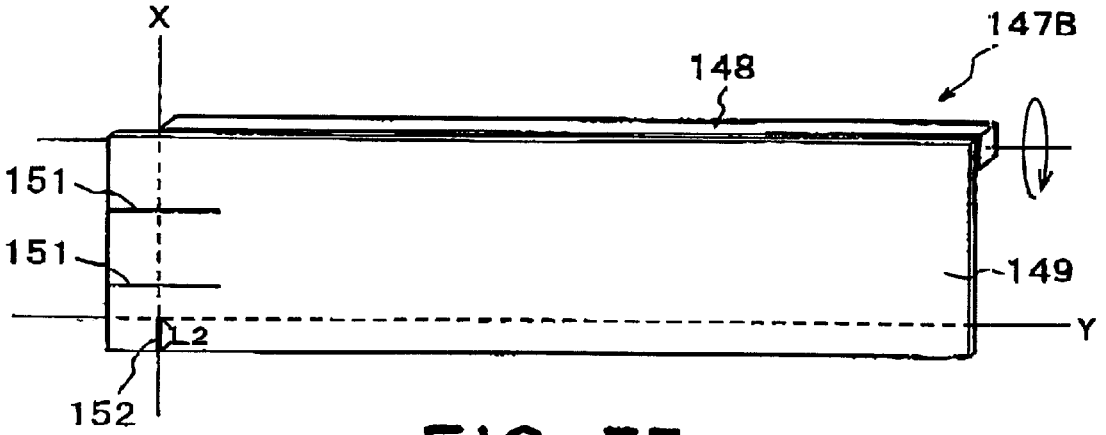
FIG. 35 is a schematic perspective view of a developer feeding member according to an embodiment of the present invention.

The elastic sheet 149 of the developer conveying member 147B illustrated in FIG. 35 was provided with a slit 152. The position of the slit 152 corresponds to the broken line X, which indicates the position of the internal surface of the side wall of the developer container 141, on which the developer amount detecting member 144 was placed. It was cut inward from the free edge of the elastic sheet 149, in parallel to the shorter edges of the elastic sheet 149, that is, in the direction perpendicular to its theoretical entry direction relative to the developer amount detecting member 144. The length L2 of the slit 152 was approximately the same as the amount of entry of the elastic sheet 149 into the developer container 141, which is indicated by the broken line Y in the drawing.

Figure 36:
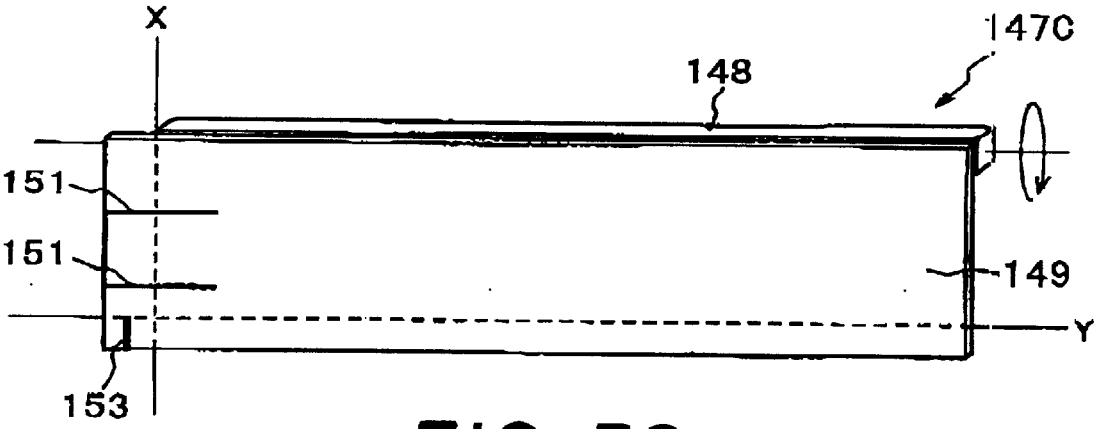
FIG. 36 is a schematic perspective view of a developer feeding member according to a comparison example.

The elastic sheet 149 of the developer conveying member 147C illustrated in FIG. 36 was provided with a slit 153 parallel to the shorter edges of the elastic sheet 149. More specifically, the slit 153 was cut in the portion of the elastic sheet 149, which made theoretical entry into the developer amount detecting member 144. In other words, the position of the slit 153 was on the outward side with respect to the position of the internal surface of the side wall of the developer container 141, which is indicated by the broken line X in the drawing.

Figure 37:
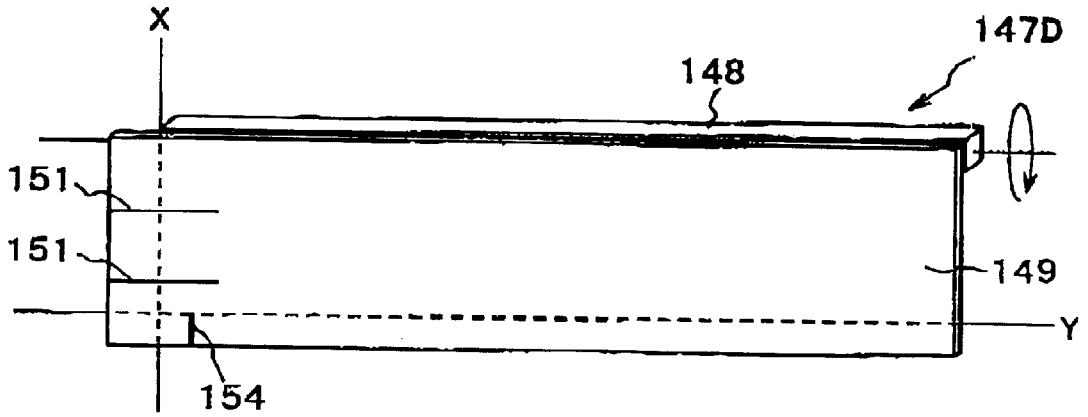
FIG. 37 is a schematic perspective view of a developer feeding member according to another comparison example.

The elastic sheet 149 of the developer conveying member 147D illustrated in FIG. 37 was provided with a slit 154 parallel to the shorter edges of the elastic sheet 149. The position of the slit 154 was on the inward side, in terms of the longitudinal direction of the elastic sheet 149, with respect to the position of the internal surface of the side wall of the developer container 141, which is indicated by the broken line X in the drawing.

Figure 38:
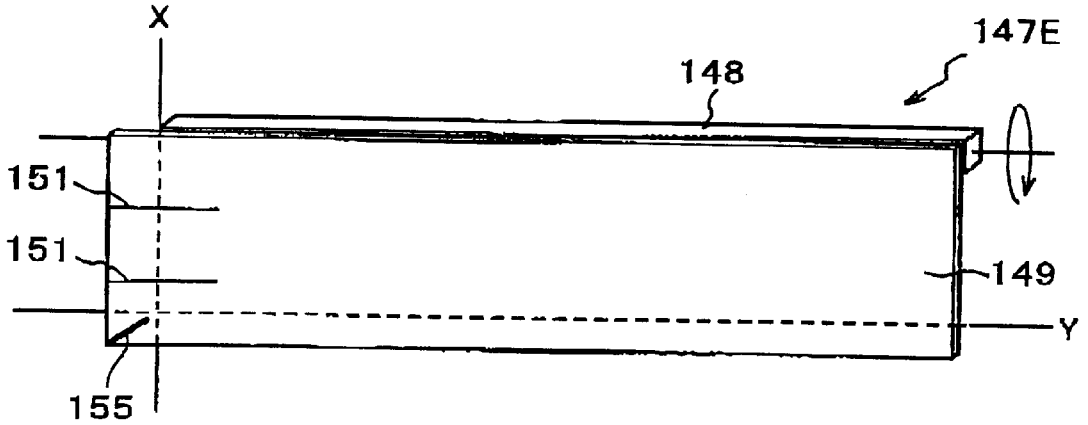
FIG. 38 is a schematic perspective view of a developer feeding member according to a further comparison example.

The elastic sheet 149 of the developer conveying member 147E illustrated in FIG. 38 was provided with a diagonal slit 155 cut from the point of the elastic sheet 149 corresponding to the intersection of the broken lines X and Y, which indicates the positions of the internal walls of the side and bottom walls of the developer container 141, respectively, to the corner of the free edge of the elastic sheet 149.

Figure 39:
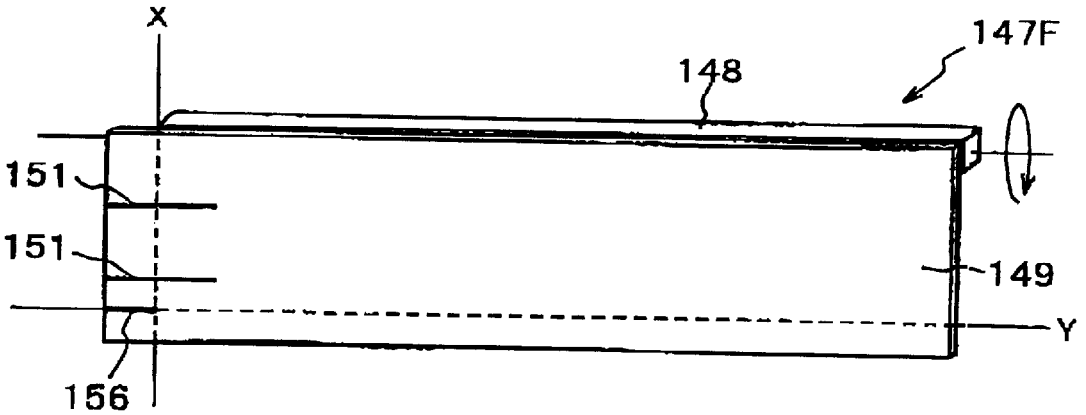
FIG. 39 is a schematic perspective view of a developer feeding member according to a further comparison example.

The elastic sheet 149 of the developer conveying member 147F illustrated in FIG. 39 was provided with a slit 156 parallel to the longitudinal direction of the elastic sheet 149. More specifically, the slit 156 was cut in the portion of the elastic sheet 149, which made theoretical entry into the developer amount detecting member 144. It was cut along the broken line Y which indicates the position of the internal surface of the bottom wall of the developer container 141. In this embodiment, it was cut inward from the edge of the elastic sheet 149 on the entry side to the position corresponding to the position of the internal surface of the side wall of the developer container 141 indicated by the broken line X in the drawing.

Figure 40:
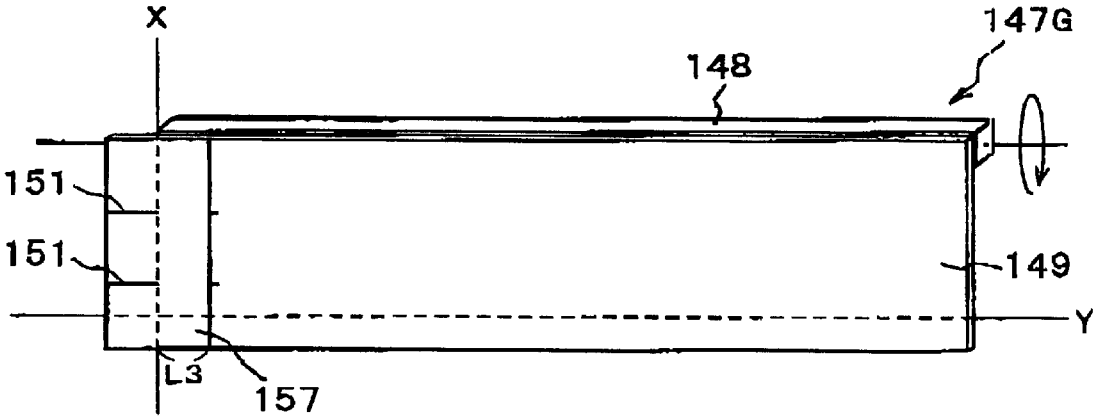
FIG. 40 is a schematic perspective view of a developer feeding member according to a further embodiment of the present invention.

The developer conveying member 147G illustrated in FIG. 40 was provided with a dedicated bottom scraping member 157, that is, the second elastic sheet, dedicated for scraping the bottom surface of the developer container 141, in addition to the elastic sheet 149, that is, the primary elastic sheet. The dedicated bottom scraping member 157 is attached to the portion of the rotatable rod 148 adjacent to the portion of the primary elastic sheet 149 which made theoretical entry into the developer amount detecting member 144.

This dedicated bottom scraping member 157 made theoretical entry into only the bottom wall of the developer container 141; it did not make theoretical entry into the side wall of the developer container 141. In this embodiment, the amount of the theoretical entry of the dedicated bottom scraping member 157 into the bottom wall of the developer container 141 was the same as that of the primary elastic sheet 149, and the position of the edge of this member 157 on the developer amount detecting member 144 side was made to coincide with that of the internal surface of the side wall of the developer container 141 represented by the broken line X in the drawing. The dedicated bottom scraping member 157 may be formed of the same material as the primary elastic sheet 149.

In other words, the developer conveying member 147G was structured so that the dedicated bottom scraping member 157, that is, the secondary elastic sheet, overlapped with the primary elastic sheet 149 in terms of the rotational direction of the developer conveying member 147G. In this embodiment, the dedicated bottom scraping member 157 was placed in front of the elastic sheet 149 in terms of the rotational direction of the developer conveying member 147G.

Figure 41:
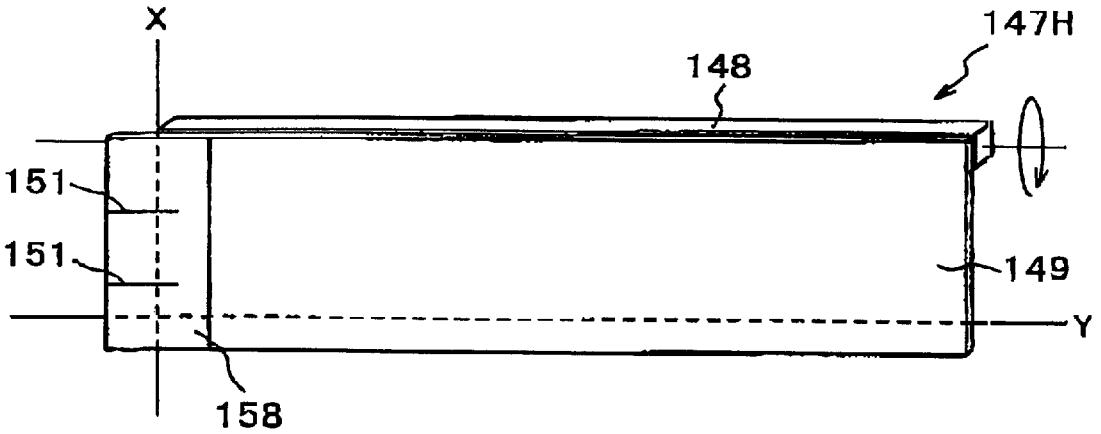
FIG. 41 is a schematic perspective view of a developer feeding member according to a further embodiment of the present invention.

In the case of the developer conveying member 147H illustrated in FIG. 41, in addition to the elastic sheet 149, that is, the primary elastic sheet, a dedicated lateral surface wiping member 158 or the secondary elastic sheet, dedicated for surface of the developer amount detecting member 144, was attached to the rotatable rod 148.

In this case, the elastic sheet 149 did not make theoretical entry into the developer amount detecting member 144, and only the dedicated lateral surface wiping member 158 made theoretical entry into the developer amount detecting member 144. The amount of the entry of the developer amount detecting member 144 into the developer amount detecting member 144 was 2 mm, which was equal to the basic measurement. Further, the dedicated lateral surface wiping member 158 was provided with a plurality of slits 159 similar to those cut into the elastic sheets of the above described developer conveying members 147A and 147G. The dedicated lateral surface wiping member 158 was structured so that it also made theoretical entry into the bottom wall of the developer container 141. The dedicated lateral surface wiping member 158 may be formed of the same material as the elastic sheet 149.

In other words, the structure of the developer conveying member 147H was such that the second elastic sheet 158 overlapped with a part of the first elastic sheet 149 in terms of the rotational direction of the developer conveying member 147H. In this embodiment, the dedicated lateral surface wiping member 158 was placed in front of the first elastic sheet 149 in terms of the rotational direction of the developer conveying member 147.

Table 1 shows the evaluations of the developer conveying members 147A–147H regarding the manner in which the developer remained on the bottom surface of the developer container 141 at the point in time when aberrant while spots began to appear (no-shake), and the manner in which the developer remained on the surface of the developer amount of detecting member 144 (wiping), and the conditions of the developer conveying member 147 during the developer consumption (stirring).

TABLE 1

| Developer stirring-conveying member | No-shake | Wiping | Stirring | Overall performance |
|---|---|---|---|---|
| A | developer remains in corners | G | G | F |
| B | G | G | G | G |
| C | developer remains in corners | developer tends to remain on outward side | G | NG |
| D | developer remains in corners | G | G | F |
| E | developer remains in corners | developer tends to remain on outward side | G | NG |
| F | G | developer tends to remain on outward side | G | F |
| G | G | G | G | G |
| H | G | G | G | G |

G: Good
F: Fair
NG: No good

As described above, in the case of the developer conveying member 147A (FIG. 34), the elastic sheet 149 sometimes floated from the bottom surface of the developer container 141, on the side which made theoretical entry into the developer amount detecting member 144, as shown in FIG. 49. Thus, there was a possibility that a certain amount of developer still remained in the corners of the developer container 141 at the point in time when aberrant white spots began to appear.

The performance of the developer conveying member 147B (FIG. 35) was satisfactory in all aspects of a developer conveying member, on which it was evaluated. It is reasonable to think that this satisfactory performance resulted from the fact that the elastic sheet 149 was provided with the slit 152 cut inward in alignment with the interior surface of the side wall of the developer container 141 and perpendicular to the entry direction of the elastic sheet 149, from the free end of the elastic sheet 149, and the provision of the slit 152 caused the force which applied to the elastic sheet 149, to separate into a component which acted in a direction perpendicular to the side wall of the developer container 141, and a component which acted in a direction perpendicular to the bottom wall of the developer container 141.

However, the further studies made by the inventors of the present invention revealed that if the length L2 of this slit 152 is greater than a predetermined length, the wiping force which was applied to the surface of the developer amount detecting member 144 by the elastic sheet 149 was likely to be reduced. Thus, the length L2 of the slit 152 should be determined according to the material and thickness of the elastic sheet 149, the dimension of the elastic sheet 149 in terms of the direction of the shorter edges of the elastic sheet 149, and the like factors.

In the case of the developer conveying member 147C (FIG. 30), the contact pressure between the elastic sheet 149 and the developer amount detecting member 144 was weak, and therefore, the force with which the surface of the developer amount detecting member 144 was wiped by the elastic sheet 149 was weak. As a result, a small amount of developer remained on the corners of the developer container 141 at the point in time when the aberrant white spots began to appear.

In the case of the developer conveying member 147D (FIG. 37), the edge portion of the elastic sheet 149 on the developer amount detecting member 144 side sometimes partially floated from the bottom surface of the developer container 141 as in the case of the developer conveying member 147A. Therefore, there was a possibility that a certain amount of developer would remain on the bottom surface of the developer container 141, across the area from the internal surface of the developer container 141 on the developer amount detecting member 144 side to a position corresponding to the position of the slit of the elastic sheet 149.

In the case of the developer conveying member 147E (FIG. 38), the contact pressure between the elastic sheet 149 and developer amount detecting member 144 was weak, and therefore, the force with which the surface of the developer amount detecting member 144 was wiped by the elastic sheet 149 was weak. Further, a small amount of developer sometimes remained in the corners of the developer container 141 at the point in time when the aberrant white spots began to appear.

In the case of the developer conveying member 147F (FIG. 39), there was a possibility that the contact pressure between the elastic sheet 149 and developer amount detecting member 144 would become weak, reducing the force with which the elastic sheet 149, in particular, the portion below the slit 156 in the drawing, that is, the portion on the free end side, wiped the developer amount detecting member 144.

The developer conveying member 147G (FIG. 40 was satisfactory in all of the evaluated aspects of the developer conveying member performance. However, the studies conducted by the inventors of the present invention revealed that when the dimension L3 of the dedicated bottom scraping member 157 in terms of the axial direction of the rotatable rod 148 was shorter than a certain length, the force with which the developer conveying member 147G scraped the developer remaining on the bottom surface of the developer container 141 was weak.

On the contrary, when the dimension L3 was greater than a certain length, the portion of the developer conveying member 147G, across which the first elastic sheet 149 and dedicated bottom scraping member 157 overlapped, was excessively strong in terms of stirring force. As a result, the amount of developer conveyed by the developer conveying member 147G became uneven across the entire longitudinal range of the developer conveying member 147G. Consequently, there was a tendency that the closer to the surface on which the developer amount detecting member 144 was placed, the faster the developer was consumed.

The dimension L3 of the dedicated bottom scraping member 157, that is, the dimension L3 of the area across which the first and second elastic sheets 149 and 157 overlap, should be determined according to various factors, for example, the material and thickness of each elastic sheet, the dimension of each elastic sheet in terms of the direction perpendicular to the rotational axis, and the like. Preferably, it should be determined in consideration of the bending strength of the area across which the two elastic sheets overlap, as will be described later.

The developer conveying member 147H (FIG. 41) was satisfactory in all of the evaluated aspects of the developer conveying member performance. However, the studies conducted by the inventors of the present invention revealed that when the dimension L4 of the dedicated bottom scraping member 157 in terms of the axial direction of the rotatable rod 148, in other words, the dimension L4 of the area across which the two elastic sheets overlap, was shorter than a certain length, the force with which the developer conveying member 147H scraped the developer remaining on the bottom surface of the developer container 141 was weak.

On the contrary, when the dimension L4 was greater than a certain length, the portion of the developer conveying member 147G, across which the first elastic sheet 149 and dedicated bottom scraping member 157 overlapped, was excessively strong in terms of stirring force.

The dimension L4 of the dedicated bottom scraping member 158, that is, the dimension L4 of the area across which the elastic sheets 149 and 157, that is, the first and second elastic sheets, respectively, overlap, should be determined according to various factors, for example, the material and thickness of each elastic sheet, the dimension of each elastic sheet in terms of the direction perpendicular to the rotational axis, and the like. Preferably, it should be determined in consideration of the bending strength of the area of the developer conveying member, across which the two elastic sheets overlap, as will be described later.

As will be understood from the above described results of the tests, when making the dimension of the elastic sheet 149 of the developer conveying member 147 in terms of the longitudinal direction of the developer conveying member 147 greater than the dimension of the internal space of the developer container 141 in terms of the same direction, in order to clean the surface of the developer amount detecting member 144 by placing the elastic sheet 149 in contact therewith, and also in order to no-shake-structure the process cartridge C by structuring the elastic sheet 149, so that it makes contact with the bottom surface of the developer container 141, if the slit 152 is cut, as in this embodiment, into the portion of the elastic sheet 149 corresponding to the interior surface of the developer container 141, on which the developer amount detecting member 144 is placed, from the free edge side, in the direction perpendicular to the axial direction of the rotatable rod 148, so that the force applies to the elastic sheet 149 is divided into a component which acts in the direction in which the elastic sheet 149 makes theoretical entry into the developer amount detecting member 144, and a component which acts in the direction perpendicular to the direction in which the elastic sheet 149 makes theoretical entry into the developer amount detecting member 144, not only can the process cartridge C be no-shake-structured, but also the surface of the developer amount detecting member 144 can be satisfactorily cleaned.

Further, if the developer conveying member 147 is provided with the supplementary elastic sheet as the dedicated bottom scraping member 157, or the dedicated lateral surface wiping member 158, in addition to the elastic sheets 149 and 149' as the primary elastic sheets, in other words, if the member for scraping the bottom surface of the developer container 141 and the member for wiping the developer amount detecting member 144 placed on the side wall of the developer container 141 are made independent from each other, so that the force which applied to the elastic sheets 149 and 149' is divided into a component which acts in the direction in which the elastic sheet 149 makes theoretical entry into the developer amount detecting member 144, and a component which acts in the direction perpendicular to the direction in which the elastic sheet 149 makes theoretical entry into the developer amount detecting member 144, not only can the process cartridge C be no-shake-structured, but also the surface of the developer amount.

The stirring forces of the above described developer conveying members 147G and 147H were further studied in relation to the bending strength of their portions correspondent corresponding to the bottom surface of the developer container 141. As a result, the following information was obtained. That is, when the bending strength of the portion of the developer conveying member 147G or 148H, across which the elastic sheet 149 or 149' as the first elastic sheet, and the dedicated bottom scraping member 157 or the dedicated lateral surface wiping member 158 overlapped, respectively, exceeded three times the bending strength of the weakest area of the portion other than the portion where the two elastic sheets were overlapping, the stirring force of the portion where the two elastic sheets were overlapping became excessively strong, making uneven the amount of developer conveyed by the developer conveying member 147, across the entire range of the developer conveying members 147H. As a result, developer unevenly remained in the developer container 141, across the range corresponding to the entire range of the developer conveying member 147G of 147H.

Therefore, the materials, thicknesses, and the aforementioned dimensions L3 and L4, of the dedicated bottom scraping member 157 or the dedicated lateral surface wiping member 158, as the second elastic sheet, the elastic sheet 149 as the second elastic sheet, should be determined so that the bending strength of the portion of the developer conveying member 147 across which the two elastic sheets overlap will become no more than three times the bending strength of the other elastic sheet portion, that is, the weakest portion, of the developer conveying member 147.

The definition of the bending strength is the force necessary to displace the portion of the elastic sheet, which corresponds to the bottom surface of the developer container 141, by 10 mm. The bending strength was measured for each elastic sheet.

As described above, according to this embodiment, the force with which the elastic sheet of the developer conveying member 147 makes theoretical entry into the developer amount detecting member 144, and the force which acts in the direction perpendicular to the surface of the developer amount detecting member 144, can be separated with the employment of a simple structure. Therefore, it is possible to provide a developer conveying member capable of conveying the developer in the developer container 141 while stirring it, wiping away the developer from the developer amount detecting member 144, as well as no-shake structuring the process cartridge, without the increasing cost thereof.

The application of the present invention to an image forming apparatus of a process cartridge type as in the preceding embodiments makes it possible to provide, without inviting a cost increase, the image forming apparatus with the structure which makes it possible to wastelessly use the developer within the developer container 141, without inconveniencing a user, and also the structure which wipes away the developer on the developer amount detecting member 144, in addition to the inherent advantages of a process cartridge system.

Figure 42:
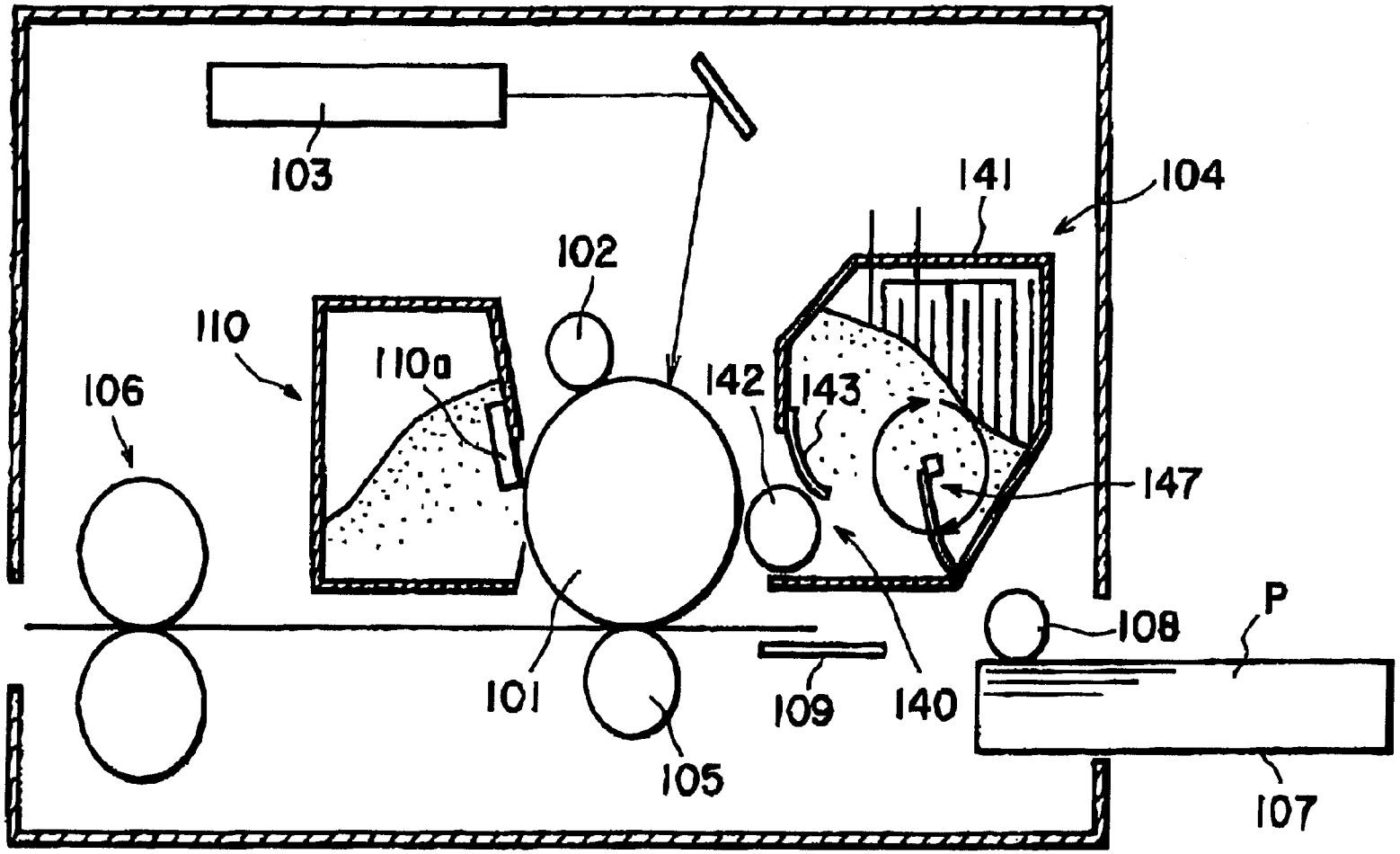
FIG. 42 is a schematic illustration of an electrophotographic image forming apparatus according to an embodiment of the present invention.
Figure 43:
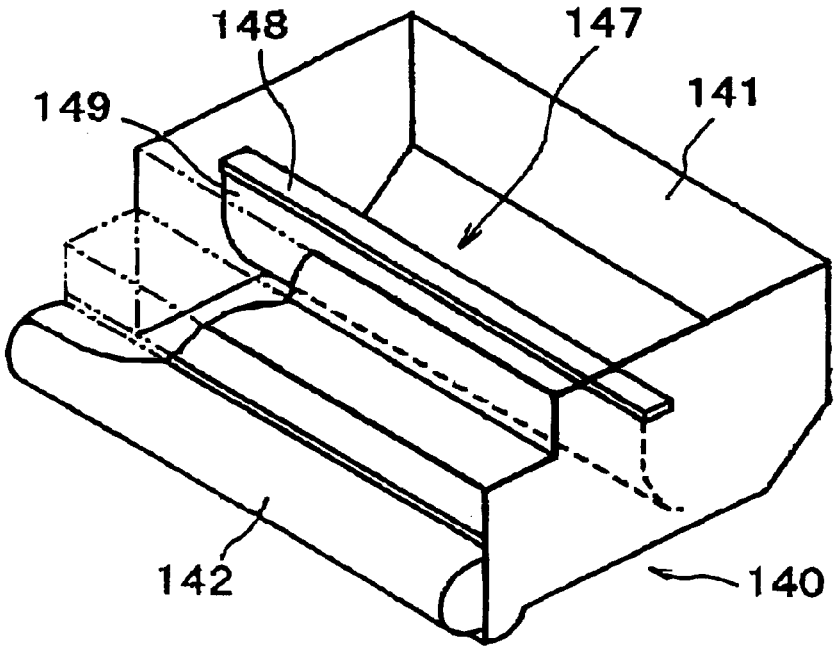
FIG. 43 is an illustration of an inner side of the developer container.

FIG. 42 shows the general structure of an electrophotographic image forming apparatus in accordance with the present invention.

This electrophotographic image forming apparatus is an electrophotographic laser beam printer, and forms images on recording medium through an electrophotographic image formation process.

The electrophotographic image formation process employed by this image forming apparatus is the same as the one employed by the image forming apparatus in the first embodiment. Therefore, the components of this apparatus similar to those of the apparatus in the first embodiment are given the same referential codes as those given to the corresponding components in the first embodiment, and their detailed description will be omitted According to this embodiment, the present invention can also be applied to an electrophotographic image forming apparatus which does not employ a process cartridge system. In other words, the developing apparatus 104, which has the developing means 140 comprising the development sleeve 142 and elastic blade 143, and the developer container 141 as a developer storage connected to the developing means, may be structured so that the developing apparatus 104 can be removably installable through the installing means with which the image forming apparatus main assembly is provided, or may be fixed to the image forming apparatus in such a manner that it can be replenished with developer.

The image forming apparatus in this embodiment has a developer amount detecting apparatus which is structured and functions in the same manner as the one in the first embodiment. In other words, as illustrated in FIG. 42, a remaining developer amount detecting member 144 similar to the one in the first embodiment is placed on the interior surface of the lateral wall of the developer container 141, that is, the interior surface of the developer container 141 perpendicular to the longitudinal direction of the development sleeve 142, and the amount of the developer within the developer container 141 is determined by detecting the electrostatic capacity of the remaining developer amount detecting member 144.

According to this embodiment, the developer container 141 and the developer conveying member 147 placed therein are structured so that the developer conveying member 147 conveys the developer while stirring it, and wipes away the developer on the surface of the developer amount detecting member 144, and also so that the process cartridge is no-shake structured.

In other words, the developer container 141 is provided with the developer conveying member 147B, 147G, or 147H, which were satisfactorily evaluated on all of the aforementioned aspects of developer conveying member performance, that is, the manner in which the developer remained on the bottom surface of the developer container 141 at the point in time when aberrant white spots began to appear (no-shake), and the manner in which the developer remained on the surface of the developer amount detecting member 144 (wiping), and the conditions o the developer conveying members 147 during the developer consumption (stirring).

As described above, the present invention can be also applied to, for example, an image forming apparatus in which the developing apparatus 104 is fixed to the image forming apparatus main assembly in such a manner that the developing apparatus 104 can be replenished with developer, and an image forming apparatus into which the developing apparatus 104 is removably installable, so that even in the case of an image forming apparatus which does not employ a process cartridge system, the developer conveying member is made to convey the developer within the developer container 141 which stirring it, and wipe away the developer from the developer amount detecting member 144, as well as to no-shape structure the apparatus.

Further, according to the present invention, the accuracy of the developer amount detecting member can be improved.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an electrophotographic photosensitive member, comprising:

a developing member for developing an electrostatic latent image formed on said photosensitive member with a developer;

a stirring member for stirring the developer by rotation thereof about an axis;

a detecting member, disposed at a longitudinal end of said stirring member, for detecting an amount of the developer; and a rubbing member for rubbing a surface of said detecting member, wherein said rubbing member is a member separate from said stirring member and is rotatable integrally with said stirring member, and wherein said rubbing member extends in a radial direction from the axis which is different from a radial direction in which said stirring member extends.

2. An apparatus according to claim 1, wherein said stirring member is a rod-like member having an end to which said rubbing member is provided.

3. An apparatus according to claim 1, wherein said stirring member is provided with a sheet member extending in a longitudinal direction thereof, and a free end of said sheet member rubs a bottom surface of a developer accommodating portion for accommodating the developer when it is rotated, and said sheet member stirs the developer and feeds the developer toward said developing member, and wherein said rubbing member is disposed adjacent a longitudinal end of said sheet member.

4. An apparatus according to claim 1, 2 or 3, wherein said rubbing member is an elastic sheet.

5. An apparatus according to claims 1, 2 or 3, wherein said detecting member has a measuring electrode which is disposed at such a position as to contact to the developer and which has at least one pair of portions spaced with a uniform gap, and wherein said detecting member also has a reference electrode which is disposed at such a position as not to contact to the developer and which has at least one pair of portions spaced with a uniform gap, and wherein said detecting member generates an electric signal in accordance with an electrostatic capacity which is indicative of an amount of the developer to permit a main assembly of the apparatus to detect the amount of the developer in substantially real time.

6. A process cartridge which is detachably mountable to a main assembly of an electrophotographic image forming apparatus, said process cartridge comprising:

(a) an electrophotographic photosensitive member; and (b) a developing apparatus for developing an electrostatic latent image formed on said photosensitive member, said developing device including:

a developing member for developing the electrostatic latent image formed on said photosensitive member;

a stirring member for stirring a developer by rotation thereof about an axis;

a detecting member, disposed at a longitudinal end of said stirring member, for detecting an amount of said developer; and a rubbing member for rubbing a surface of detecting member, wherein said rubbing member is a member separate from said stirring member and is rotatable integrally with said stirring member, and wherein said rubbing member extends in a radial direction from the axis which is different from a radial direction in which said stirring member extends.

7. An apparatus according to claim 6, wherein said stirring member is a rod-like member having an end to which said rubbing member is provided.

8. An apparatus according to claim 6, wherein said stirring member is provided with a sheet member extending in a longitudinal direction thereof, and a free end of said sheet member rubs a bottom surface of a developer accommodating portion for accommodating the developer when it is rotated, and said sheet member stirs the developer and feeds the developer toward said developing member, and wherein said rubbing member is disposed adjacent a longitudinal end of said sheet member.

9. An apparatus according to claims 6, 7 or 8, wherein said rubbing member is an elastic sheet.

10. An apparatus according to claims 6, 7 or 8, wherein said detecting member has a measuring electrode which is disposed at such a position as to contact to the developer and which has at least one pair of portions spaced with a uniform gap, and wherein said detecting member also has a reference electrode which is disposed at such a position as not to contact to the developer, and which has at least one pair of portions spaced with a uniform gap, and wherein said detecting member generates an electric signal in accordance with an electrostatic capacity which is indicative of an amount of the developer to permit a main assembly of the apparatus to detect the amount of the developer in substantially real time.

11. A process cartridge detachably mountable to a main assembly of an electrophotographic image forming apparatus, said process cartridge comprising:

an electrophotographic photosensitive member:

a charge member for electrically charging said photosensitive member;

a developing device for developing an electrostatic latent image formed on said photosensitive member, said developing device including:

a developing roller for developing an electrostatic latent image formed on said photosensitive member;

a feeding member for feeding a developer toward said developing member, wherein said feeding member is provided with a sheet member extending in a longitudinal direction thereof, and a free end of said sheet member rubs a bottom surface of a developer accommodating portion for accommodating of the developer when it is rotated, and said sheet member feeds the developer;

a detecting member for detecting an amount of the developer and which has at least one pair of portions spaced with a uniform gap, wherein said detecting member has a measuring electrode which is disposed at such a position as to contact to the developer and which has at least one pair of portions spaced with a uniform gap, and wherein said detecting member also has a reference electrode which is disposed at such a position as not to contact to the developer and which has at least one pair of portions spaced with a uniform gap, and wherein said detecting member generates an electric signal in accordance with an electrostatic capacity which is indicative of an amount of the developer to permit a main assembly of the apparatus to detect the amount of the developer in substantially real time, and wherein said detecting member is disposed at a longitudinal end of said feeding member; and an elastic sheet for rubbing a surface of said detecting member which is a member separated from said feeding member and which is integrally rotatable with said feeding member, and wherein said elastic sheet is disposed adjacent a longitudinal end of said sheet member, and wherein said elastic sheet extends in a radial direction from an axis which is different from a radial direction in which said feeding member extends.

12. A feeding member for a developing device having a developing member for developing an electrostatic latent image formed on an electrophotographic photosensitive member with a developer and a detecting member for detecting an amount of said developer, said feeding member comprising:

a feeding member for feeding the developer by rotation toward said developing member when it is mounted to said developing device, wherein said feeding member has a sheet member extending in a longitudinal direction thereof, and having a free end which rubs a bottom surface of a developer accommodating portion for accommodating the developer when it is rotated, wherein said sheet member feeds the developer; and an elastic sheet which is a member separated from said feeding member and which rubs a surface of said detecting member when it is mounted to said developing device and which is rotatable integrally with said feeding member, wherein said elastic sheet is disposed adjacent a longitudinal end of said sheet member, wherein said elastic sheet extends in a radial direction from an axis which is different from a radial direction in which said feeding member extends.

13. A developing device for developing an electrostatic latent image formed on an electrophotographic photosensitive member, developing device comprising:

a developing member for developing an electrostatic latent image formed on said photosensitive member with a developer;

a detecting member detecting an amount of the developer; and a feeding and rubbing member including a feeding portion for feeding the developer toward said developing member by rotation, wherein said feeding portion has a free end which rubs a bottom surface of a developer accommodating portion when it is rotated, and a rubbing portion for rubbing a surface of said detecting member by rotation, and wherein said feeding and rubbing member has a slit extending in a direction substantially parallel with an axis of the rotation.

14. An apparatus according to claim 13, wherein said slit extends in a direction crossing with the surface of said detecting member to be rubbed.

15. An apparatus according to claim 13, wherein said slit extends in a direction crossing with a bottom surface of said developer accommodating portion to be rubbed.

16. An apparatus according to claim 13, wherein said feeding and rubbing member includes an integral sheet member, and a free end of said sheet member rubs a bottom surface of a developer accommodating portion for accommodating the developer, and a lateral end thereof rubs a surface of said detecting member.

17. An apparatus according to claims 13, 14, 15 or 16, wherein said feeding and rubbing member is an elastic sheet.

18. An apparatus according to claims 13, 14, 15 or 16, wherein said detecting member has a measuring electrode which is disposed at such a position as to contact to the developer and which has at least one pair of portions spaced with a uniform gap, and wherein said detecting member also has a reference electrode which is disposed at such a position as not to contact to the developer and which has at least one pair or portions spaced with a uniform gap, and wherein said detecting member generates an electric signal in accordance with an electrostatic capacity which is indicative of an amount of the developer to permit a main assembly of the apparatus to detect the amount of the developer in substantially real time, and wherein said detecting member is disposed at a longitudinal end of said feeding member.

19. A process cartridge detachably mountable to a main assembly of an electrophotographic image forming apparatus, said process cartridge comprising:

an electrophotographic photosensitive member;

a developing device for developing an electrostatic latent image formed on said photosensitive member said developing device including:

a developing member for developing an electrostatic latent image formed on said photosensitive member with a developer;

a detecting member for detecting an amount of said developer; and a feeding and rubbing member including a feeding portion for feeding the developer toward said developing member by rotation, wherein said feeding portion has a free end which rubs a bottom surface of a developer accommodating portion for accommodating the developer when it is rotated, and a rubbing portion for rubbing a surface of said detecting member by rotation, wherein said feeding and rubbing member has a slit extending in a direction substantially parallel with an axis of the rotation.

20. A process cartridge according to claim 19, wherein said slit extends in a direction crossing with the surface of said detecting member to be rubbed.

21. A process cartridge according to claim 19, wherein said slit extends in a direction crossing with a bottom surface of said developer accommodating portion to be rubbed.

22. A process cartridge detachably mountable to a main assembly of an electrophotographic image forming apparatus, said process cartridge comprising:

an electrophotographic photosensitive member;

a developing device for developing an electrostatic latent image formed on said photosensitive member, said developing device including:

a developing member for developing an electrostatic latent image formed on said photosensitive member with a developer;

a detecting member for detecting an amount of said developer; and a feeding and rubbing member including a feeding portion for feeding the developer toward said developing member by rotation, wherein said feeding portion has an end which rubs a bottom surface of a developer accommodating portion for accommodating the developer when it is rotated, and a rubbing portion for rubbing a surface of said detecting member by rotation, wherein said feeding and rubbing member has a slit extending in a direction crossing with a rubbing surface, wherein said feeding and rubbing member includes an integral sheet member, and a free end of said sheet member rubs a bottom surface of a developer accommodating portion for accommodating the developer, and a lateral end thereof rubs a surface of said detecting member.

23. A process cartridge according to claims 19, 20, 21 or 22, wherein said rubbing member is an elastic sheet.

24. A process cartridge according to claims, 20, 21 or 22, wherein said detecting member has a measuring electrode which is disposed at such a position as to contact to the developer and which has at least one pair of portions spaced with a uniform gap, and wherein said detecting member also has a reference electrode which is disposed at such a position as not to contact to the developer and which has at least one pair of portions spaced with a uniform gap, and wherein said detecting member generates an electric signal in accordance with an electrostatic capacity which is indicative of an amount of the developer to permit a main assembly of the apparatus to detect the amount of the developer in substantially real time.

25. A feeding member for a developing device having a developing member for developing an electrostatic latent image formed on an electrophotographic photosensitive member with a developer and a detecting member for detecting an amount of said developer, comprising:

a feeding and rubbing member including a feeding portion for feeding the developer toward said developing member by rotation, wherein said feeding portion has a free end which rubs a bottom surface of a developer accommodating portion for accommodating the developer when it is rotated, and a rubbing portion for rubbing a surface of said detecting member by rotation, and wherein said feeding and rubbing member has a slit extending in a direction substantially parallel with an axis of the rotation.

26. A feeding member according to claims 12 or 25, wherein said developing device is provided in a process cartridge which is unified with said electrophotographic photosensitive member.

27. An elastic sheet for a developing device for developing an electrostatic latent image formed on an electrophotographic photosensitive member comprising a slit for reducing a force against a rotation which is applied in a plurality of directions when said elastic sheet is mounted in said developing device and is rotated, wherein said slit extends in a direction substantially parallel with an axis of the rotation.

28. An elastic sheet according to claim 27, wherein the force against the rotation is a force of reaction when the elastic sheet stirs a developer, a force of reaction when the elastic sheet feeds the developer, a force of reaction when the elastic sheet rubs a detecting member for detecting an amount of said developer, and/or a force when the elastic sheet contacts a bottom surface of an accommodating portion accommodating the developer.

29. An elastic sheet according to claims 27 or 28, wherein the slit extends in a direction crossing with a direction of the force received.

30. A process cartridge detachably mountable to a main assembly of an electrophotographic image forming apparatus, said process cartridge comprising:

an electrophotographic photosensitive member;

a developing device for developing an electrostatic latent image formed on said photosensitive member, said developing device including:

a developing member for developing an electrostatic latent image formed on said photosensitive member with a developer;

a detecting member for detecting an amount of said developer; and a feeding and rubbing member including a feeding portion for feeding the developer toward said developing member by rotation, wherein said feeding portion has an end which rubs a bottom surface of a developer accommodating portion for accommodating the developer when it is rotated, and a rubbing portion for rubbing a surface of said detecting member by rotation, wherein said feeding and rubbing member has a slit extending in a direction crossing with a rubbing surface, wherein said detecting member has a measuring electrode which is disposed at such a position as to contact to the developer and which has at least one pair of portions spaced with a uniform gap, and wherein said detecting member also has a reference electrode which is disposed at such a position as not to contact to the developer and which has at least one pair of portions spaced with a uniform gap, and wherein said detecting member generates an electric signal in accordance with an electrostatic capacity which is indicative of an amount of the developer to permit a main assembly of the apparatus to detect the amount of the developer in substantially real time.

* * * * *

UNITED STATES PATENT AND TRADEMARK OFFICE

CERTIFICATE OF CORRECTION

PATENT NO. : 6,463,225 B1
DATED : October 8, 2002
INVENTOR(S) : Daisuke Abe et al.

It is certified that error appears in the above-identified patent and that said Letters Patent is hereby corrected as shown below:

Column 1,
Line 18, "meaning" should read -- means --; and
Line 24, "removable" should read -- removably --.

Column 2,
Line 16, "os" should read -- of --.

Column 5,
Line 11, "a" should be deleted.

Column 7,
Line 15, ",and therefore," should read -- , therefore, --; and
Line 36, "can" should read -- can be --.

Column 8,
Line 42, "ambiance" should read -- ambient --; and
Line 44, "which" should read -- it --.

Column 9,
Line 33, "electrodes 23 is" should read -- electrodes 23 are --; and
Line 38, "ways" should read -- way --.

Column 10,
Line 12, "output" should read -- and output --; and
Line 28, "end" should read -- and --.

Column 11,
Line 3, "ace" should read -- are --;
Line 42, "the area," should read -- area, --;
Line 55, "9h" should read -- 9h shown in --; and
Line 67, "promote" should read -- prompt --.

Column 12,
Line 47, "ilk" should read -- 11A --.

Column 14,
Line 1, "am" should read -- as --;
Line 4, "the sheet" should read -- allowing the sheet --;
Line 21, "this" should read -- the --; and
Line 27, "20k," should read -- 20A, --.

UNITED STATES PATENT AND TRADEMARK OFFICE

CERTIFICATE OF CORRECTION

PATENT NO. : 6,463,225 B1
DATED : October 8, 2002
INVENTOR(S) : Daisuke Abe et al.

It is certified that error appears in the above-identified patent and that said Letters Patent is hereby corrected as shown below:

Column 15,
Line 4, "rib 30" should read -- rib 50 --;
Line 32, "small" should read -- small screws, --;
Line 40, "4B" should read -- 48 --; and
Line 46, "47" should read -- 47 is --.

Column 16,
Line 9, "measurement, electrode 20A aids" should read -- measurement electrode 20A side --; and
Line 58, "the, first" should read -- the first --.

Column 17,
Line 10, "or" should read -- of --; and
Line 29, "an" should read -- a --.

Column 18,
Line 4, "A" should read -- A, --;
Line 7, "28" should read -- is --;
Line 13, "portioned" should read -- portion --;
Line 23, "which" should read -- which is --;
Line 33, "principle" should read -- principal --; and
Line 65, "far" should read -- for --.

Column 19,
Line 25, "en" should read -- an --.

Column 21,
Line 30, "end" should read -- and --; and
Line 67, "to" should read -- is to --.

Column 23,
Line 8, "142" should read -- 142a --.

Column 25,
Line 28, "is a development amount detecting member" should be deleted;
Line 29, "144, and" should be deleted;
Line 32, "decreases" should read -- decreases; --.

Column 27,
Line 8, "is," should read -- is --.

UNITED STATES PATENT AND TRADEMARK OFFICE

CERTIFICATE OF CORRECTION

PATENT NO. : 6,463,225 B1
DATED : October 8, 2002
INVENTOR(S) : Daisuke Abe et al.

It is certified that error appears in the above-identified patent and that said Letters Patent is hereby corrected as shown below:

Column 30,
Line 24, "while" should read -- white --.

Column 31,
Line 58, "40" should read -- 40) --.

Column 32,
Line 66, "applies" should read -- applied --.

Column 33,
Line 26, "amount." should read -- amount detecting member 144 can be satisfactorily cleaned. --
Line 29, "correspon-" should be deleted; and
Line 30, "dent" should be deleted.

Column 35,
Line 7, "o" should read -- of --.

Signed and Sealed this

Twenty-sixth Day of August, 2003

JAMES E. ROGAN
*Director of the United States Patent and Trademark Office*